US007856938B2

(12) United States Patent
Marion et al.

(10) Patent No.: US 7,856,938 B2
(45) Date of Patent: Dec. 28, 2010

(54) GENERAL PURPOSE SUBMARINE HAVING HIGH SPEED SURFACE CAPABILITY

(75) Inventors: Reynolds Marion, Lake Butler, FL (US); Ezra Eugene Mock, Lake Butler, FL (US); Scott Anthony Shamblin, Gainesville, FL (US)

(73) Assignee: Marion Hyper-Submersible Powerboat Design LLC, Lake City, FL (US)

( * ) Notice: Subject to any disclaimer, the term of this patent is extended or adjusted under 35 U.S.C. 154(b) by 385 days.

(21) Appl. No.: 11/774,356

(22) Filed: Jul. 6, 2007

(65) Prior Publication Data

US 2008/0127878 A1 Jun. 5, 2008

Related U.S. Application Data

(63) Continuation-in-part of application No. 10/722,621, filed on Nov. 26, 2003, now Pat. No. 7,246,566.

(51) Int. Cl.
*B63G 8/00* (2006.01)

(52) U.S. Cl. ..... 114/312

(58) Field of Classification Search ..... 114/66, 114/121–125, 312
See application file for complete search history.

(56) References Cited

U.S. PATENT DOCUMENTS

| | | | | |
|---|---|---|---|---|
| 1,510,283 | A | 9/1924 | Lake | |
| 1,864,837 | A | 6/1932 | Lake | |
| 2,337,318 | A | 12/1943 | Eliuk | |
| 3,038,431 | A | 6/1962 | Bajulaz | |
| 3,129,681 | A | 4/1964 | Bajulaz | |
| 3,257,982 | A | 6/1966 | Meldrum | |
| 3,598,074 | A | 8/1971 | Schubert | |
| 3,716,009 | A | 2/1973 | Strickland | |
| 3,902,919 | A * | 9/1975 | Hespel | 429/39 |
| 4,458,618 | A | 7/1984 | Tuffier | |
| 4,494,472 | A | 1/1985 | Rougerie | |
| 4,565,145 | A * | 1/1986 | Mayall et al. | 114/271 |
| 4,676,545 | A | 6/1987 | Bonfilio et al. | |
| 4,745,860 | A | 5/1988 | Reymann et al. | |
| 4,889,066 | A | 12/1989 | Neil et al. | |
| 4,928,614 | A | 5/1990 | Forman | |
| 4,936,238 | A | 6/1990 | Childress | |
| 5,542,240 | A | 8/1996 | Snider et al. | |
| 5,713,299 | A | 2/1998 | Alino et al. | |
| 5,787,836 | A | 8/1998 | Blaisdell et al. | |
| RE36,093 | E | 2/1999 | Wyman et al. | |
| 6,619,224 | B1 | 9/2003 | Syfritt | |

(Continued)

FOREIGN PATENT DOCUMENTS

EP 0716012 6/1996

(Continued)

OTHER PUBLICATIONS http://ussubs.com/submarines/manned.php3.

(Continued)

*Primary Examiner*—Stephen Avila
(74) *Attorney, Agent, or Firm*—Saliwanchik, Lloyd & Saliwanchik

(57) ABSTRACT

The present invention provides a submarine that is capable of surface operation with its passenger compartment completely or predominately above the waterline. The vessel is capable of high-speed, long-range surface navigation and seakeeping.

389 Claims, 8 Drawing Sheets

U.S. PATENT DOCUMENTS

| | | | |
|---|---|---|---|
| 6,745,716 | B2 | 6/2004 | Belyeu |
| 7,143,710 | B2 | 12/2006 | Lang et al. |

FOREIGN PATENT DOCUMENTS

| | | |
|---|---|---|
| FR | 1399676 | 5/1965 |
| FR | 2648780 | 12/1990 |
| FR | 2688466 | 9/1993 |
| WO | WO 96/01207 | 1/1996 |
| WO | WO 99/52766 | 10/1999 |

OTHER PUBLICATIONS http://www.sub-find.com/mp26.htm.
http://www.subeo.com/history.htm.

* cited by examiner

GENERAL PURPOSE SUBMARINE HAVING HIGH SPEED SURFACE CAPABILITY

CROSS-REFERENCE TO A RELATED APPLICATION

This application is a continuation-in-part of patent application Ser. No. 10/722,621, filed Nov. 26, 2003, now U.S. Pat. No. 7,246,566 issued Jul. 24, 2007, which is hereby incorporated by reference in its entirety.

FIELD OF THE INVENTION

The present invention relates to a submarine capable of high-speed, long-range surface navigation.

BACKGROUND OF THE INVENTION

There are many different types of vessels that can be classified as submarines or submersibles. A submarine is typically considered an autonomous vessel, capable of moving forward and changing directions under water, capable of navigation on the high seas, with seakeeping capabilities, and capable of safely operating under water. A submersible is generally considered any vessel that can submerge and operate underwater, but may have limited or no capacity to navigate the seas on its own. Submarines and submersibles both carry human passengers under the surface of the water. Therefore, any submarine or submersible must at least be able to attain negative or neutral buoyancy, and provide propulsion for the passengers. Most submarines and submersibles also provide some sort of life support for the passengers, though some submersibles may require the passengers to wear Self-Contained Underwater Breathing Apparatus (SCUBA) gear. All submarines, and many submersibles, keep the passengers safe from the pressure of the water at depth.

Buoyancy is the upward force exerted by water on a submerged or partially submerged object. A vessel will float in water when the buoyant force pushing up is equal to the gravitational force pulling the vessel down. The buoyant force pushing up on an object in water is called hydrostatic lift. The magnitude of the buoyant force, or hydrostatic lift, is dependent of the amount of water displaced by a particular object. When an object is on the surface of water, gravity pulls it down, and if the bottom is sealed, as in a vessel, it will push water aside. The volume of water displaced will be equal to the volume of the object that is below the waterline, which is known as the surface displacement. The buoyant force acting on an object is equal to the weight of the volume of water displaced.

Since the displacement of a vessel on the surface of the water is dependent on its weight, it can be controlled by using ballast. Ballast is usually water that is allowed to enter a vessel into sealed hull compartments.

In surface ships, water is typically added to ballast compartments to add additional mass to the lower portions of the ship. This lowers the ship's center of gravity and therefore increases its stability on the surface. Submarines and submersibles have historically not needed ballast water for stability on the surface since they will usually already have a low center of gravity and little cargo variability. They also typically sit very low in the water while surfaced, with only a very small volume of the overall vessel above the waterline.

In submarines and submersibles, water is added to ballast compartments to help them sink below the surface. This can be looked at as either reducing the displacement of a vessel or increasing its weight; both have the same mathematical effect. In submarine terminology, adding ballast water is typically viewed as reducing the vessel's buoyancy. When ballast compartments are full, they are looked at as being essentially neutrally buoyant, and thus accounting for no buoyant force on the vessel. The mass of these ballast compartments must still be considered in the energy required to propel the vessel underwater. These ballast compartments are often called variable displacement, since they allow water to enter and reduce the buoyancy of a vessel by reducing its displacement.

For vessels capable of underwater operation, such as submarines and submersibles, they must attain neutral buoyancy by adjusting the amount of ballast water. Neutral buoyancy refers to the condition where the upward force of buoyancy equals the downward pull of gravity. In this condition, a vessel can use its propulsion systems to rise, sink, or move about in the water.

In typical submarines, the weight of the vessel is set such that it is just enough to overcome the buoyant force due to the vessel's fixed displacement. The fixed displacement is the volume of the portions of the sub that are watertight and cannot be flooded, which determines the minimum buoyancy. This setting of the weight is necessary to allow the vessel to submerge and attain neutral buoyancy even when it has no extra weight by completely flooding the controllable ballast. Thus, the variable displacement is determinant of its payload capacity. The fixed displacement in most submarines is contained mostly within the pressure hull, the strengthened passenger compartment that resists the extreme pressure of the water at depth.

Typical small submersibles are used for either deep-diving science or industry missions or for shallow-diving recreational trips. Both types have the minimal controllable ballast necessary to reach the buoyancy needed to barely rise above the surface just enough to allow passengers to enter and exit the vessel. The variable displacement is extremely small compared to the amount of fixed displacement in these vessels. Due to this fact, these small submersibles are not able to rise high enough above the surface to allow a majority of their volume to reside above the waterline. They are not able to achieve the amount of positive buoyancy necessary to do so. Keeping the majority of the volume of the vessel underwater when surfaced simplifies the design of the vessel and keeps it stable both underwater and while surfaced. However, this design approach gives very limited ability to travel on the surface and allows a very low degree of variability in payload.

While originally developed for military use, vessels capable of underwater operation are used today for a wide variety of purposes. Modern submarines and submersibles are very specialized, though, varying from vessels that serve as military weapons platforms to those that are used for deep-sea scientific research to those that are used for recreational shallow dives. Despite a large quantity of submarines and submersibles for many specialized tasks, no true general-purpose vessel capable of underwater operation exists that can be used for multiple applications. There is also currently no underwater vessel that is small, cost-efficient, and possesses significant autonomy, navigation capacity, and range. The only submarines in use today that can navigate on the high seas are huge, ship-sized military submarines. A small vessel capable of underwater operation with true navigation capacity and sea-keeping abilities would be extremely useful in both private industry and to the military.

The designs and capabilities of existing submarines and submersibles are varied, from simple underwater scooters for divers to the huge nuclear missile-armed boomers of the United States Navy. Nevertheless, all existing submarines and submersibles share the common trait that they are each designed for a very specific purpose and have limited utility in applications outside of their intended use.

Nearly all of the world's true submarines today are large, ship-sized military vessels. In fact, the only true submarines currently in use are the transoceanic military vessels used by the U.S. Navy and other industrialized nations. These are among the most sophisticated vessels capable of underwater operation ever built.

Some nations still use diesel-electric military submarines, which were in wide use during World War II. The modern versions display better submerged time, speed, stealth, and armament, but are similar in basic function. They use surface engines to charge electric batteries for a dive. Nuclear-powered designs that can spend months underwater have replaced many diesel-electric submarines in the U.S. Navy and in some foreign navies. The atomic reactors used to power these vessels can operate for years without needing to add fuel, and they typically only need to surface every few months to add supplies and exchange crews.

Transoceanic military submarines are used for many different missions, and each mission type is usually accomplished by a particular class of submarine. The U.S. Navy currently has the Ohio-Class Submersible Ship Ballistic missile Nuclear (SSBN), the Submersible Ship Guided missile Nuclear (SSGN)-Class, the Los Angeles and Seawolf Submersible Ship Nuclear (SSN) classes, and the Virginia SSN class. The Ohio-Class SSBN, also known as boomers, serve as a stealthy mobile launch platform for ballistic missiles. The SSGN-Class are boomers that are converted to carry cruise missiles and to serve as platforms for Special Forces operations. The L.A. and Seawolf SSN classes are fast attack submarines, and the Virginia SSN class is a fast attack sub, cruise missile launch platform, and Special Forces platform. All U.S. Navy submarines are atomic-powered and capable of diving to at least 800 feet below the surface of the water.

Transoceanic military submarines are designed for long-range cruising at relatively high speeds compared to surface vessels and for stealth. These vessels are typically as big as large surface ships. None of these military submarines have any non-military use. They are far too expensive and impractical to transport cargo. Passenger travel is cheaper, faster, more practical, and more comfortable by other means. Industrial use is not practical for these submarines since their size prevents operation around or under other vessels or offshore platforms. The lack of windows, large crew size needed for operation, and huge cost to produce precludes any tourism or recreational use. Thus, these huge military submarines have no other use besides their current warfare platform.

There are many existing submersibles collectively capable of a variety of different uses, but each individually only useful for a specific task. Smaller submersibles are used by both the military and private sector and are generally characterized by the fact that they are not used for navigation on the high seas but rather are vehicles used to access the depths of the ocean in a largely vertical range.

The most basic submersibles are pods that are lowered and raised in the water by a surface vessel using a support cable. Diving bells and bathyspheres are examples of these simple pods.

A diving bell is basically a submerged pocket of air in an air-tight compartment that is partially open at the bottom. The bottom may either have a hole in the center or a hatch that is opened when the diving bell is submerged at depth. A diving bell acts as an elevator taking divers deep under the surface of the water and as a decompression chamber slowly bringing divers back to the surface. A diving bell resists the extreme pressures at depth through the use of ambient pressure compensation. As the diving bell descends under water, the water pressure outside the diving bell increases. If no air is added to the diving bell, the water ingresses through the opening and begins filling the bell. The air trapped in the diving bell compresses at the top until it reaches the ambient pressure of the water outside. When the pressure on the inside and outside of the diving bell is equal, water stops intruding into the diving bell. As the diving bell continues to descend, the pressure becomes greater, the air compresses more, and the air pocket becomes smaller. Since the pressure is equal on the interior and exterior of the diving bell, the water does not cause any stress on the wall as long as the diving bell remains open. This means that common materials of low strength may be used to construct a diving bell, as long as they are reasonably airtight.

Typical modern diving bells are designed to remain dry on the inside. Compressed air is released into the diving bell at depth to prevent water ingress at depth. The air is usually provided by a surface support vessel via an umbilical connection. Air is provided at a pressure just higher than that of the water outside the diving bell. This causes air to slowly bubble out through the diving bell opening and keeps the air supply fresh for the passengers. When the diving bell ascends to the surface, the pressure of the water decreases and the air inside expands and bubbles out.

The main limitation of any ambient pressure submersible, including a diving bell, is a result of the limitations of the human passengers. The body is stressed by increases in ambient pressure but compensates by pulling more air into the lungs, increasing the amount of gases in the blood. If too much nitrogen enters the blood, narcosis may result. This threat can be somewhat eased by mixing other inert gases in the breathing mix, such as helium. Breathing mixes usually also have a lower percentage of oxygen than normal surface air since the compression causes additional oxygen to enter the blood. As the pressure drops when the ambient pressure submersible rises, the body must expel the excess gases accumulated during the compression dive though exhalation. This is a slow process; the longer time spent at depth, and the deeper the depth, the longer the expulsion of excess gases takes. If the ambient pressure submersible rises too quickly, the gases in the blood can bubble and cause "the bends," which is very painful and can result in a fatal embolism.

Therefore, passengers of an ambient pressure submersible must decompress as they surface, just as a SCUBA diver must. This limits the usefulness of ambient pressure submersibles to the same depths that SCUBA divers can reach. This a maximum of about 200 feet, with about 33 feet being a more practical for passengers that are not expert divers.

To allow for long duration dives and rapid ascent, and to protect passengers from dangerous high pressure conditions common to ambient pressure submersibles, the passenger compartment must be kept at the normal air pressure, one atmosphere. The pressure from the water tends to crush the passenger compartment more and more as the depth increases, though. The passenger compartment must be constructed in a strong, pressure-resistant manner.

A pressure hull is a manned pod constructed of extremely strong and durable materials capable of resisting the crushing force of water at depth and protecting passengers without ambient pressure compensation. Pressure hulls are usually spherical or cylindrical in shape since these shapes tend to be inherently resistant to compressive force. Any deviation from these shapes greatly reduces the pressure tolerance and thus the maximum depth reachable by the hull. Pressure hulls are therefore constructed with a high degree of precision in shape. These precise tolerances increase the time and expense of constructing the hull.

A bathysphere is a simple pressure hull suspended from a cable. It usually has a viewing window and accommodations for a crew inside. Stored oxygen and a carbon dioxide scrubber are commonly used for life support. Bathyspheres were the first submersibles to carry humans to depths over 3,000 feet below the surface of the water, and were originally used for scientific research. They are not used very much any more.

Diving bells and bathyspheres are both limited by the heavy steel cable connecting them to the surface or a surface vessel and by their complete lack of autonomy, both on and below the surface. A large surface vessel, with its own crew and cost is needed to provide the support cable or umbilical. The lack of self-propulsion, power storage, and buoyancy control, along with the hindrance of the large cable, prevent either of these from being submersible vehicles. Instead, they are useful for operations or observation only. The bathysphere is limited to a depth of about 3,500 feet while diving bells become dangerous deeper than around 300 feet.

Deep Submergence Vehicles (DSVs) are designed to reach the deepest portions of the ocean. A relatively small number are in existence and have been used for scientific and military research purposes. DSVs usually require a support vessel and cannot navigate. DSVs have two categories: bathyscaphes and deep-dive submersibles.

The bathyscaphe is an old vessel no longer in production, and very few have ever been built, likely less than 10. A bathyscaphe was the vessel used to reach the deepest point on Earth, the Challenger Deep portion of the Marianas Trench in the South Pacific Ocean. A bathyscaphe is a spherical pressure hull suspended from a buoyant superstructure filled with petroleum fuel. The fuel is not used for power, but rather to provide resistance to compression at depth. The fuel also provides buoyancy control. To descend, fuel is released to reduce buoyancy. To ascend, metal pellets are released from the vessel to reduce weight. The pellets are held in place in hoppers via electromagnets, meaning that electrical failure would result in the vessel immediately rising towards the surface. Battery-powered electric thrusters provide propulsion and steering under water, but this capability is extremely limited due to the large superstructure.

While being able to dive to great depths, the bathyscaphe is very limited by its size and low maneuverability under water. It is also difficult to launch and recover. No bathyscaphes are currently known to be in operation.

Deep-dive submersibles are small battery-powered submersibles with a spherical steel pressure hull. They are similar to bathyscaphes, but are smaller and without the fuel-filled superstructure. The pressure hull is typically thinner than that of a bathyscaphe, resulting in a lower maximum depth. The lower weight allows ascension to the surface to be achieved without the fuel superstructure of the bathyscaphe. Deep-dive submersibles rise using the buoyancy of the pressure hull along with high-pressure air-blown buoyancy tanks and oil-filled equipment chambers or high-strength glass-bead foam blocks.

Deep-dive submersibles have small ballast tanks that fill with air at the surface to allow the vessel to have a small portion of its volume above the waterline. The ballast tanks flood to cause the vessel to dive, and the tanks remain open at the bottom, maintaining ambient pressure at depth. These vessels are typically negatively buoyant when diving, using the force of gravity to sink until the desired depth is reached. Then, the vessel can drop weight and add high-pressure air to the ballast tanks to achieve neutral buoyancy. To rise back to the surface, deep-dive submersibles drop disposable metal ballast and do not typically need electric propulsion. Battery-powered electric motors are used for limited underwater propulsion and steering. Deep-dive submersibles are more maneuverable than bathyscaphes due to their smaller size.

The reliance on drop weight to return to the surface can be a problem for deep-dive submersibles. If reconfiguration is desired or if a weight needs to be lifted during a dive, this can be difficult to achieve. Deep-dive submersibles have a low weight budget for ascending, since there is little variability in their buoyancy and minimal drop weight. The air-blown ballast tanks contain only a small fraction of the displacement of the passenger compartment and provide very minimal adjustable buoyancy.

Extreme safety precautions and precise engineering are necessary with a deep-dive submersible. Since the pressure hull's displacement is needed to rise to the surface, any flooding of the pressure hull will cause the vessel to sink to the bottom. The precise engineering necessary to help avoid this risk increases the cost of production.

DSVs have little or no navigating ability or range, since they use battery-powered thrusters and have the majority of their volume under water when surfaced. A surface vessel is needed to deliver them to and retrieve them from a dive site. Huge cranes are often needed to lower DSVs into the water.

Additionally, DSVs have very small passenger compartments. The spherical pressure hulls are usually designed with the minimum radius necessary to accommodate a crew and vital instruments. The U.S. Navy has one DSV that is larger than most typical DSVs, but it is too expensive to be practical for non-military purposes. Overall, DSVs are useful for a very small range of tasks but are severely limited by their lack of range, seakeeping ability, autonomy, and speed.

Another existing common type of submersible is the tourist submersible. Tourist submersibles are some of the largest private submersibles, often accommodating 16 or more passengers. They usually have a pressure hull and operate at a depth of between 1-300 feet of water. The pressure hull is usually large, elongated, and made of steel with some oversized hemispherical acrylic viewing windows. Tourist submersibles are powered by large battery arrays located in the keel and are propelled by electric thrusters.

Tourist submersibles are not useful for purposes other than sightseeing. They lack speed, autonomy, and navigation capability. They only have a small portion of their volume above the waterline when surfaced. They are dependent on battery power and air stores, which require a support vessel or dock to recharge. Tourist submersibles must be large in size to be cost effective, but their size causes them to be depth-limited due to the large force exerted on the pressure hull.

Tourist submersibles use the buoyancy of the passenger compartment to rise to the surface, similar to DSVs. Thus, any failure of a pressure hull penetration could cause the submersible to sink to the bottom. This leads to increased engineering costs.

Some tourist submersibles have been manufactured with small diesel engines giving them the autonomy to go to a dive site and back without a support vessel. However, these vessels still lack open-ocean navigation ability and are very limited in their range. They are also unsafe to operate in even moderately rough seas and still suffer from the problems of other tourist submersibles with respect to depth, speed, size, and cost.

Ambient pressure personal submersibles resist pressure at depth using ambient pressure compensation as a diving bell does. This limits their use to depths that a SCUBA diver can reach. The simplest ambient pressure personal submersible is a wet hull submersible.

A wet hull submersible is an underwater vessel where the passengers are exposed to the water while the vessel propels them through the water. They typically have small ballast tanks to help attain neutral buoyancy and electric motors for propulsion. The passengers are supplied air via an air-filled helmet or a breathing apparatus such as SCUBA gear.

Wet hull submersibles are obviously very limited in their use. The passengers are exposed to the water temperature, which can be problematic in cold climates. The passengers are also exposed to pressure at depth, which means wet hull submersibles are limited to depths of around 200 feet even when manned by expert divers using mixed gas for breathing. A depth limit of 33 feet is more practical for sport divers.

The military uses a wet hull submersible called a Seal Delivery Vehicle (SDV). The passenger compartment is completely enclosed, but still flooded. Thus, the SDV suffers from the same shortcomings as other wet hull submersibles.

An ambient pressure dry hull is a submersible with the hull sealed so that the interior is dry. A gauge is used to determine the ambient pressure of the water outside. Air is added to the passenger compartment through valves until the interior pressure equals the exterior pressure of the water. A check valve is used to release the air as the submersible rises to the surface and the water pressure decreases. The hull can be constricted in any reasonable shape and any material that is reasonably airtight.

Ambient pressure dry hulls are depth limited by many factors. First of all, the amount of air and battery power reserves they carry prevents them from going too deep. More importantly, though, they are limited by the human body. A depth of about 200 feet can be achieved with highly trained divers, but a more practical depth limit is 33 feet below the surface of the water.

Ambient pressure personal submersibles are generally battery-powered. They have little surface range, seafaring capability, or autonomy. They rely on surface vessels to reach a dive site and to recharge their batteries and air supply. A few ambient pressure personal submersibles have been built with diesel surface engines, but they still face the same depth limitations as all other ambient pressure designs.

The Advanced Seal Delivery System (ASDS) is a submersible that uses a pressure hull for Navy Seal operations. It is relatively large for a submersible, at 62 feet long. The ASDS is a highly special-purpose vessel, designed for stealth utility. It uses only battery power for propulsion, which severely limits its range and seafaring abilities. The ASDS has low amounts of buoyancy for rising to the surface, and instead commonly docks underwater with a host submarine. The cost of these submersibles is extremely high, meaning they have no non-military use.

Every existing submarine and submersible is designed, built, and used for a specific role. Thus, there exists a need for general purpose submarine. Such a submarine would be capable of performing many roles under water and able to navigate on the surface, with strong seakeeping ability, long range, high speed, and autonomy. Such a vessel would be useful for both the private sector and the military. There are many characteristics and capabilities a general purpose submarine should possess.

A general purpose submarine will need to be relatively small in size but should still be able to accommodate passengers. Submarines have historically been impractical for long-range cargo or passenger transport. Sightseeing, industrial, and security uses are all good uses for a submarine, but all require small submarines relative to the atomic-powered military behemoths. Small size is also key to reducing the cost of producing, operating, and maintaining a submarine. Smaller pressure hulls allow submarines to operate at greater depths than their larger counterparts since the water pressure is spread over a smaller surface area on the hull. Good general purpose submarines should be able to accommodate a crew or passenger contingent of from as few as one to as many as 12 people during a dive. In most cases, this should be accomplished by use of various sizes of a one-atmosphere pressure hull providing safety and rapid ascension. This capacity is useful for scientific, military, recreational, industrial, and other uses.

A general purpose submarine should be a capable navigator with a long operating range and strong seakeeping abilities. It should also be autonomous, capable of generating its own power and air supply and storing them for a dive. Such a vessel would be more efficient and less expensive than a vessel that requires a surface support vessel. The safety factor in rough seas would also be higher since it could ride out the storm without the assistance of a surface support vessel. The ability to navigate over a long range would allow private industry to be able dispense with the cost of a surface support vessel for the first time. The submarine could deploy from a regular dock and travel to its destination on its own.

A good general purpose submarine should be able to attain decent speed, as traveling at high speeds is useful in many circumstances. Speed allows a tourist sub to carry more passengers without the need for a surface support vessel. Speed is also useful in military and security operations. Further, speed lowers mission duration, which decreases costs, and allows a vessel to avoid approaching storms.

A general purpose submarine should be configurable, possessing the ability to take on equipment needed for several different types of missions. Configurability is a key feature of a general purpose sub. Such a vessel should be able to increase passenger compartment comfort when used in a recreational or tourist role; have weaponry and armor added to it in a military role; and be equipped with cameras, manipulators, storage, and tools in a scientific or industrial role. These reconfigurations should not require substantial redesigning of the vessel; ideally these reconfigurations should not significantly increase the cost and time needed to deploy these variations of the general purpose submarine.

A general purpose submarine should be capable of diving and keeping passengers safe at depths that encompass the majority of water that is useful to industry and tourism. While for some purposes, such as tourism, depths of 33 feet may be sufficient, in many embodiments, such a vessel should be able to dive to at least 500 feet, covering about 90% of the useful water. These depths are sufficient to offer stealth to the military as it exceeds the depth at which light penetrates the water in most locations, and even long-range military submarines rarely operate below depths of 1,000 feet. For industrial operations, the majority of oil pipelines and infrastructure lie in the first 300 feet of water.

The amount of time a general purpose submarine should be able to sustain a dive should allow the maintenance of depth for at least a full work day. This would allow industrial or scientific operations to accomplish a sufficiently full day's work, and would enable a military user to remain submerged during all daylight hours to remain hidden. Longer dive time capability increases safety as well, as it allows for additional time to rescue a stricken submarine.

Any general purpose submarine should have a high degree of safety. Due to the fact that it will be autonomous and capable of navigating the high seas on its own, safety becomes particularly important. Such a vessel should be capable of handling severe weather conditions and unforeseen circumstances on the surface, as well as multiple system failure during a dive.

A general purpose submarine should be able to be constructed at low cost. The production and operating costs should not exceed the combination of costs of a surface ship and a submersible, or of a surface ship with a Remotely Operated Vehicle (ROV).

Many challenges must be overcome to design and build a general purpose submarine with such characteristics and capabilities as many of those listed above. First of all, small size must be reconciled with high speed, navigation, seakeeping ability and long range.

It has historically proven difficult to design a relatively small submarine capable of long-range navigating and seakeeping at high speed. Typical submarines that do the listed capabilities are extremely large, bulky, and expensive. These submarines have been useful only for the military. Private industry has solved the navigation issue by transporting small submersibles using surface vessels, which is costly and wasteful. However, the desire for long-range navigating and seakeeping at high speed indicate that such a general purpose vessel should be a true submarine, not a simple submersible, thereby making it more difficult to design. The vessel must either be capable of long-range navigation underwater or must be capable of handling as a true surface craft in addition to its ability to operate under water. Long-range underwater navigation has only been successfully accomplished through the use of nuclear power or enormous battery banks charged on the surface by diesel power. These methods are practical in large, transoceanic military submarines, but are not possible in a smaller submarine.

Existing designs of small submersibles are incapable of acting as a true surface craft. Small submersible designs rely on batteries and electrical motors for propulsion. Batteries are very limited in the amount of energy they store, so to operate as a true surface craft, a vessel should carry a large, heavy fuel load. Large, powerful engines should also be present for the submarine to operate capably on the surface. The use of large, powerful engines and large fuel reserves allow high speed, long range, and large payload capacity in surface boats. However, it is not a simple task to add such engines to an existing submersible design. Attempts that have been made to add diesel engines to tourist submersibles or smaller industrial submersibles have been ineffective since their functionality is limited by the design of the submersibles.

The first reason for the failure of the attempts to add large engines and fuel stores to existing designs is due to the increase in weight caused by these additions. Small submersibles typically have small amounts of buoyancy, and extensive modifications are necessary when adding significant weight. Adding a large engine and fuel would lead to the vessel not being able to surface. Such a vessel would obviously have no practical utility. Thus, additional displacement must be added to the vessel to provide additional buoyancy.

Small submersible designs have increased the size of their pressure hulls to provide the added displacement. This protects the engines from pressure and water at depth as well as adding the necessary displacement to allow the vessel to surface. To accommodate the large engine requires a significant increase to the pressure hull, though. Such an increase drastically increases the vessel's weight and fixed displacement (which increases the submersion weight). The net result of such an arrangement is either a decrease or minimal gain in the power-to-weight ratio of the vessel. The massive increases in weight necessary to add power to a small submersible using this method sets up the paradox that the power is self-defeating because of the weight. Therefore, small submersible designers have only been able to include small engines and fuel tanks. The small amounts of power provided severely limit navigation, seakeeping, speed, and range.

The second reason for the failure of the attempts to add large engines and fuel stores to existing submersible designs is because of the hull shape and draft. The typical hull shape of a submersible is cylindrical, optimized for underwater operation and handling at fairly low speeds. When operating on the surface, with the majority of their volume below the waterline, these vessels handle very poorly, incurring significant drag. They also have poor seakeeping ability because of the lack of a sharp bow necessary to pierce waves and handle rough seas. Therefore, increasing the power only minimally increases the speed, since the deep draft and improperly shaped hull result in significant drag and extremely poor handling in rough seas.

Another challenge that must be overcome to design and build a general purpose submarine is reconciling small size with configurability. Existing small submersibles have proven to be very difficult to make configurable. A main reason for this difficulty is the way submersible designs approach buoyancy. Most submersibles are designed with minimal buoyancy when surfaced, leading to very little ability to carry extra weight and still maintain their capability to surface. The passenger compartment must also be very carefully engineered and scrutinized since almost all the submersible's buoyancy comes from it. Any water intrusion into the passenger compartment could cause the submersible to sink and kill the passengers. Adding equipment to the hull typically requires redesigning the entire vessel. Therefore, submersibles are designed with a maximum load, and any reconfiguration requires an extensive redesign. It is too costly, time-consuming, and impractical to reconfigure the vessel for alternative uses once it has been built.

The next challenge to overcome in designing and building a general purpose submarine is reconciling design simplicity and low cost with dive depth and duration. Submersibles that have typically been affordable for private users are ambient-pressure submersibles. These do not require heavy-duty pressure hulls and the engineering challenges that come along with pressure hulls. However, ambient-pressure submersibles are only safe at depths of about 33 feet, and only up to about 200 feet for experienced divers using mixed breathing air.

On the other hand, a pressure hull is needed to allow a vessel to achieve great depth and long duration dives. Existing submersible designs incorporating pressure hulls are subject to catastrophic threats if swamping and leakage occur, and thus they require costly, complex safety engineering. Thus, using existing designs, it is not possible to achieve deep and long duration dives while also keeping the cost low and the design relatively simple.

The next challenge in designing and building a general purpose submarine is reconciling design simplicity and low cost with safety. One of the key problems in designing a simple, low cost submarine has historically been the huge expense that goes into engineering safety into a typical submersible. While ambient-pressure submersibles are relatively low cost and of simple design, they are inherently dangerous and must be operated by trained individuals who understand the process of decompression. Pressure hull designs are inherently safer than ambient-pressure designs since they do not expose the passengers to increases in pressure at depth. Though safer, the pressure hull design requires a lot of high cost engineering to remain safe because of the pressure differential that exists at depth. Additionally, due to the small amount of buoyancy typically present aside from the pressure hull, a failure in the pressure hull will result in the submersible sinking to the bottom in a typical design. Thus, complex engineering and maintenance precautions must be used to ensure safety. This increases the cost. Once again, using current designs, it does not seem possible to design a simple, low cost submarine with a high degree of safety.

Another challenge to overcome for a general purpose submarine to be designed and built is reconciling navigation, high speed, seakeeping, and long range with configurability. A submarine that is able to be configured for multiple roles must be small in size. However, small size is incompatible with traditional notions of what is necessary to achieve long-range navigation and seakeeping abilities at high speed. Additionally, a configurable submarine must be capable of carrying a variable payload.

Speed, range, and navigation and seakeeping abilities require large engines and large fuel stores. The submarine must be capable of carrying this weight. Additionally, configurability increases the payload requirements since the vessel must be able to carry a wide variety of heavy items, such as manipulator arms, weaponry, armor, cabin furnishings, deck space accompaniments, or added instrumentation. The limited amount of displacement, and thus buoyancy, in typical designs prevents this extra weight from being possible since the submersible will not be able to surface if it were to be added.

BRIEF SUMMARY OF THE INVENTION

The subject invention provides a submarine capable of high-speed, long-range surface navigation and seakeeping akin to a surface vessel, such as a speed boat. The present invention takes a very unique approach to overcome the challenges of providing a general purpose submarine. It is also the first submarine able to be mass produced.

The submarine of the present invention comprises primary assemblies including a surface hull, a passenger compartment, a main ballast compartment, a surface engine compartment, as well as many optional assemblies and components. The use of interchangeable primary assemblies and component connection grids that allow ease of component swapping results in a purpose-configurable vessel. Among the primary assemblies that may be included on the vessel are a passenger compartment, a surface hull, an upper body works, a surface engine compartment, a central framework, side tanks, and main internal ballast.

The submarine typically includes a very large amount of variable displacement via a staged ballasting system. The unique ballast system comprises main internal ballast compartments, main external ballast compartments, a trim ballast system, and semi-controllable ballast zones. The total volume of fully-controllable ballast is usually about twice the volume of fixed displacement in the passenger compartment and about equal to the volume of surface displacement of the entire vessel, though the actual fully-controllable ballast volume may be more or less than these estimates.

In certain embodiments, the main internal ballast compartments remain completely flooded and open to the environment while the vessel is submerged under water. No ambient-pressure air compensation is necessary since they remain open to the water, functioning like a wet hull. The main external ballast compartments only fill to the extent necessary for the submarine to attain neutral buoyancy. They are sealed by valves from both the main internal ballast compartments and the exterior environment at the beginning of a dive. Ambient-pressure air compensation is provided at depth for the main external ballast compartments. In certain embodiments, each main internal ballast compartment is connected to a main external ballast compartment via a pea trap connection.

In embodiments containing a trim ballast system, the trim ballast system comprises a series of smaller ballast compartments and is used to adjust the trim of the vessel. The trim ballast compartments are often located at the front portion of the side tanks, and the stability tanks serve as rear trim compartments. Other optional trim compartments may be added as well where desired.

The semi-controlled ballast zones are free-flooding zones that are purged by gravity as the submarine surfaces and are substantially closed to the water during surface operation. During the surfacing process, the main internal and external ballast compartments typically lift the vessel until the free-flooding semi-controllable ballast zones are just above the waterline. Then, these zones gravity drain through large one-way valves, hull gates, or a combination, until purged. The net effect is that the semi-controlled ballast is neutrally buoyant while the vessel is submerged but provides additional displacement while the vessel is surfaced. Also, the semi-controlled ballast provides freeboard displacement in the portion that resides just above the waterline while surfaced. This freeboard displacement helps inhibit the vessel from rocking side to side while surfaced.

The submarine of the present invention typically includes a passenger compartment which will usually be a pressure hull. A pressure hull passenger compartment is constructed of very strong materials capable of resisting pressure at depth and will usually be cylindrically or spherically shaped. The passenger compartment ideally sits high in the vessel, separated from the water during surface operation by a surface hull. When the submarine is surfaced, the passenger compartment is completely lifted out of the water or isolated from the water by the surface hull, such that no part of it makes direct contact with the water. The controls for the pilot are located in the passenger compartment, and any through-hull penetrations will generally only be in the lower third of the compartment.

The submarine comprises a surface hull, which can be any type of hull, such as a displacement hull or a planing hull, depending on the performance characteristics desired by the end user. The surface hull contains the main internal ballast compartments and may contain several other components. The use of a surface hull helps provide the vessel with significant amounts of displacement and lift on the surface. This lowers the drag and allows the vessel to travel at high speeds on the surface of the water.

The vessel usually includes an upper body works, which surrounds portions of the passenger compartment, extending laterally from either side of it and also often above it in the rear. The exterior includes the decking; the spoiler, if present; and the stability tank mounts. Retractable dive planes, if present, will typically be located in the upper body works. A semi-controllable ballast zone resides in the interior of the upper body works, and additional components may also be housed there.

The vessel often comprises a fuel and surface engine system. The fuel and surface engine system preferably includes at least one variable displacement fuel cell, at least one fuel grid, at least one surface engine, at least one gear system, at least one out drive, and at least one surface engine compartment.

The vessel vacuums fuel from the variable displacement fuel cells such that they lose volume as fuel is used. The fuel grid supplies fuel throughout the vessel, and the surface engines provide power to the vessel. The out drives connect to the surface engines and provide propulsion.

The surface engine compartment is either a pressure hull or is ambient-pressure air compensated at depth. It houses many components, including the surface engines. If it is ambient-pressure air compensated, it can be built of lighter materials.

The vessel typically has at least one air grid that provides air to different parts and systems of the vessel. There are usually four or five air grids in the air system, including the high-pressure air storage grid, the emergency air grid, the ambient-pressure air compensation grid, the oxygen grid, and, in certain embodiments, a low-pressure primary air grid. Each system serves different purposes, but they share many common connections and resources.

The air system serves many purposes on the vessel. It is used to purge the ballast compartments, provide ambient-pressure air compensation to components and assemblies, provide life support to the passenger compartment, and vent the battery tubes, if present. The air system can also be used to provide umbilical support to divers and to convert a pressure hull passenger compartment to an ambient pressure compartment, if desired.

The air system also often comprises carbon dioxide scrubbers. Together with the oxygen stores, they provide a robust life support system to help enable the submarine to maintain long duration dives.

The air system is capable of recharging itself, contributing to the autonomous nature of the vessel. The high-pressure air storage grid uses surface air and compresses it, and the other air grids (excepting the emergency grid) use down-regulators to draw air from this grid.

The vessel usually comprises an electrical system which is used to provide power to electrical components. This system comprises at least one alternator, at least one battery, and at least one electrical grid.

The alternator draws power from the surface engine while the vessel is surfaced and charges the batteries, which store the power. The electrical grid includes wiring, relays, and switches, and connects many different components to the power stored in the batteries. The vessel has three different electrical systems, including the primary electrical system, the secondary electrical system, and the supplemental electrical system. The primary system serves to charge the secondary system, and the supplemental system draws power from the secondary system via an inverter.

The vessel of the present invention typically has a hydraulic system as a means of transferring power throughout the vessel. This system powers rams that operate dive planes, the entry to the passenger compartment, the surface engine compartment lid, and the steering and trim of the out drives. Hydraulics additionally actuates valves around the vessel and transfer power to thrusters.

The hydraulic system can be divided into the propulsion hydraulic system, the auxiliary hydraulic system, and the control hydraulic system. The propulsion system uses two electric motors powered by the primary electrical system. The auxiliary system is powered by hydraulic pumps driven by the surface engines. The control system uses a hydraulic power unit driven by the secondary electrical system and makes use of a hydraulic accumulator.

The submarine also often comprises submersion pods, which are pressure-hull based or ambient-pressure compensated compartments outside of the passenger compartment. These submersion pods can be used to house many different components, including batteries and a wide array of optional equipment.

The vessel as a whole is very easily configured for a particular purpose. Each of the primary assemblies is made with attachment points to mount to other assemblies or to a central framework assembly, and with grid connections. Thus, these assemblies can be easily swapped out or removed for quick repair.

The present invention will be described in more detail below with reference to the accompanying drawings.

DETAILED DESCRIPTION OF THE INVENTION

Figure 1:
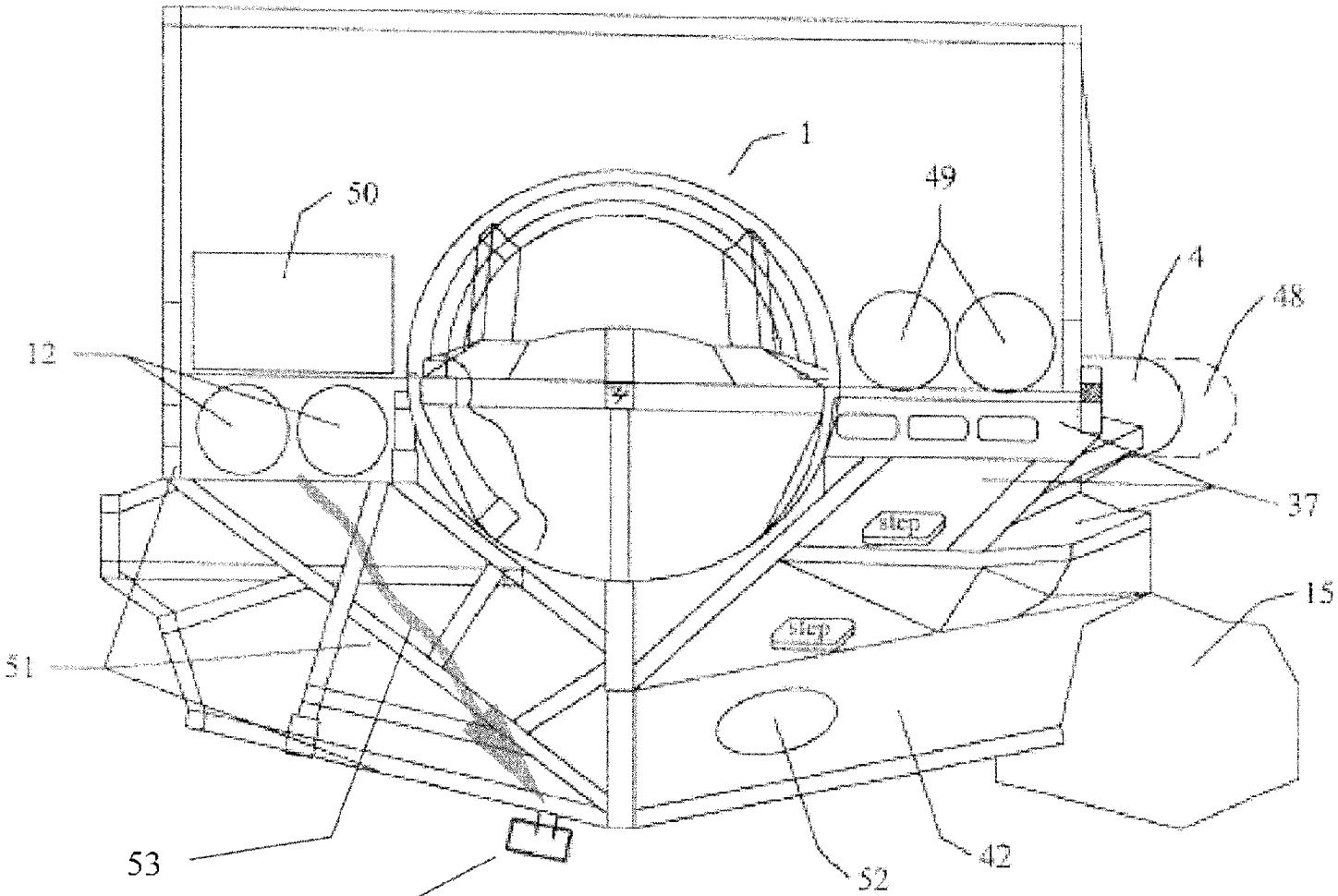
FIG. 1 is a front view of an embodiment of the subject invention.
Figure 2:
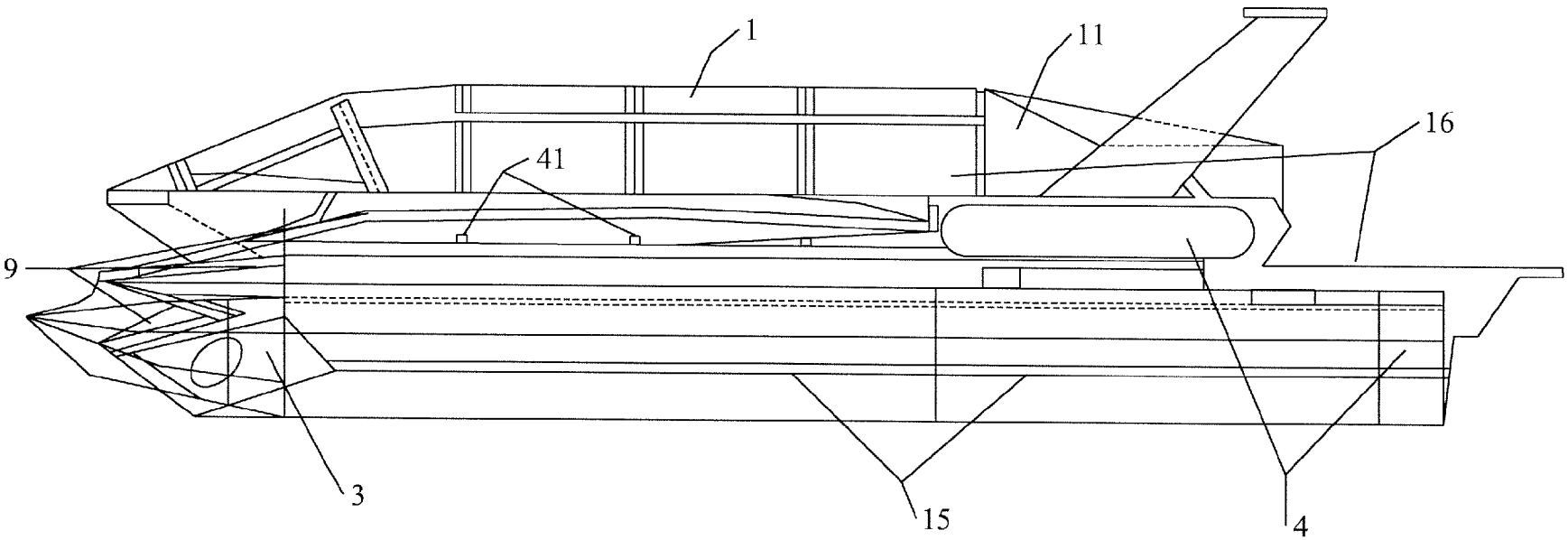
FIG. 2 is a side exterior view of an embodiment of the subject invention.
Figure 3:
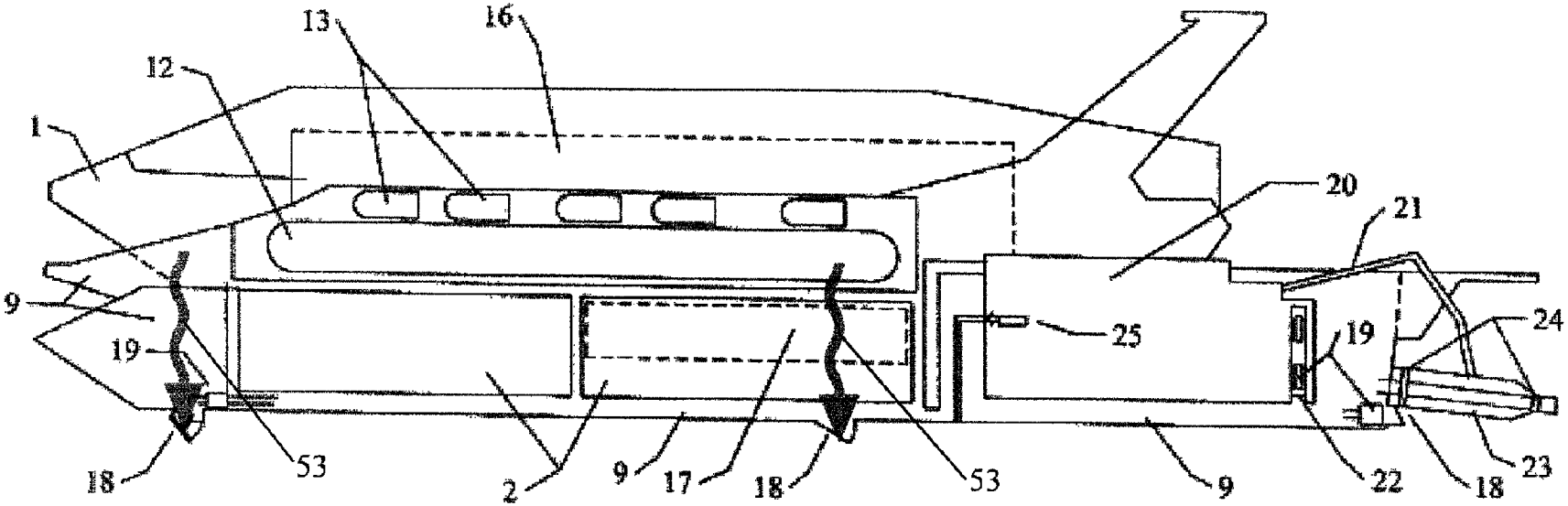
FIG. 3 is a side view cut away view of an embodiment of the subject invention.
Figure 4:
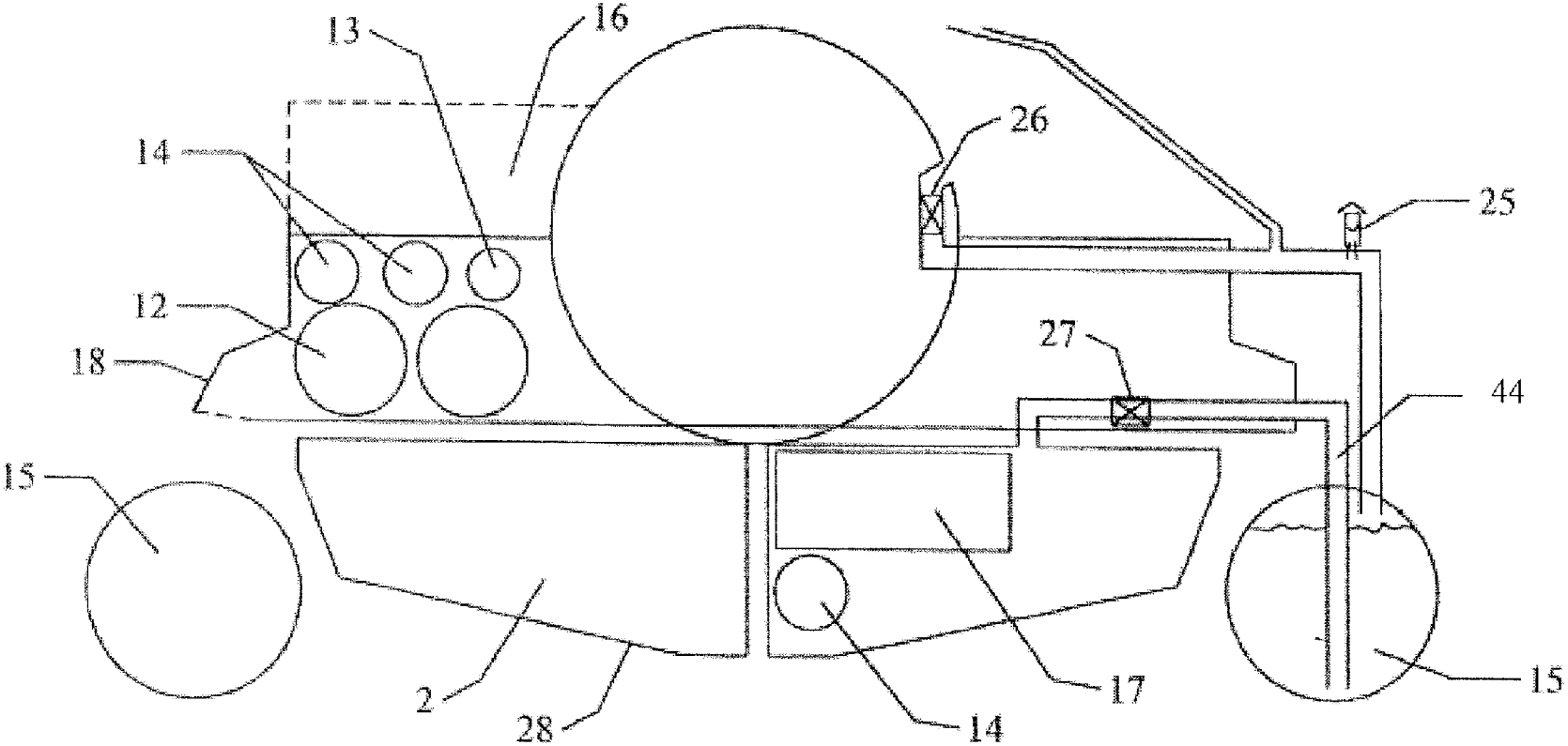
FIG. 4 is a front cut away view of an embodiment of the subject invention.
Figure 5:
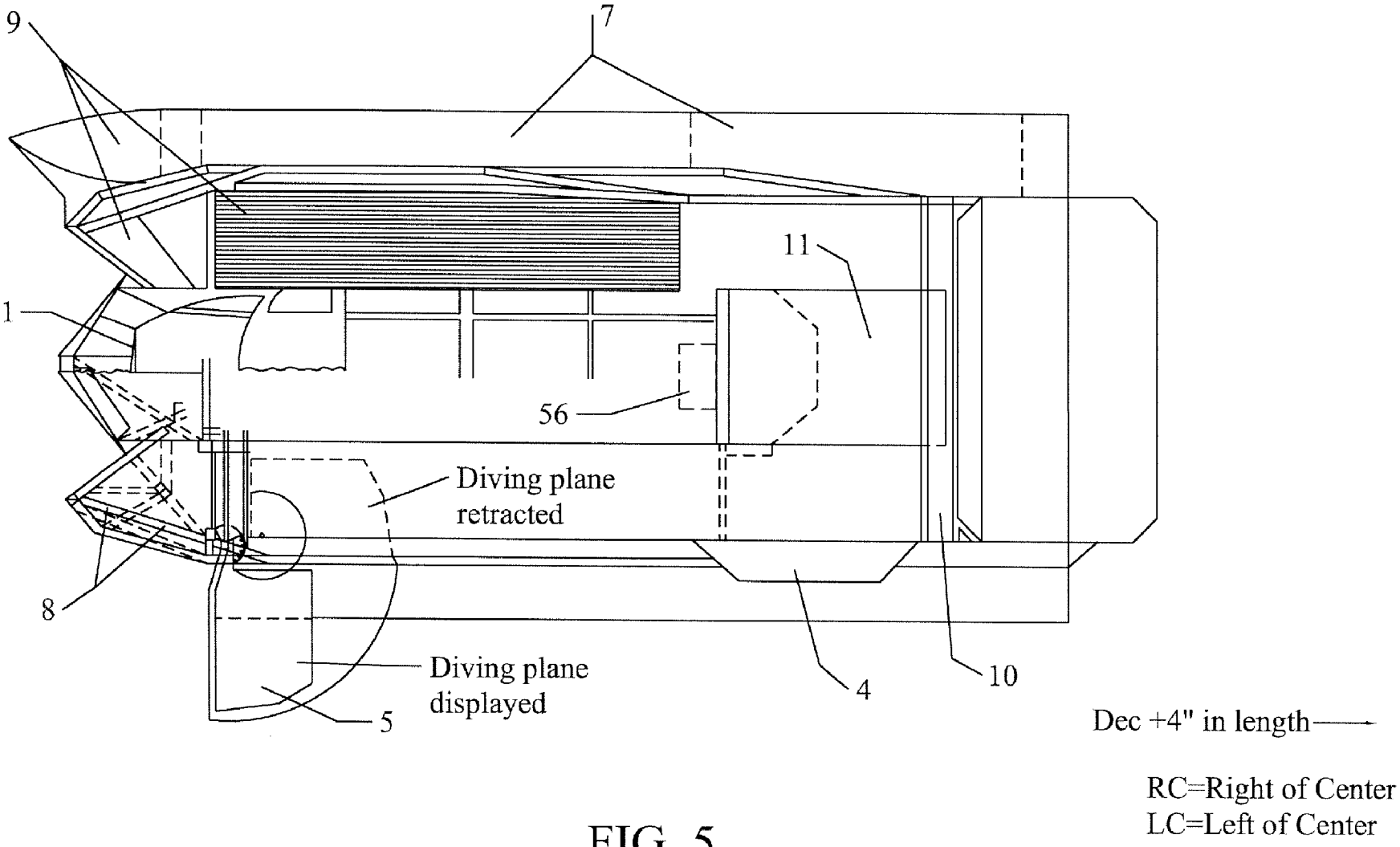
FIG. 5 is a top down view of an embodiment of the subject invention.
Figure 6:
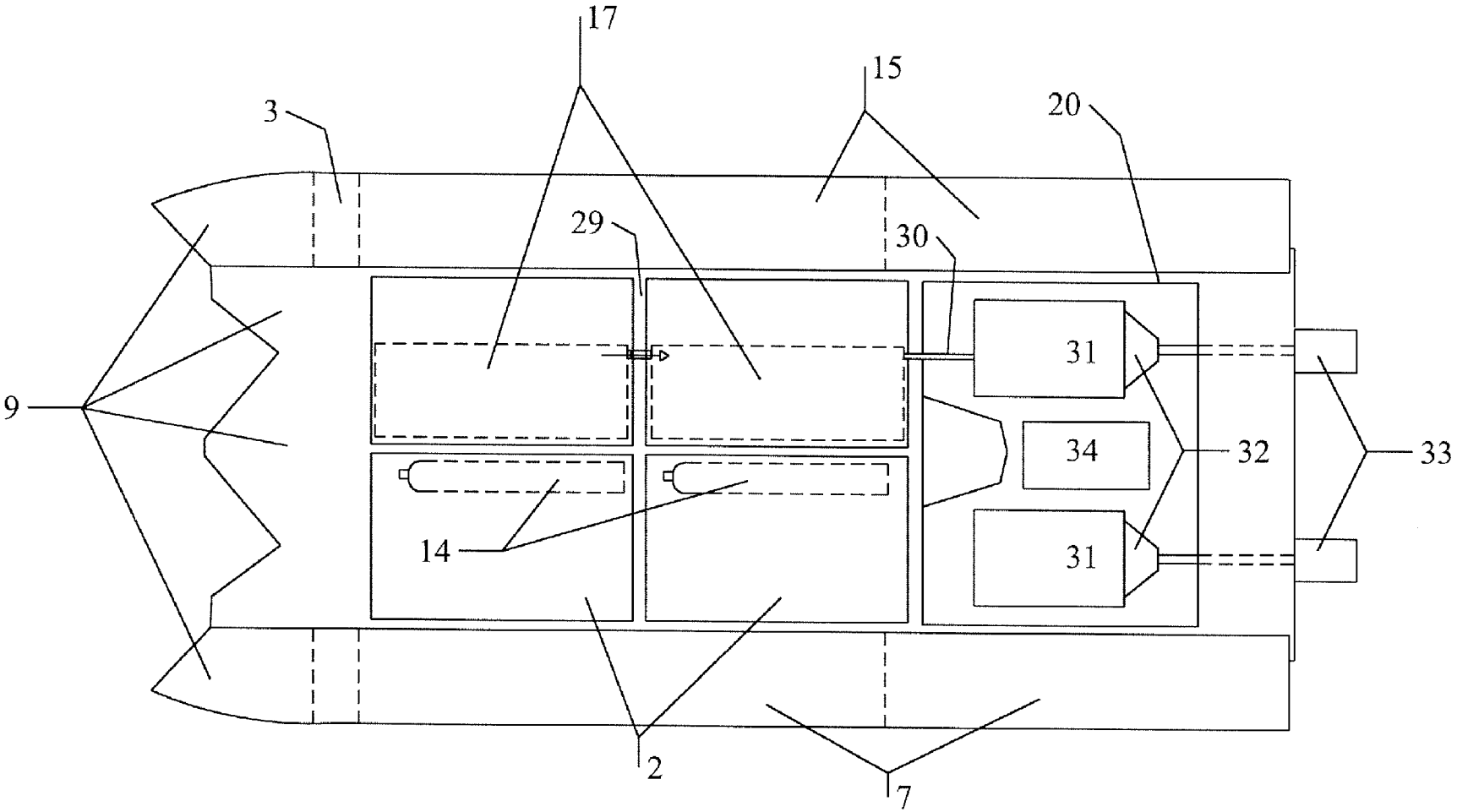
FIG. 6 is a bottom up view of an embodiment of the subject invention.

The vessel of the present invention combines high surface speed and long-range navigation and seakeeping abilities with the capability to protect passengers at submerged depth. It also provides a high degree of variability in payload and a purpose-configurable modular design, making it very adaptable for uses in industry, tourism, government, military, and recreation. The vessel has a relatively simple, yet extremely innovative design that is very safe without requiring extensive costly engineering. The vessel of the present invention is the first general purpose submarine.

In order to overcome all of the challenges and provide a true general purpose submarine, the present invention was designed by taking on a perspective that is radically different than typical submersible designs. Versatile submerged capabilities were combined with robust surface handling characteristics in most embodiments through the use of a true pressure hull, large buoyancy envelope, high power-to-weight ratio, high fuel reserves, and high volume above the waterline during surface cruising.

The size of the vessel of the present invention is relevant to its usefulness across industries. Although much smaller than the huge atomic-powered military subs, the vessel of the present invention is of a proven proportion to enable seakeeping and navigation on the surface. It is also large enough to carry significant supplies to allow mission durations of several days. The relatively small size allows easy transport, with over-the-road transport, air transport, boat ramp launch, common docking slip use, and transport on larger vessels all possible. Higher speed and greater stealth are enabled by the relatively small size as well. The costs for acquisition, crews, fuel, maintenance, operation, and repair are all much lower compared to very large submarines. Incorporating the submarine's extensive functionality into its relatively small size was one of the greatest challenges overcome by the present invention.

One of the key features of the vessel of the present invention is its unique approach to ballasting. A much higher proportion of controllable variable displacement is present than in a typical submersible. In addition to the quantity, another aspect of the ballast approach is the staging and segregation of the vessel's forms of fully-controllable ballast and its semi-controllable ballast. Thus, the vessel utilizes both a high proportion of variable ballast as well as a staged ballast design that in many embodiments is separated into main internal, main external, and semi-controlled divisions. Each division of ballast operates differently to attain performance never before seen in such a small vessel.

Most typical submersibles and submarines deal with ballasting in the same fashion. Each has just more than the minimum controllable ballast needed to obtain enough buoyancy to get a small portion of its volume above the surface and to trim the vessel during submerged operations. The fixed displacement present is huge relative to the amount of variable displacement present. This leads to the amount of buoyancy that can be controlled always being smaller than the buoyancy that is inherent in the vessel. This approach makes sense in large military vessels since they operate almost exclusively under water. In smaller submersibles, the designers provide just enough ballast to pierce the surface to replenish supplies and power and change out passengers or crew. Underwater performance is maximized, and little attention is paid to surface performance.

As a result of the conventional thinking regarding ballasting, existing submarines and submersibles have very deep drafts, with most of their volume being below the water line during surface operation. This helps to keep the vessel stable but has the disadvantages of providing very little ability to cruise on the surface, very little variability in payload, and a constant threat of swamping that must be accounted for with complex, costly engineering of safety precautions.

The submarine of the present invention counters conventional thinking by taking a different approach and using a majority of the submarine's volume for ballasting. This large amount of ballasting is necessary to allow the submarine to be capable of operating on the surface as a high-speed, long-range surface vessel. The huge quantity of controllable ballast also makes it possible for the submarine to have a high degree of variability in payload, to be configured for multiple purposes, and to have underwater lifting capabilities. Safety is inherently increased with this design by reducing the risk of swamping or sinking due to a pressure hull penetration leak.

The total volume of ballast that is fully controllable in the present invention is about twice the volume of fixed displacement of the passenger compartment and is typically about equal to the volume of surface displacement of the entire vessel, though the actual ballast volume may be more or less than these values. Therefore, the controllable ballast is typically designed such that, if fully purged, it is always capable of providing more buoyancy than the passenger compartment. This feature distinguishes the present invention from other pressure-hull based designs since it does not necessarily rely on the passenger compartment's buoyancy to return to the surface.

If a through-hull penetration fails in the present invention, resulting in a leak, the submarine can be prevented from sinking to the bottom. If the passenger compartment can be brought to ambient pressure using the given air stores, the leak will generally be limited to filling the lower third of the volume of the passenger compartment. If any degree of positive buoyancy can then be obtained by injecting air into the main ballast, the vessel will return to the surface, accelerating as it rises due to the expansion of the trapped air. Sufficient purging of the main ballast to compensate for loss of approximately a third of the passenger compartment displacement can be obtained per 200 feet of depth from one air storage tank, fully charged.

In an embodiment of the invention, the large controllable ballast allows for a maximum negative swing in buoyancy of up to about 24,000 lb. before the vessel will completely lose its ability to return to the surface. In contrast, a deep-dive submersible allows for a negative swing in buoyancy of only about 1000-2500 lb. before preventing its ability to surface. A return to the surface is essentially guaranteed with the submarine of the present invention when operating at reasonably shallow depths.

Additionally, safety is also enhanced by the fact that the unique ballast system allows the passenger compartment to be completely or predominately risen above the waterline when the submarine is surfaced. Thus, when surfaced, the through-hull penetrations are no longer submerged and no longer a threat to leak. The surface hull incorporated into the submarine provides an additional barrier between the passenger compartment and the water when surfaced. Due to using the proper amounts of lift and hydrostatic support, the passenger compartment is able to reside completely or predominantly above the waterline. This also does away with the need for complex and costly engineering for each through-hull penetration that would be needed on a typical submarine to achieve the same degree of safety. Strong safety precautions are present in a simple and cost-effective design in the present invention.

Moreover, the large proportion of controllable ballast greatly improves the surface performance and carrying capacity of the vessel. Significant payload and heavy components, such as surface motors, fuel, and batteries, can be added to the vessel, even though this would not be possible in typical submersibles.

A very shallow draft is also achieved due in large part to the large amount of controllable ballast. This leads to low drag and thus allows a planing hull to be incorporated, thereby enabling unprecedented surface speed for a submarine. Thus, the unique ballast system allows long-range navigation and seakeeping at high speeds to be present in a small submersible that has the payload capacity to be easily configured for many purposes.

The ballast system of the present invention makes use of a combination of sealed and partially open ballast compartments, as well as free-flood zones during a dive, to allow a high degree of variability in payload and great safety benefits. In many embodiments, the ballast system can be divided into three zones that each operate differently. The main internal, main external, and semi-controlled zones work together to submerge and surface the vessel.

The main internal ballast compartments remain completely flooded and open while the vessel is submerged under water. These compartments do not have a need for ambient-pressure air compensation to resist deformation at depth since they remain open to the sea, functioning similar to a wet hull.

The main external ballast compartments, on the other hand, only fill to the extent necessary to obtain neutral buoyancy. The large size of these compartments allows for a great degree of variability in payload, which can be increased even further by the standard addition of removable weights. The main external ballast compartments are sealed by heavy-duty valves from both the main internal ballast compartments and the exterior environment at the beginning of a dive. Their displacement is locked in and the amount of buoyancy they will provide is thus determined. The compartments are compensated with air at depth to avoid deformation. This allows for light-weight construction, which in turn keeps the vessel's weight low and increases surface performance.

Being completely full at depth, the main internal ballast compartments are neutrally buoyant. In an emergency, though, air can be injected directly into the main internal ballast and trapped in the compartments since they are sealed at the top. Under this scenario, each main internal ballast compartment functions like a positively buoyant diving bell. In addition, a pea trap connection between the main internal and main external ballast ensures that the internal compartments can be fully purged even if all valves were to fail open. This level of safety is unique to the present invention and allows the submarine to surface under virtually any circumstances.

Safety is increased on the surface as well, as a result of the main ballast system's sealed nature. A breach of the surface hull would only allow water to enter until the trapped air reaches ambient pressure. This functions as an effective double hull. Furthermore, if the vessel were to invert due to bad weather, it can submerge and right itself, adding even more safety.

The semi-controlled ballast comprises free-flooding zones that are purged by gravity as the vessel surfaces and sealed to the water during surface operation. The main internal and external ballast typically lifts the submarine until the free-flooding semi-controllable ballast zones are just above the waterline. Then, these zones gravity drain 53 through large one-way valves or through hull gates until purged. The net effect is that the semi-controlled ballast is neutrally buoyant while the vessel is submerged but provides additional displacement while the vessel is surfaced. Also, the semi-controlled ballast provides freeboard displacement in the portion that resides just above the waterline while surfaced. This freeboard displacement helps inhibit the vessel from rocking side to side while surfaced.

The functionality of the overall ballast system of the vessel allows enhanced surface performance, as well as diving and surfacing with no complex mechanical operations necessary. The result of the unique ballast system is a large increase in payload capacity with just minimal additional weight. This allows for high power and fuel reserves to be added, increasing the configurability of the vessel. The safety level achieved is unparalleled by any typical submersible as the vessel can surface in virtually any circumstances.

Another feature of an embodiment of the present invention is its ability to carry a system that allows it to recharge its own air stores after a dive and an additional system to recharge its powerful dive batteries. Due partly to the payload capacity and variability provided by the unique ballasting system, the vessel is able to carry these additional systems and thus be autonomous. The air store is typically SCBA breathing air to be used as life support and in ballasting operation. The substantial payload capacity provided by the unique ballast system also allows the vessel to carry more conventional oxygen and carbon dioxide scrubber stores in large quantities. This leads to improved life support capabilities and also provides redundancy to increase the robustness of the life support systems. The submarine does not require shore or surface vessel support to conduct multiple dives, making it more convenient than typical small submersibles. The ability to recharge itself allows the submarine to dive multiple times, and the amount of fuel present is the main limiting factor in its ability to recharge. This ability gives the vessel longer range and greater dive time than typical submersibles.

A unique feature of the vessel is its handling of stability issues. Due to the fact that a large percentage of the volume of the submarine resides above the waterline while surfaced, the vessel's center of gravity crosses its center of buoyancy when it submerges. At the point where they cross, most traditional surface vessels are not stable and are in danger of rolling over. However, in certain embodiments of the subject invention, through the use of a carefully balanced distribution of weight, stability tanks mounted on the upper sides, and freeboard displacement that remains above the waterline when the points cross, these embodiments are able to remain stable and inhibit rollover.

Another important characteristic of an embodiment of the present invention that distinguishes it from typical submersibles is its purpose-configurable component- and assembly-based modular construction. This modularity allows for a high degree of configurability. While most submersible vessels are preconfigured for a particular purpose and built as a single unit, embodiments of the present invention are designed for multi-purpose use and for mass production, with the ability to customize each individual submarine.

In an embodiment, the vessel comprises one or more primary assemblies which are large, pre-manufactured portions of the vessel. The primary assemblies, such as the passenger compartment, the upper body works, the surface hull, the surface engine compartment, the side tanks, the main internal ballast, and the central framework, can easily be swapped out, added, or removed for repair or to change the vessel's capabilities. Each primary assembly is pre-fabricated, typically with pre-attached components. The vessel typically comprises at least one passenger compartment, at least one surface hull, at least one main internal ballast, and at least one surface engine compartment.

Other primary assemblies and many common marine components or submarine components can also be incorporated into the vessel and easily connected to grids providing electrical power, air, water, and/or hydraulic power. Typical submersibles have the passenger compartment as the main body such that every change will greatly affect it. In the present invention, on the other hand, the passenger component is just one assembly, and it is not affected by most changes to the vessel.

The use of primary assemblies allows variant methods of assembling the vessel. In an embodiment, a central framework primary assembly is used, upon which other primary assemblies may be mounted. The central framework is typically a rigid box or I-beam frame, which may be steel, composite material, aluminum, or other rigid material, with pre-drilled mounting holes or brackets for the attachment of other primary assemblies and components.

In an embodiment, rigid reinforcing members are incorporated into the primary assemblies themselves. The reinforcing members may comprise steel, composite material, aluminum, or other rigid material, with pre-drilled mounting holes or brackets for the attachment of other primary assemblies and components located on the assemblies themselves.

In a further embodiment, neither a framework nor reinforcing members are used. Rigidity and strength are instead provided by the construction of the primary assemblies, using the method commonly known in the art as monocoque or uni-body construction, or structural skin. This method is commonly used in automotive or surface boat manufacture. Using a uni-body construction method, the primary assemblies are designed with sufficient structural strength via corrugation, internal welding, or other means that they will integrate into a single chassis, eliminating the need for a body-on-frame.

Further embodiments may use combinations of uni-body and body-on-frame construction. Any of these assembly methods, when used to join the primary assemblies, provide for the use of an assembly line, which has never before been used for submarine construction. The configurability of the vessel is also greatly enhanced by the use of primary assemblies and components which can be easily swapped out.

Yet another unique feature of an embodiment of the present invention is the inclusion of pressure-resistant pods aside from the passenger compartment. The vessel typically includes a true one-atmosphere pressure hull passenger compartment which also houses controls, instruments, and passenger comfort components. However, other components are isolated from the passenger compartment and enclosed in their own pressure-resistant submersion pods.

The passenger compartment has connections to the air grid which allow it to alternatively function as an ambient pressure compartment. The vessel can function as a diving bell, providing decompression to bent divers, and an egress collar may be included to assist diver operations in saturation dives. Additionally, the ambient pressure mode can be used in emergency situations to prevent flooding of the passenger compartment, providing enhanced safety. The ability to ambient pressure compensate the passenger compartment, combined with the fact that through-hull penetrations are only on the lower third of the passenger compartment, guarantees that any through-hull penetration failure will not completely fill the passenger compartment with water.

Submersion pods are pressure hulls or ambient-pressure compensated compartments that reside outside of the passenger compartment. The battery bank tubes are typically pressure hull submersion pods, and the surface engine compartment is typically an ambient-pressure compensated submersion pod. These submersion pods increase the configurability of the vessel since components are more easily switched out by not being contained in the passenger compartment. This also keeps the fixed displacement low, lowering the weight necessary to submerge the submarine and increasing the surface performance. Safety is also enhanced by isolating potentially dangerous components from the passenger compartment, such as high-voltage electric lines or fuel stores.

Embodiments of the present invention comprising an ambient-pressure air compensation grid help ambient-pressure submersion pods, chambers, and compartments avoid deformation and water intrusion at depth.

The ambient-pressure air compensation grid comprises an ambient core reader which reads the ambient pressure of the water at depth. The ambient core reader equalizes the pressure across the grid, and air is distributed to an ambient core manifold which connects via vent hoses or piping to the submersion pods, chambers, and components attached to the ambient-pressure air compensation grid. Due to this air compensation system, these components may be constructed of lightweight materials and various shapes, as long as they are reasonably airtight. In addition, the system helps reduce the fixed displacement and total weight of the vessel, therefore allowing for a higher power-to-weight ratio.

Another advantage provided by the ambient-pressure air compensation grid is that off-the-shelf components not designed for use on submarines at high-pressure depths under water can be used on the submarine at such depths. Air compensating these components negates the need for special development or testing and allows any sealed, water-resistant component to be modified and attached to the ambient-pressure air compensation grid to prevent deformation and/or water intrusion. The components, such as a marine radar dome, for example, can be typically attached to the ambient-pressure air compensation grid via a vent hose. This enhances the configurability of the vessel and simplifies its design.

An important feature of the present invention is its inclusion of a surface hull and its ability to achieve a high power-to-weight ratio.

Typical submarines and submersibles use displacement hulls, which have a very deep draft which reduces surface visibility and creates a large amount of drag during surface operation. Drag lowers speed and increases energy needed for surface operation.

Displacement hull vessels are limited in their forward speed by drag and the length of the vessel. A ship of a given length cannot go faster than its hull speed because of the wave action that it creates as it moves forward, and the wave action is determined by the length of the vessel. A displacement hull vessel attempting to exceed its hull speed will push up on a bow wave.

In order to achieve a speed higher than the hull speed, other forces must be used. Hydrodynamic lift resulting from a vessel's motion can be used to surpass the hull speed. Hydrodynamic lift comes from the tendency of a vessel to rise tip in the front when water collects against the front of the bow as it moves forward. With sufficient thrust from the engines and a proper hull design, a vessel can achieve a significant enough amount of hydrodynamic lift to ride up on top of its own bow wave and plane. Planing is similar to skipping across the surface like a stone, as opposed to pushing through the surface, as with a displacement hull. Planing allows for significant increases in a vessel's speed, because the vessel is no longer limited by its hull speed. Drag is also minimized since more of the vessel is lifted out of the water compared with a displacement hull.

The unique ballasting of the present invention allows for a shallow draft. When combined with the weight and space saving of the ambient-pressure compensated engine compartment and submersion pods, the submarine is able to attain a high enough power-to-weight ratio during surface operation to achieve planing. The vessel comprises a planing surface hull and is thus capable of high speeds during surface operation.

An embodiment of this vessel is the first submarine to have a pressure hull and a planing hull. The large amount of horsepower housed in the ambient-pressure compensated surface engine compartment and the large fuel reserves make this possible. Planing has historically been considered nearly impossible in submarines with pressure hulls. True submarines have previously never achieved any significant degree of planing. The planing ability of the submarine according to the present invention solves the challenge of reconciling configurability and small size with long-range surface navigation and seakeeping at high speeds.

Another aspect of an embodiment of the present invention is its variable displacement fuel system.

Storing fuel is problematic to submarines and submersibles due to several factors. While diesel fuel compresses only minimally and thus does not need protection from pressure at depth, the fuel leaves a gap in fuel tanks as it is used. The gap must be accounted for or the fuel tank wall will deform. Any submarine carrying fuel needs to compensate for the variance of fuel over the course of a mission. Therefore, fuel tanks must be ambient pressure compensated or, alternatively, built in a pressure hull.

If fuel is located in a pressure hull, the displacement will be fixed but the fuel weight will vary as it is used. Compensating weight, which decreases efficiency, must be added to allow the submarine to dive when fuel is low. Ambient-pressure compensated fuel tanks either present a fire risk if air is added or an engineering challenge if the tank is compensated with seawater. Some military submarines in use during World War II used a seawater compensation system, but it was very complex and is not practical for non-military vessels. In fact, many typical submersibles simply do not carry any fuel and instead use only batteries for energy storage. This results in extremely limited range and navigation capacity.

In certain embodiments, the submarine of the present invention uses variable displacement fuel cells to be able to carry fuel reserves of greater than 500 gallons in a small-sized vessel and with less weight than typical designs. A variable displacement fuel cell comprises a flexible material fuel bag residing in the main ballast tanks or a free-flood zone inside the vessel. Fuel is removed from the cell as it used by a fuel pump, thereby reducing the displacement of the cell. As the displacement of the cell is decreased, more water enters the vessel, leading to a net result of little additional weight being necessary to attain neutral buoyancy at the beginning of a dive.

Some compensating weight may still be used in the vessel to offset a dive with a full fuel load. Because diesel fuel weighs about 1-1.5 lb/gallon less than water, the vessel is actually more buoyant with more fuel. This means that the vessel gets heavier underwater as fuel is used and water replaces its volume. The submarine is designed with enough weight to be able to dive with a full fuel load of well over 500 gallons, though the actual full fuel load may be less in particular models. To demonstrate the advantage of the variable displacement fuel cells, the compensating weight for the vessel traveling in seawater with 525 gallons of diesel fuel is only about 804 lb, while at least 3,728 lb of compensating weight would be necessary if the fuel was located in a pressure hull. This massive reduction in the weight of the vessel helps allow for a shallow draft, which in turn contributes to the ability of the vessel to plane and achieve high speed.

Referring now to the drawings, as shown in FIGS. 1-8, the vessel of the present invention may comprise a central framework 8, to which may be attached a passenger compartment 1, a surface hull 42, an upper body works 37, a surface engine compartment 20, main internal ballast compartments 2, and side tanks 15. The side tanks may further divide into the main external ballast compartments and the trim ballast compartments 3.

Figure 7:
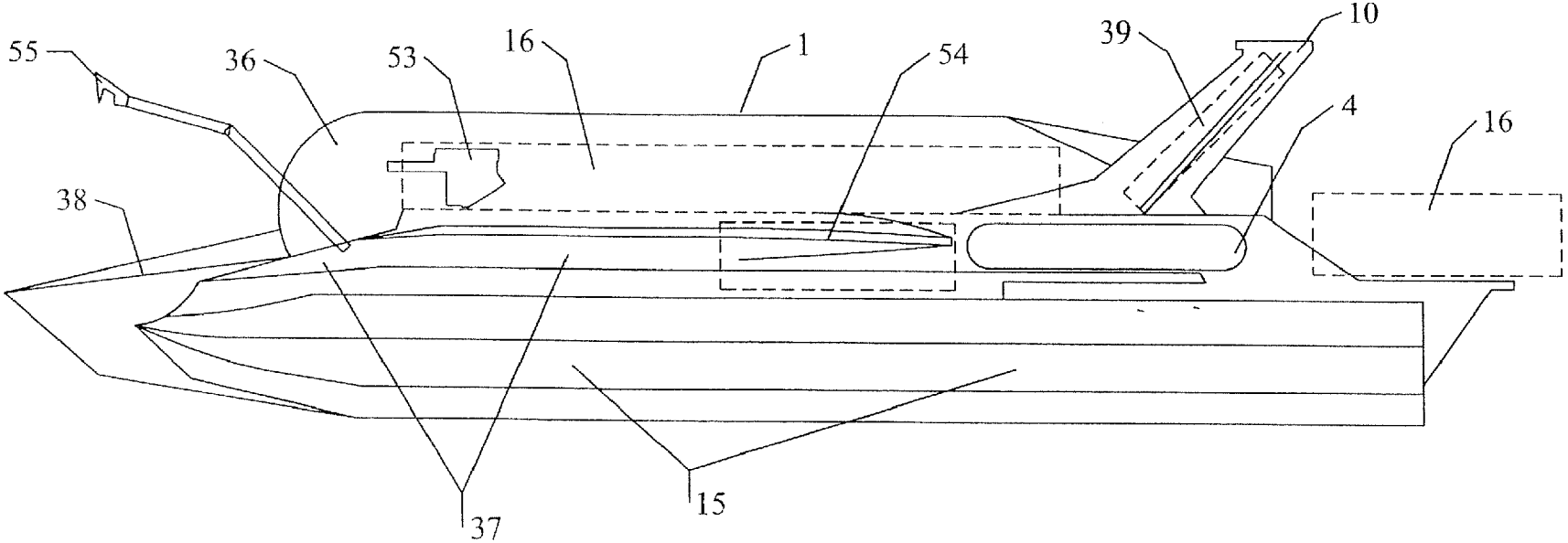
FIG. 7 is a side view of an embodiment of the subject invention.
Figure 8:
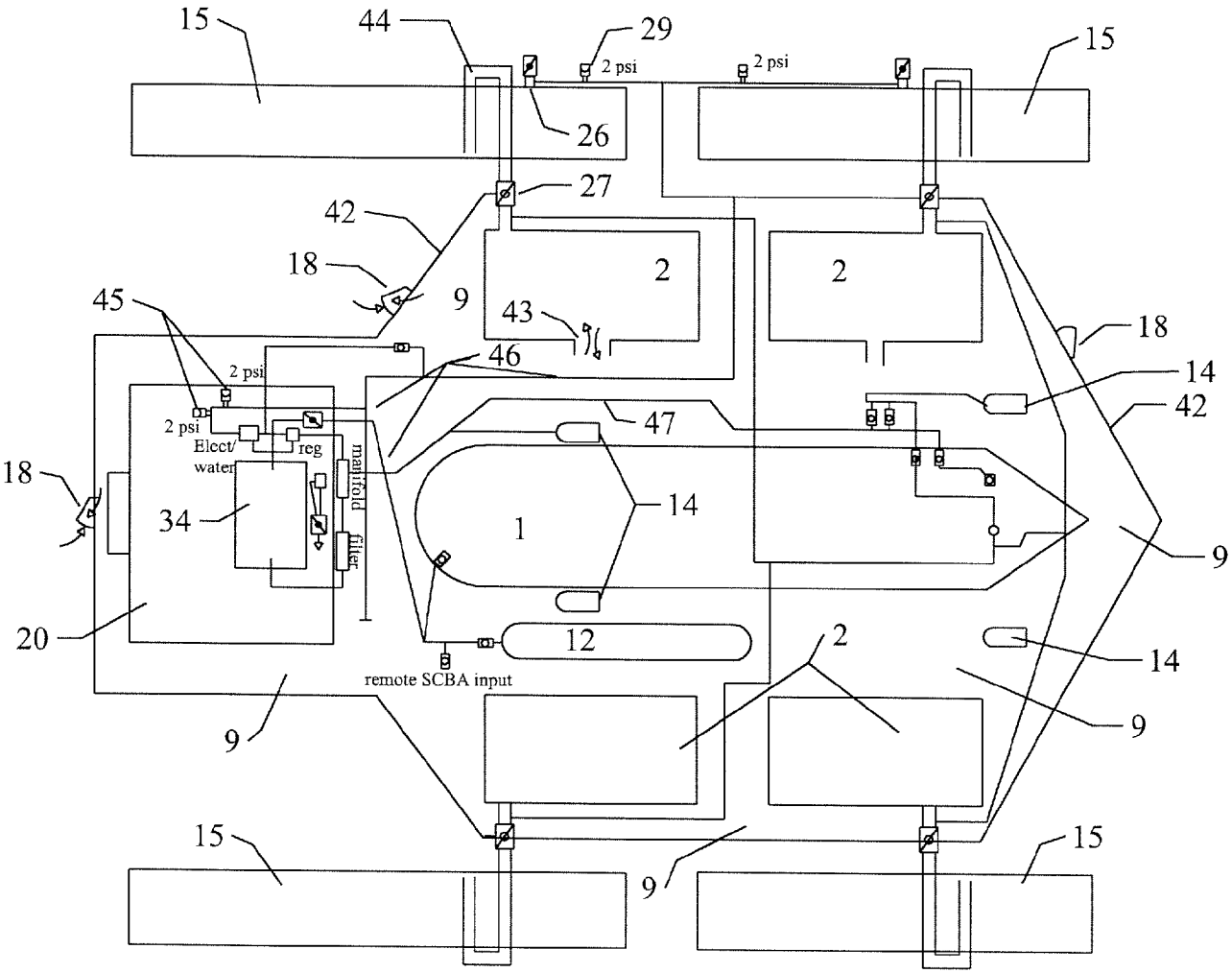
FIG. 8 is the air and main water grid of an embodiment of the subject invention.

The passenger compartment 1 houses the passengers and contains controls for the operation of the vessel. In many embodiments, the passenger compartment 1 is a pressure hull. In alternative embodiments, the passenger compartment 1 may be an ambient pressure hull. In a further alternative embodiment, the passenger compartment comprises a hemispherical head portion 36, as shown in FIG. 7. In certain embodiments, the passenger compartment 1 includes an air conditioner 56.

The surface hull 42 serves to separate the passenger compartment 1 from the water during surface operation and also helps the vessel attain high speeds during surface navigation. In many embodiments the surface hull 42 is a planing hull. In alternative embodiments, the surface hull 42 is a displacement hull. In a further alternative embodiment, the surface hull 42 is a wave piercing planing-style hull 38, as shown in FIG. 7. In certain embodiments, the surface hull 42 comprises a hull gate 18.

The upper body works 37 surrounds the lower portion of the passenger compartment 1 and extends laterally from either side and above the passenger compartment 1 in the rear. In many embodiments, the upper body works 37 includes semi-controllable ballast zones 9, which may have semi-controllable ballast one-way flappers 41, and stability tanks 4. In certain embodiments, the upper body works 37 also includes dive planes 5 (shown in deployed position in FIG. 5) that may be deployed during dive operations. In certain embodiments, the rear deck and side deck areas 16 may be used for submersion pods (49, 50) housing additional batteries (in submersion pod 49) or additional fuel load (in submersion pod 50). In certain embodiments, the upper body works 37 may include a spoiler 10. The spoiler 10 may comprise piping 39 that can be used in snorkeling applications. In alternative embodiments, larger stability tanks 48 may be used. In certain embodiments, the upper body works may include a weapon mount 53, well 54, or manipulator arm 55.

In many embodiments, the surface engine compartment 20 is ambient-pressure compensated with the help of ambient pressure input check valves 45 and an ambient core reader 22. The surface engine compartment 20 often houses surface engines 31, which use surface engine gears 32 to operate out drives contained in out drive housings 23. In many embodiments, the out drive housings 23 are ambient-pressure compensated. Out drive seals 24 may be used to help keep the surface engine compartment 20 sealed where the out drives are located. The surface engines 31 draw fuel from fuel cells 17, which are often variable displacement fuel cells, via a fuel line 30 and fuel check valve 29. The surface engine compartment 20 typically comprises an engine lid cover 11 to keep it sealed from the elements. In certain embodiments, the vessel may include an aft thruster contained in an aft thruster tube assembly 51 and a bow thruster contained in a bow thruster tube assembly 52.

In many embodiments, the unique ballast system of the present invention comprises main internal ballast compartments 2, main external ballast compartments 7, trim ballast compartments 3, and semi-controllable ballast zones 9. Each main internal ballast compartment 2 typically opens to the outside environment via the main internal ballast input 43 and to the main external ballast compartments 7 via pea trap connections 44 and main ballast valves 27. The main internal ballast compartments 2 often comprise ballast liners 28. In many embodiments, the main external ballast compartments 7 can open to the outside environment via the ballast exhaust port 21 and the use of the exhaust valve 26. In certain embodiments, water pumps 19 may be used to assist with water injection to or ejection from the ballast system.

In many embodiments, the vessel includes an electrical system and an air system. The electrical system stores power using battery banks 12, which may be stored in submersion pods. In many embodiments, the air system comprises oxygen tanks 13, SCBA storage tanks 14, an emergency air tank 33, a high-pressure compressor 34, and an air grid. The air grid may include a low-pressure air delivery line 40, a low-pressure air delivery and compensation line 46, a high-pressure air delivery line 47, and air grid check valves 25.

The primary assemblies and other components of the vessel will be described in further detail below.

The term "ambient core manifold" as used herein refers to a central hub, kept at ambient pressure, that distributes ambient-pressure compensating air to other components of the vessel.

The term "ambient core reader" as used herein refers to a device that reads and/or reacts to the ambient pressure.

The term "ambient pressure" as used herein refers to the pressure of the environment outside the vessel at a given time.

The term "buoyancy" as used herein, consistent with its usual meaning in the art, refers to the upward force exerted by the water on a vessel, and is equal to the weight of the volume of water displaced by the vessel.

The term "carbon dioxide scrubber" as used herein, consistent with its usual meaning in the art, refers to a device or substance used to remove the majority, if not all, of the carbon dioxide from a sample of air.

The term "center of buoyancy" of a vessel as used herein, consistent with its usual meaning in the art, refers to the geometric center of the buoyant force acting on the vessel.

The term "center of gravity" of a vessel as used herein, consistent with its usual meaning in the art, refers to the geometric center of the vessel's mass.

The term "component" as used herein refers to any device or substance which can reasonably be included on any submarine, submersible, or surface vessel.

The term "fully-controllable ballast compartment" as used herein refers to a ballast compartment that is designed to receive air purposefully injected under pressure and has a direct, controllable connection to an air grid or is connected to a ballast compartment that has a direct, controllable connection to an air grid; and includes the main internal ballast compartments and any main external ballast compartments, but excludes the trim ballast compartments.

The term "fuel cell" as used herein refers to any container reasonably capable of holding fuel.

The term "hydraulic accumulator," as used herein refers to any container that holds fluid and provides fluid to the hydraulic system, but does not receive additional fluid until the pressure of the hydraulic system drops below a certain threshold, at which point additional fluid is provided to the hydraulic accumulator.

The term "hydrostatic lift" as used herein, consistent with its usual meaning in the art, refers to the buoyant force of water pushing up on a vessel while it is sitting at rest.

The term "main ballast system" as used herein refers to the main internal ballast compartments and the main external ballast compartments, if any.

The term "neutral buoyancy" as used herein, consistent with its usual meaning in the art, refers to the condition where the force of gravity and the force of buoyancy acting on a vessel are equal, meaning that the vessel neither rises nor sinks in the water.

The term "passenger compartment" as used herein refers to a component of a vessel that is safe for human passengers to occupy during operation of the vessel.

The term "purpose-configurable" as used herein means able to be modified, arranged, or reconfigured for a particular mission or purpose, such as by removing and replacing removable components, for example, by unbolting components from a submarine and attaching other components to the submarine without requiring extensive redesign of the vessel, and also includes being capable of open design.

The term "seakeeping" as used herein, consistent with its usual meaning in the art, means a vessel's ability to endure rough conditions at sea such as high wind, large waves and heavy rain; and to navigate safely at sea for prolonged periods during stormy weather.

The term "semi-controllable ballast zone" as used herein refers to any zone or compartment of a vessel which is at least partially open to the environment, completely fills with water when the vessel is submerged, and water freely drains by action of gravity, without the assistance of mechanically injected air, when the vessel is on the surface of the water.

The term "submarine" as used herein refers to an autonomous vessel, capable of moving forward and changing directions under water, capable of navigation on the high seas, with seakeeping capabilities, and capable of safely operating under water with human passengers.

The term "submersible" as used herein refers to a vessel or vehicle, capable of safely taking human passengers below the surface of the water and safely returning the passengers to the surface. All submarines are submersibles, but not all submersibles are submarines.

The term "surface displacement" as used herein, consistent with its usual meaning in the art, refers to the volume of water that is displaced by a vessel during surface operation.

The term "surface navigation" as used herein, consistent with its usual meaning in the art, refers to moving and/or changing directions during surface operation.

The term "surface operation" as used herein, consistent with its usual meaning in the art, refers to when a vessel has approximately as much of its volume above the waterline as it is reasonably capable of having. For example, for a typical large submarine, surface operation refers to when enough of its volume is above the waterline so that the hatch on top can be opened and passengers and/or supplies can be brought on or off.

The term "surface vessel" as used herein, consistent with its usual meaning in the art, refers to any vessel that is typically intended for surface operation and is not typically intended for underwater operation, and includes, but is not limited to, vessels such as speed boats, oil tankers, yachts, cruise ships, and tugboats.

The term "upper body works" as used herein refers to deck areas and side areas of a vessel and encompasses any components that can be attached to deck areas. The term "upper body works" may also encompass any semi-controllable ballast zones that are located on or contained within the deck areas and side areas.

The term "variable displacement" of a vessel as used herein refers to the volume of a vessel that can be safely and reasonably flooded with water without any danger to the passengers of the vessel.

The term "variable displacement fuel cell" as used herein refers to a fuel cell which is capable of having a changing volume as fuel is used from the cell.

The term "vessel" as used herein refers to a craft designed for navigation on water or under water.

The term "vessel capable of underwater operation" as used herein refers to submarines and submersibles.

Vessel Overview

Typical small vessels capable of underwater operation are preconfigured and built as a single unit. The passenger compartment is usually the main body of the vessel such that any alteration to the vessel affects the passenger compartment. Thus, every change must be analyzed for possible effects on the crucial passenger-housing function.

The vessel of the subject invention is designed to be easily reconfigured, making mass production reasonable. Many prefabricated, common, off-the-shelf components are incorporated into the vessel, providing a modular, purpose-configurable, open design. This allows each vessel produced to be customized to be better suited for the desired purpose. The vessel can be used for nearly any seafaring purpose, such as recreational use, military use, or industrial use, such as by oil companies.

In many embodiments, the present invention comprises primary assemblies, component grids, and submersion pods.

In many embodiments, the vessel includes a central framework 8 primary assembly which comprises a skeleton of material with pre-formed hard attachment points. In certain embodiments, the skeleton may be made of metal, composite material, or a combination of both. In certain embodiments, the pre-formed hard attachment points are reinforced holes for bolts. The skeleton may be formed from I-beams or box tubing. Different vessels may use different skeleton shapes. In an embodiment, the skeleton is in the shape of a rectangular box with triangular bracing as needed to withstand the stresses of surface travel and wave action. In certain embodiments, the central framework 8 comprises additional structural supports extending down into the keel.

In many embodiments, the passenger compartment 1 is an attached assembly that attaches to the central framework 8, to the surface hull 42, or to the upper body works 37. This provides an advantage over typical small vessels capable of underwater operation, minimizing the effects on the passenger compartment 1 of changes to the vessel. In many cases it permits changes to the vessel without affecting the passenger compartment 1.

The primary assemblies of the vessel of the present invention are interchangeable and come in different designs, which may be chosen according to what is desired. In many embodiments, the primary assemblies are large vessel sections specifically fabricated for the construction of the vessel of the subject invention. The primary assemblies mount to each other, or, if present, to the central framework 8 on pre-set attachment points.

Among the primary assemblies that may be used on the vessel of the present invention are the passenger compartment 1, the upper body works 37, the surface hull 42, the surface engine compartment 20, the side tanks 15, and the main internal ballast 2. Each of these primary assemblies attach to each other or to an optional central framework 8 primary assembly. One of the advantages of the subject invention is that any of the primary assemblies may be replaced without substantially affecting or having to rebuild the other assemblies. In this respect the subject invention is a modular submarine. In certain embodiments, the vessel comprises a planing-type speedboat hull to allow for higher speeds. This surface hull 42 can be changed out with a slower but more efficient displacement-type hull that is used in other embodiments.

The vessel comprises a passenger compartment 1, which houses passengers and pilots. In many embodiments, the passenger compartment 1 attaches to a central framework 8 primary assembly via a series of lateral rings that each bolt to pre-set hard points on the central framework 8. In other embodiments, the passenger compartment 1 attaches directly to the surface hull primary assembly 42 or to the upper body works primary assembly 37, or to both. Since in most embodiments the passenger compartment 1 is the most buoyant portion of the vessel while the vessel is under water, a large portion of the vessel's weight typically hangs from the passenger compartment 1. In certain embodiments, the passenger compartment 1 includes an air conditioner 56.

The upper body works 37 surrounds at least the majority of the lower half of the passenger compartment 1 in many embodiments. The design of the upper body works 37 is variable and may include components such as recreational decks, payload space, weapons mounts 53, wells 54, and manipulator anus 55. In many embodiments, the upper body works 37 houses ballast system components including the stability tanks 4 and a semi-controllable ballast zone.

In many embodiments, the surface engine compartment 20 is aft of the passenger compartment 1. The surface engine compartment 20 protects the surface engines 31 and other components when the vessel is submerged under water at depth.

In many embodiments, the surface hull 42 attaches to the lower half of a central framework 8 and to a keel extension. The surface hull 42 allows the vessel to function as a regular surface transport vessel while on the surface of the water. The surface hull 42 often houses the main internal ballast assembly 2. In an embodiment, the fuel cells 17 and/or air tanks (13, 14, 33) are also housed in the surface hull 42.

The main internal ballast assembly 2 typically comprises a series of ballast water compartments. In many embodiments, these ballast water compartments are housed within the surface hull 42. The side tanks 15 typically extend to either side of the surface hull 42. In many embodiments, the side tanks 15 house the main external ballast compartments 7 and trim ballast compartments 3. The side tanks 15 can serve to add buoyancy to the vessel both on the surface of the water and when submerged under water.

In many embodiments, the primary assemblies house the mechanical equipment, air storage, electrical storage, fuel storage, and other components that help the vessel function. Many different components may be included in the vessel of the present invention. In many embodiments, the vessel comprises at least one ballast compartment, at least one surface engine, at least one fuel cell, at least one alternator, at least one battery, at least one subsurface motor and thruster, at least one air compressor, at least one air storage tank, and controls for a pilot to operate the vessel. In certain embodiments, the vessel additionally comprises a hydraulic system for power distribution as well as the electric system. The majority of the components of the vessel are off-the-shelf stock marine components or standard submarine parts. Some of the parts, such as the ballast compartments, are custom-made.

In many embodiments, the components of the vessel are arranged into systems, which are connected by grids. The grid systems may include the high-pressure air storage grid, the emergency air grid, the low-pressure primary air grid, the ambient-pressure air compensation grid, the oxygen grid, the main ballast water grid, the trim ballast water grid, the electrical grid, the hydraulic grid, and the fuel grid. Each grid system comprises connectors that allow components and component pods to be added to or removed from the vessel easily. The connectors connect to each component or component pod, and they make repairs and upgrades to the vessel much easier.

Any vessel that operates under water must account for the reality that components may be damaged by pressure or water intrusion at depth. In many embodiments of the present invention, the passenger compartment 1 and the surface engine compartment 20 offer inherent protection to the components enclosed inside. Other vessel components are either inherently capable of withstanding pressure and water at depth, such as the air tanks (13, 14, 33) and fuel cells 17, or they must be protected.

In many embodiments, direct air compensation is used to protect components of the vessel at depth. Internal air pressure is directly added to the components to create a pressure differential of nearly 0 psi between the interior and exterior of the components. In other embodiments, submersion pods are used to protect components of the vessel at depth. Submersion pods are individual enclosures that house the components and resist the outside pressure. An ambient pressure pod that is connected to the ambient-pressure air compensation grid is an example of a submersion pod that may be used. A pressure hull pod is another example of a submersion pod that may be used. A pressure hull pod is built air tight and to resist the pressures of great depth under water through its construction, without air compensation. Submersion pods may serve as interchangeable modules that hold banks of components or stores of consumables in various embodiments. Many embodiments comprise battery bank pods which house batteries connected in series and can be changed out for other battery bank pods by disconnecting them from the electrical grid connection.

In many embodiments, the vessel of the present invention is relatively small in size, often less than 50 feet in length. In certain embodiments, the length of the vessel is less than 35 feet. In a further embodiment, the length of the vessel is less than 20 feet. In yet a further embodiment, the length of the vessel is less than 10 feet.

In many embodiments, the width of the vessel is less than 20 feet. In a further embodiment, the width of the vessel is less than 10 feet.

In many embodiments, the height of the vessel is less than 10 feet. In a further embodiment, the height of the vessel is less than 6 feet.

In many embodiments, the vessel has a dry weight of between about 2,500 pounds and about 60,000 pounds. In a further embodiment, the vessel has a dry weight of between about 2,500 pounds and about 30,000 pounds. In yet a further embodiment, the vessel has a dry weight of between about 2,500 pounds and about 15,000 pounds.

Passenger Compartment

Passenger compartments in submarines range from those that just provide a place to sit while exposed to water to those that fully enclose passengers in a protective one-atmosphere dry environment. As a vessel dives under water, the ambient pressure of the water rises and begins to crush the vessel. To combat this, the passenger compartment can be maintained near the ambient pressure of the water, or the passenger compartment can be made strong enough to resist the pressure from the water at depth.

A vessel can maintain ambient pressure by allowing the compartments to fill with water. Wet hull submarines have passenger compartments full of water. These are often not very useful since it is dangerous for passengers to be exposed to the water at depth. Cold climates and high pressures prevent wet hull submarines from being able to go very deep under water. Additionally, oxygen needs to be delivered directly to the passengers instead of just to the passenger compartment.

A vessel can also maintain ambient pressure by using compressed gas within the vessel compartments. One way to make use of this type of passenger compartment is to have an opening at or near the bottom of the passenger compartment. As the vessel goes deeper under water, water comes in through the opening and the air compresses in the upper portion of the passenger compartment.

An ambient pressure dry hull is a type of passenger compartment that maintains ambient pressure at depth. The passenger compartment is sealed with a dry interior, and a gauge is used to determine the ambient pressure of the water. Air is added to the dry compartment until the pressure equals that of the exterior water. A check valve is used to release air as the vessel ascends toward the surface and the ambient pressure decreases. Any shape and reasonably gas-tight material can be used since the pressure on the interior and exterior of the passenger compartment remains nearly equal. Ambient pressure dry hulls are depth-limited by the amount of air they can carry and their battery power reserves. They also have the inherent limitation that they must rise slowly when returning to the surface from being submerged at depth to avoid causing an embolism or the bends in any of the passengers.

A pressure hull is built of strong materials and of a proper shape to withstand high forces without compressing. The interior of a pressure hull is maintained at one atmosphere, even at depth. Pressure hulls are usually cylindrical or spherical, and the time of construction and cost of vessels using pressure hulls are typically higher than those using other types of passenger compartments.

The subject invention has a passenger compartment 1 which houses the controls for the pilot and provides space for passengers to occupy during a dive. The passenger compartment 1 may optionally host other supplies, such as scrubber material and pure oxygen bottles.

In embodiments of the invention, the passenger compartment 1 rims longitudinally along the top of the vessel and is attached to a series of hard points on the central framework 8, on the surface hull 42, or on the upper body works 37 assembly, or on a combination of them. The passenger compartment 1 may be mounted at different points to allow it to be raised, lowered, moved forward, or moved rearward in different embodiments. This also allows for additional adjustments to payload carrying capacity beyond that gained by side tank or surface hull setup. These changes can be utilized to provide more or less stability to the vessel both surfaced and submerged in water. To accomplish this, the height of the passenger compartment 1 may be adjusted to move the vessel's center of gravity or the vessel's center of buoyancy as desired to stiffen or loosen the vessel.

In many embodiments of the vessel, the passenger compartment 1 mounts to another assembly via a series of bands on the outside of the passenger compartment 1. In an embodiment, the bands are metal. In an alternative embodiment, the bands are composite material such as carbon fiber. In a further alternative embodiment, some bands are metal and others are composite material.

In many embodiments, the passenger compartment 1 contains the largest portion of the vessel's fixed displacement. The passenger compartment 1 comprises from about 40% to about 60% of the total volume of submerged fixed displacement of the vessel. In an embodiment, about 50% of the total volume of submerged fixed displacement is provided by the passenger compartment 1.

In embodiments of the subject invention, the passenger compartment 1 is located forward of the surface engine compartment 20. This forward location helps to offset the surface engine compartment's buoyancy during a dive for the purpose of maintaining the trim stability of the vessel. The volume of water displaced by the surface engine compartment 20 during a dive is significant relative to the total volume of fixed displacement of the passenger compartment 1. In an embodiment, the total volume of water displaced by the surface engine compartment 20 during a dive is about 75% of the total volume of fixed displacement of the passenger compartment 1.

Any appropriate form of passenger compartment may be used with the vessel of the present invention. In an embodiment, a wet hull is used. In an alternative embodiment, an ambient pressure dry hull is used. In a further alternative embodiment, a pressure hull is used, such that the hull is constructed to maintain one atmosphere of pressure within the hull while the vessel is submerged deep under water. Unlike existing pressure hull submarines, the pressure hull of the present invention is not the main body of the vessel in many embodiments. Instead, the pressure hull is a component or module that is attached to the central framework 8, or to another assembly, allowing for a greater degree of flexibility in changing its location relative to other components of the vessel.

The pressure hull passenger compartment of the vessel may have any appropriate size and shape, of which many are known to persons of ordinary skill in the art. In an embodiment, the pressure hull is spherical. In an alternative embodiment, the pressure hull is shaped as a cylinder with curved ends.

In many embodiments, the pressure hull passenger compartment is shaped as a cylinder with hemispherical ends. In certain embodiments, the outside diameter may be in the range of about three feet to about 10 feet. In an embodiment, the outside diameter of the pressure hull is about four feet. In certain embodiments, the length of the pressure hull may be in the range of about six feet to about 24 feet. In certain embodiments, the length of the pressure hull passenger compartment is in the range of about 12 feet to about 18 feet. The pressure hull of the vessel is scalable, and as larger or smaller versions of the vessel are constructed, the pressure hull may be larger or smaller.

The pressure hull passenger compartment may be constructed of steel, aluminum, titanium, carbon fiber, acrylic, or other strong material known to be capable of resisting the compressive force of water at depth, or any combination of these materials. In certain embodiments, the pressure hull comprises viewing windows constructed of transparent material. In many embodiments, viewing windows are constructed of acrylic. In an embodiment, one hemispherical end of the pressure hull is acrylic. In a further embodiment, both hemispherical ends of the pressure hull are acrylic. In an alternative embodiment, part or all of the cylindrical section of the pressure hull is acrylic. In another embodiment, the entire pressure hull is constructed of acrylic.

In some embodiments of the invention, the pressure hull passenger compartment is divided into subsections mated together with collars. In an embodiment, a series of acrylic cylinders are joined together with circular-shaped I-beams made of metal or carbon fiber with O-ring gaskets at the joints providing a gas-tight seal. The bands used to connect the pressure hull passenger compartment to the central frame assembly are located on the collars.

In some embodiments of the invention, the pressure hull passenger compartment uses an internal skeletal structure. In an embodiment, the pressure hull comprises a series of upright reinforcement rings made of circular-shaped metal or carbon fiber I-beams and longitudinal support beams. The pressure hull is covered with metal and acrylic sections.

In many embodiments, the pressure hull passenger compartment is rated to a depth of at least 50 feet. In certain embodiments, the pressure hull passenger compartment is rated to a depth of at least 200 feet. In a further embodiment, the pressure hull passenger compartment is rated to a depth of at least 600 feet. In a further embodiment, the pressure hull passenger compartment is rated to a depth of at least 1200 feet. In yet a further embodiment, the pressure hull passenger compartment is rated to a depth of at least 1500 feet.

In many embodiments, the passenger compartment 1 comprises a hatch for passengers to enter and exit the compartment. The hatch may also have a locking mechanism. Any suitable hatch and hatch-locking mechanism may be used. In an embodiment, the hatch is hydraulically operated.

In embodiments of the invention, the passenger compartment 1 comprises a metal frame in the interior which is used to mount the internal components of the passenger compartment 1. The frame includes mounting points and conduits for pilot controls and instrumentation, pilot and passenger seats, and other interior components. In an embodiment, the pilot seating and control panel is located in the front of the passenger compartment 1.

In an embodiment, the passenger compartment 1 comprises luxury automobile-style interior. In certain embodiments, the inside of the passenger compartment 1 also comprises a marine sanitation device for toilet use. The passenger compartment 1 may also comprise oxygen tanks and carbon dioxide scrubber material.

The passenger compartment 1 connects to other systems of the vessel through hull penetrations. In certain embodiments, the hull penetrations are located in the lower third of the passenger compartment 1. Standard submarine through-hull connectors, commonly known in the art, are used for electrical, hydraulic, and air connectors. The passenger compartment 1 receives electrical power from the electrical system of the vessel via the electrical connectors. The passenger compartment 1 connects to the oxygen grid of the vessel. The passenger compartment 1 also connects to an air grid for introduction of pressurized air. This allows for pressurization of the compartment and can also serve as an alternative life support source. In an embodiment, the passenger compartment 1 connects to a low-pressure primary air grid.

In some embodiments of the invention, the passenger compartment 1 is climate controlled via an air conditioning system in the interior.

In certain embodiments, the passenger compartment 1 comprises a dormant relief valve that can open to the exterior environment. In an embodiment, the dormant relief valve is located in the bottom portion of the passenger compartment 1 near the pilot's seat and opens to the free-flood zone in the upper body works 37. The dormant relief valve will typically be open while the vessel is operating on the surface of the water and will typically be closed during a dive. The valve may be opened during a dive for certain emergencies or during certain normal circumstances if the passenger compartment 1 operates as an ambient pressure hull. In an embodiment, the valve exhaust is located below the bottom of the passenger compartment 1 within the surface hull 42 area. The dormant relief valve may be used to relieve any partial vacuum created within the seated passenger compartment, ensuring easy opening of a hatch. The dormant relief valve may also serve as a drain for condensation water that may build up in the passenger compartment 1 from an air conditioning system or other source. It additionally allows for a hatch to be closed without a complete seal being made while the vessel is operating on the surface of the water. Finally, the dormant relief valve may also allow for air from an air grid, such as the low-pressure primary air grid, if present, or the high-pressure air storage grid to be introduced into the passenger compartment 1 during a dive for certain ambient pressure operations.

The passenger compartmnent's ability to pressurize from the low-pressure primary air grid or high-pressure air storage grid in certain embodiments, combined with the dormant relief valve, allows several different life support modes and ambient pressure operations of the vessel. A semi-closed or open circuit breathing system may be used when the vessel is submerged, at ambient pressure or one atmosphere. In the event of a through-hull penetration or other hull failure that allows for water ingress, ambient pressurization can slow the leak and prevent water from rising above the height of the penetration inside the passenger compartment 1. Additionally, the vessel may be used to decompress divers suffering from the bends. This is accomplished by placing the diver in the pressure hull passenger compartment and taking the vessel to an appropriate depth in the water, where the passenger compartment is then pressurized to ambient pressure. The vessel then surfaces over the period of time appropriate for proper decompression.

In an embodiment, the passenger compartment 1 is designed for use similar to a diving bell. The passenger compartment comprises a hatch on the lower portion of the compartment.

In many embodiments of the invention, the ballast exhaust valves 26 are located within the pressure hull passenger compartment. This allows for the ballast exhaust valves 26 to be closed manually in the event that hydraulic failure occurs while purging the ballast.

In many embodiments, all electrical circuits of high amperage and other system components that could be harmful to the safety of the passengers are located outside the passenger compartment 1 or can be isolated to being outside the passenger compartment 1.

In an embodiment, the passenger compartment 1 includes bilge pumps that can be utilized to pump out any water in the compartment while on the surface. The water is pumped out by opening a valve that is normally closed to protect the bilge circuit and passenger compartment 1 from pressure or water ingress during a dive.

In an embodiment of the present invention, armor may be added to the outside of the passenger compartment to provide enhanced protection against bullets or other weapons. The pressure hull passenger compartment is already resistant to small arms fire in most embodiments due to its heavy construction and shape.

Many of the embodiments of the passenger compartment 1 described herein provide safety advantages over existing boats and submarines. The well-built pressure hull passenger compartment provides greater protection to passengers from wave action while the vessel is on the surface. The passenger compartment 1 can be fully sealed and can make use of the existing life support systems while surfaced, making it safer in bad weather. These life support systems also provide additional safety in the event that the vessel sinks. If water gets in to the passenger compartment 1 during a dive due to the partial failure of a through-hull penetration, a sufficient air bubble can exist in the passenger compartment 1 for survival of the passengers until resurfacing because the penetrations may be located in the lower third of the passenger compartment 1. Additionally, the passenger compartment 1 typically has no contact with the water while the vessel is on the surface which helps to prevent swamping due to wave action while the hatch is open.

Surface Hull

Typical small vessels capable of underwater operation have very meager or non-existent navigation abilities on the surface of the water. They usually rely on mother ships or barges to carry them to a dive site. Such vessels that make use of a pressure bull typically have a very deep draft when surfaced. Usually, only a hatch and top deck protrudes above the water. Surface navigation is essentially non-existent because of both the deep draft and the lack of sufficient power. The deep draft while surfaced reduces visibility above the water and creates a huge amount of drag, which causes the vessel to lose speed and requires large amounts of energy to move it forward. The vessel of the present invention is the first vessel of relatively small size to be fully capable of underwater operation and robust surface navigation.

The subject invention includes a surface hull 42 which is in contact with the water while the vessel is operating on the surface. The surface hull 42 provides a significant amount of displacement while oil the surface, resulting in a shallow draft for the vessel like a typical existing surface boat. In many embodiments, the surface hull 42 is mounted to the lower half of a central framework 8. In further embodiments, the surface hull connects directly to the passenger compartment 1 or to the upper body works 37 or both.

In embodiments of the invention, the surface hull 42 comprises the main internal ballast assembly 2 and may also house vessel components such as air tanks (13, 14, 33) or fuel cells 17. In certain embodiments, the surface hull 42 houses additional payload or cargo. The surface hull 42 surrounds the surface engine compartment assembly 20 in many embodiments.

In certain embodiments, the surface hull 42 possesses a series of hull gates 18 that can be opened, allowing for the displacement created by the hull to be lessened if the pilot so desires.

The use of a surface hull 42 helps create significant amounts of water displacement while the vessel is on the surface of the water. This provides lift and allows the vessel to have a very shallow draft like a typical surface boat. Additionally, the surface hull 42 is the first line of defense against the sinking of the vessel, having some characteristics similar to those of a double-hulled surface vessel.

In many embodiments, the surface hull 42 protects components within the vessel from most reasonable waterborne threats when the vessel is on the surface of the water. Additional payload or cargo may be housed in the surface hull 42 in certain embodiments.

Any existing surface boat hull design may be used as the surface hull 42 of the present invention. Different hull forms can allow changes in overall surface buoyancy, underwater lifting capability, surface speeds, sea-keeping performance, stability, and fuel efficiency. Any appropriate material or materials may be used to construct the surface hull, including aluminum, fiberglass, and composite material.

Typical vessels capable of underwater operation usually use a displacement hull. Additionally, many surface vessels use a form of displacement hull. A displacement hull displaces water as the vessel moves. Displacement hulls require a relatively low power-to-weight ratio and give high fuel economy.

In certain embodiments, a displacement hull is used as the surface hull 42. Any existing displacement hull may be used. In certain embodiments of the invention, a displacement hull with a sharp bow, a substantially curved underside and stern, and a fairly shallow draft is used. Examples of displacement hulls that may be used include the standard ship-style monohull, a catamaran form hull, and a trimaran form hull. In an embodiment, a Small Waterplane Area Twin-Hull (SWATH) displacement hull is used.

Embodiments using a displacement hull as the surface hull 42 may have smaller surface engines 31 and a smaller surface engine compartment 20 due to a lower horsepower requirement.

Displacement hull vessels are limited in their forward speed by drag and the length of the vessel. A ship of a given length cannot go faster than its hull speed because of the wave action that it creates as it moves forward, and the wave action is determined by the length of the vessel. A displacement hull vessel attempting to exceed its hull speed will push up on a bow wave.

In order to achieve a speed higher than the hull speed, other forces must be used. Hydrodynamic lift, resulting from a vessel's motion can be used to surpass the hull speed. Hydrodynamic lift comes from the tendency of a vessel to rise up in the front when water collects against the front of the bow as it moves forward. With sufficient thrust from the engines and a proper hull design, a vessel can achieve a significant enough amount of hydrodynamic lift to ride up on top of its own bow wave and plane. Planing is similar to skipping across the surface like a stone, as opposed to pushing through the surface, as with a displacement hull. Planing allows for significant increases in a vessel's speed, because the vessel is no longer limited by its hull speed. Drag is also minimized since more of the vessel is lifted out of the water compared with a displacement hull.

Planing hulls allow vessels to achieve much greater speeds while lowering the payload capacity and fuel efficiency.

In many embodiments, a planing hull is used as the surface hull 42. Any existing planing hull design may be used. In certain embodiments of the invention, a planing hull with a substantially flat underside, a curved bow, and a flat transom is used. This planing hull requires a high power-to-weight ratio to achieve planing through hydrodynamic lift. In many embodiments, the vessel is capable of achieving surface operation at high speeds, well over 20 miles per hour. In certain embodiments, the vessel is capable of achieving speeds during surface operation of at least 30 miles per hour. In other embodiments, the vessel is capable of achieving speeds during surface operation of at least 40 miles per hour. In further embodiment, the vessel is capable of achieving speeds during surface operation of at least 60 miles per hour.

Typical vessels capable of underwater operation are the wrong shape, too heavy, too large, sit far too low in the water when surfaced, and/or have too little power to achieve any significant amount of hydrodynamic lift while on the surface of the water. The present invention is the first vessel incorporating a pressure hull for underwater operation that is also capable of using a planing hull.

Ballast System

The vessel of the subject invention has a ballast system that allows it to operate both when submerged and when on the surface of the water. The ballast system comprises the main ballast system, the trim ballast system, and semi-controllable ballast zones that can be partially controlled when the vessel is on the surface of the water.

Main Ballast System

The main ballast system is typically a staged system of fully-controllable ballast compartments, or ballast tanks, that is used in normal conditions to allow the vessel to surface and rise above the waterline, to submerge, and to attain near-neutral buoyancy under the surface. The main ballast system comprises at least one, but preferably a plurality of hull gates 18 on the underside of the vessel. The hull gates 18 are ports that can open to allow water to enter or exit the system, and which can close water-tight to seal the system from water entry. Water flows through the hull gates 18 from the effect of gravity or air pressure. The vessel may optionally include a pump 19 or pump system to accelerate the flow of water through the hull gates 18. Such pumps and pump systems are well known to persons having ordinary skill in the art.

In many embodiments of the invention, each hull gate 18 connects through a pump to the main internal ballast 2. The main internal ballast 2 is often located entirely within the surface hull 42 of the vessel and comprises one or more ballast compartments. In an embodiment, the main internal ballast 2 comprises four ballast compartments: two forward, and two aft, which fill simultaneously under normal conditions. The ballast compartments are separated within the main internal ballast area by lateral walls and sealed with ballast liners 28. The ballast liners 28 provide a gas-tight seal and may be made of a durable plastic material. Each main internal ballast compartment is connected by a gas-tight connection to the emergency air grid, through which air may be introduced into the compartment. In an embodiment, each main internal ballast compartment is sealed only on the top and sides and is open on the bottom to a free-flooding semi-controllable ballast zone in the lower part of the interior of the surface hull 42, which fills via common hull gates 18. In an alternative embodiment, each main internal ballast compartment is completely sealed on the bottom and filled via its own hull gate 18 or plurality of hull gates 18. A pump 19 may optionally be used to accelerate the filling of the ballast compartments with water.

In an embodiment of the invention, the main internal ballast compartments provide space for the location of modular system components, which may be added or removed depending on the desired configuration of the vessel. The compartments may be penetrated by gas-tight connectors to allow connection of the components to the high-pressure air storage, low-pressure primary air, emergency air, ambient-pressure air compensation, electric, hydraulic, and/or fuel grids. In an embodiment, the air storage tanks (13, 14, 33) are located within the main internal ballast compartments. Additional modular components in further embodiments can include battery bank pods, fuel cells 17, or any other component that could be pressure compensated or enclosed in a submersion pod, or that is inherently water-tight and pressure resistant.

In many embodiments of the invention, each main internal ballast compartment connects to a corresponding main external ballast compartment 7 through a pea trap 44. Each pea trap 44 comprises a connective pipe that exits the main internal ballast compartment at the top, arcing upward through the main ballast valve 27, and downward into the bottom of the main external ballast compartment 7. The pea trap 44 forces the ballast to operate in series, as a main internal ballast compartment must completely fill before the water in it overflows into a main external ballast compartment 7.

In certain embodiments of the invention, the main external ballast comprises two external side tanks 15, located port and starboard, which are each further divided into a forward and aft compartment. The main external ballast compartments 7 are completely sealed on all sides. The main external ballast compartments 7 are preferably inherently water-tight and gas-tight, but they may be lined with plastic ballast liners 28 for a gas-tight seal. In certain embodiments, the side tanks 15 may be attached to the vessel with only bolts, thereby facilitating interchangeability. The size, material, compartment size, and exact location of the side tanks 15 may vary depending on the configuration of the vessel.

Each main external ballast compartment 7 connects to an exhaust valve 26 which exits the tank through an exhaust port 21 that allows the tanks to vent off air as the system fills with water. In certain embodiments, an exhaust fan may be included inside the exhaust port 21 to accelerate the purging of air from the system. Each main external ballast compartment 7 further connects via a gas-tight connection to the air grids through which pressure compensating air may be introduced into the compartment or exhausted, or through which pressurized air may be added to purge the tanks. A bilge pump or plurality of pumps may optionally be included at the bottom of the main external ballast compartments 7 to remove additional water as needed.

In an alternative embodiment of the invention, the side tanks 15 can be constructed as pressure vessels, resistant to pressure and not requiring pressure compensation.

In a further alternative embodiment of the invention, no connection exists between the main internal and main external ballast compartments 7. Instead, each ballast compartment separately fills via its own hull gate 18 and purges via its own exhaust valve 26.

In a further alternative embodiment, there are no external ballast compartments 7. Only internal ballast is used, which can be designed to flood in series or simultaneously.

In further alternative embodiments, water-tight and gas-tight structural boxes or airbags may be used in the internal or external ballast compartments.

When embodiments of the vessel of the present invention are operating on the surface of the water, the main ballast system is fully or substantially purged of water and is sealed against the intrusion of water. The hull gates 18 generally remain closed, and all ballast system valves remain closed. No air or water enters or exits the system. The main ballast system, however, may be used to make adjustments to the trim of the craft through the addition of small amounts of water via the hull gates 18, as needed.

In embodiments of the invention, prior to the submersion of the vessel from above the surface to below the surface, a pre-dive check should be performed. During the pre-dive check, the hull gates 18 are opened, but the exhaust valves 26 and the main ballast valves 27 remain closed. Water flows into the main ballast compartments through the force of gravity, but cannot fill the compartment because the air compresses inside until the force exerted by the air pressure causes the water to stop entering the compartment.

In an embodiment of the present invention, during the normal submersion process wherein the vessel transitions from surface operation into submarine operation, the main ballast system floods in series. Water is allowed to enter the ballast system as the hull gates 18 remain open, and both the main ballast valves 27 and exhaust valves 26 are opened, allowing air to purge from the system. In alternative embodiments, the vessel may comprise pumps and/or exhaust fans to accelerate the process by pump induction of water or exhaust fan purging of air. Water flows in through the hull gates 18 (and, if present, through a pump system), and into the internal ballast compartments. As the main internal ballast compartments fill, the air escapes through the pea traps 44, through the open main ballast valves 27, into the main external ballast compartments 7, and out through the open exhaust valves 26 and exhaust ports 21. Once the main internal ballast compartments are completely filled with water and purged of air, the water flows through the arc of each pea trap 44, through the main ballast valve 27, and into the bottom of the main external ballast compartments 7. The main external ballast compartments 7 continue to fill until the vessel submerges and reaches near-neutral buoyancy. At the point that near-neutral buoyancy is attained, the main ballast valves 27 and the exhaust valves 26 are closed, trapping a fixed volume of air in the main external ballast compartments 7. Alternatively, in embodiments wherein the internal and external ballast compartments are not connected, the ballast floods in stages by the timed opening of hull gates 18 and valves. The main internal ballast compartments' hull gates 188 and exhaust valves 26 are opened first and the compartments are completely filled. The external compartments are then opened and filled until near-neutral buoyancy is achieved, then closed.

In certain embodiments, while the vessel is submerged underwater, the hull gates 18 remain open to the water. Neither the pump system nor the exhaust fan are active, if part of the embodiment. The main internal ballast compartments remain completely filled. The main ballast valves 27 remain shut, and the water to air volume ratio in the main external ballast compartments 7 remains constant unless deliberately varied by the pilot operating the vessel. As the vessel dives and the outside ambient pressure rises, air is added via the air grid connection to the main external ballast compartments 7 as necessary to pressure compensate them. The ambient pressure compensation maintains the structural integrity of these compartments at depth. Although air is added as the depth increases, there is no change in the volume of the air present in the compartment due to compression. No pressure compensation is required in the main internal ballast 2, as it remains completely filled with water.

In embodiments of the invention, during the normal surfacing process, water is purged from the system and air is added to the system in the reverse of the submersion process. The hull gates 18 remain open to allow water to exit the system. The main ballast valve 27 in the pea trap 44 arc is opened. Air is injected into the main external ballast compartments 7 via the air grid system connector, pushing the water out via the pea trap 44 and into the main internal ballast 2. The water flooding into the main internal ballast 2 from the main external ballast compartments 7 in turn pushes the main internal ballast water out through the hull gates 18. After the main external ballast is completely purged of ballast water and filled with air, the air purges the pea trap 44 of water and the main internal ballast water begins to purge through the hull gates 18. In certain embodiments, pumps are used to help expel water from the system. Once the main internal ballast 2 is substantially purged of water and filled with air, the hull gates 18 close. Any remaining water is pumped out. Once the main ballast system is fully purged of water, the main ballast valve 27 and exhaust valve 26 are closed and the system is again capped to the environment.

Trim Ballast System

The main ballast system can be supplemented by a trim ballast system, which comprises a series of smaller ballast compartments used to adjust the attitude or trim of the vessel. In many embodiments of the present invention, two forward trim ballast compartments 3 are located forward of the main external ballast compartments 7, within each side tank 15. Two additional trim ballast system compartments are located aft on the upper body works 37 portion of the vessel, one port and one starboard. In an embodiment, at least two trim ballast compartments 3 are located within each side tank 15. In many embodiments, the trim ballast compartments include stability tanks 4. The size and material of the stability tanks 4 may vary depending on the configuration of the vessel. Larger stability tanks 4 can be used to add stability during the submersion process in the event that heavier loads are contemplated to be carried on the upper portion of the vessel. Larger stability tanks 48 may also be used with increased payload.

In many embodiments, the stability tanks 4 help stabilize the vessel as it transitions from the surface of the water to a submerged state. As the vessel sinks, and its center of gravity and center of buoyancy become equal, the stability tanks 4 remain just above the water line. In the event that the vessel begins to roll, the stability tank 4 on the low side of the craft will enter the water and provide additional displacement, thus stabilizing the vessel and inhibiting rollover.

In embodiments of the invention, the trim ballast system compartments 3 are constructed to be water-tight and gas-tight. In alternative embodiments, the trim ballast system compartments 3 may be lined with durable plastic ballast liners 28 to provide a gas-tight seal.

In an embodiment of the present invention, each trim ballast tank connects to a pump (or plurality of pumps) and valve system that draws water from a semi-controllable ballast zone 9. Water may be added to each compartment or removed as desired by the operation of the pump system. Each trim ballast compartment 3 is further connected via a gas-tight connection to the air grids, through which air may be introduced into the compartment or exhausted as needed to pressure compensate the tank or to force water out of the compartments.

In embodiments of the invention, during submersion of the vessel, the trim ballast system can be used to achieve absolute trim and neutral buoyancy after the main ballast system is used to reach near-neutral buoyancy. While the vessel is completely submerged, the trim ballast system compartments 3 are varied in their water-to-air volume ratio as needed through the addition or removal of water from the pumps, and the addition or removal of air from the air grid. This process is controlled by the pilot of the vessel to adjust the trim and neutral buoyancy of the vessel as desired. Each trim ballast system compartment 3 operates independently of the others to allow full adjustment of trim. As the vessel dives and the outside ambient pressure rises, air is added to the trim ballast components 3 as necessary to pressure compensate them via the air grid connection.

In an alternative embodiment of the vessel, the trim ballast tanks may be constructed as pressure vessels which would not need pressure compensation.

Semi-Controllable Ballast Zones

In certain embodiments of the invention, the vessel comprises at least one additional semi-controllable ballast zone 9 which remains substantially dry while the vessel is operating on the surface, but completely floods with water when the vessel is submerged under water. Because these zones remain open to the environment, they maintain ambient pressure at depth. In many embodiments, the semi-controllable ballast zones have at least 60% of their total volume free of water while the vessel is operating on the surface. Preferably, at least 65% of their total volume is free of water during surface operation. More preferably, at least 70% of their total volume is free of water during surface operation. Even more preferably, at least 75% of their total volume is free of water during surface operation.

In an embodiment, a semi-controllable ballast zone 9 surrounds the surface engine compartment 20. In an embodiment, this zone fills and drains via a connection to the hull gates 18 that underlie the main internal ballast compartments. In an alternative embodiment, this zone fills or purges via its own hull gate or plurality of gates 18. The semi-controllable ballast zones may optionally include a pump or plurality of pumps 19 to aid in filling and purging. In an embodiment, when the vessel is surfacing after being submerged, the semi-controllable ballast zone 9 surrounding the surface engine compartment 20 purges water via a one-way lower flapper valve. In embodiments including a pump 19, the pump 19 is used to help accelerate the induction or the purging of the water.

In an embodiment, a semi-controllable ballast zone 9, such as a semi-controllable ballast freeboard zone, is located in the upper body works 37 portion of the vessel. In many embodiments of the invention, the freeboard zone is substantially enclosed on all sides except the bottom (which is open to the semi-controllable ballast area surrounding the surface engine compartment), preventing any substantial amount of water from entering the zone during surface operation. A one-way drain exiting the lower side of the freeboard zone allows water to exit during the surfacing process or during a storm, but only allows small amounts of water to enter when the vessel operates on the surface. The one-way drain resides above the waterline during typical surface operation. When the vessel is submerged under water, the freeboard zone completely floods via a connection to the lower semi-controllable ballast zone 9 surrounding the surface engine compartment 20, and the air purges via one-way flapper valves 41 on the top. When the vessel is on the surface of the water, the freeboard zone provides freeboard displacement. When the vessel is surfacing after being submerged, as the vessel rises, the freeboard zone rises above the water line and water escapes through the drains and through the hull gates via the connection to the lower semi-controllable ballast zone.

In alternative embodiments, the freeboard zone may utilize decking with small gaps on the top to allow air to escape during a dive, instead of the one-way flapper valves.

Additional Ballast System Features

The amount of ballast used in the vessel will vary depending on the embodiment and will depend on several factors, including the total amount of weight that will be included in the vessel. In many embodiments the combined volume of all fully-controllable ballast compartments of the vessel is from approximately 125% to approximately 315% of the volume of the total fixed displacement of the passenger compartment of the vessel. In an embodiment of the invention, the combined volume of the all fully-controllable ballast compartments is approximately 200% of the volume of the total fixed displacement of the passenger compartment 1. Additionally, in many embodiments, the combined volume of all fully-controllable ballast compartments of the vessel should be from approximately 75% to approximately 125% of the total volume of surface displacement of the vessel. In all embodiment, the combined volume of all fully-controllable ballast compartments is approximately 100% of the total volume of surface displacement.

The ballast system of the vessel of the subject invention only needs air pressure and gravity to substantially fill or purge the system of water. If an embodiment includes pumps and/or exhaust fans, the ballast system will still operate if the pumps and/or exhaust fans fail.

When the vessel is on the surface of the water, the air pocket trapped in the main ballast system provides a degree of protection to the vessel. In the event that the hull gates 18 stick open or even if the surface hull 42 is ruptured, the vessel will not sink, so long as the air remains trapped inside the ballast compartments. Water can only enter through the hull gates 18 or a surface hull 42 rupture in an amount sufficient to compress the air inside the compartment. Once the air pressure in the compartment equals the force of the water pushing in, the vessel will stabilize and remain on the surface.

The ballast system also allows the vessel to right itself if it becomes inverted on the surface. The pilot of the vessel can initiate the submersion process even if the vessel is upside-down on the surface. The system will flood in reverse, with the exhaust ports allowing water into the main external ballast compartments 7, which in turn flood the main internal ballast compartments, with air escaping from the hull gates 18. Once the vessel submerges, the vessel's center of gravity will be above its center of buoyancy, causing it to invert itself and to return to its normal underwater orientation. The pilot can then initiate the surfacing process and return to the surface in the proper orientation.

Compartmentalization of the ballast system allows the vessel to return to the surface even in the event of a breach. Each compartment may be filled with air independently, and only a fraction of the total buoyancy reserve is necessary to surface. In many embodiments, even in the event that the passenger compartment 1 were breached and filled with water, the reserve buoyancy in the main ballast system is sufficient to bring the craft back to the surface if there is sufficient air to establish positive buoyancy at the depth.

Although the main internal ballast compartments are typically completely filled with water when the vessel is submerged, air can be injected into them from the emergency air grid to form a reserve source of buoyancy without the assistance of the electrical or hydraulic system or an air grid, such as the low-pressure primary air grid or the high-pressure air storage grid. In many embodiments, the pea traps 44 prevent air from escaping from the main internal ballast 2 even in the event of valve failure or a breach of the connecting main external ballast compartment 7. The pea trap 44 design is passive and does not rely on valves, and the emergency air grid is redundant to the low-pressure primary air grid, if present. In embodiments without a low-pressure air grid, the emergency air grid is redundant to the high-pressure air storage grid. Thus, a total failure of the electric, hydraulic, and low-pressure primary air (or high-pressure air storage) grids will have no effect on the pilot's ability to activate the reserve buoyancy to bring the vessel to the surface. In certain embodiments, a reserve buoyant lifting force in excess of 12,000 lbs, approximately half of the total variable buoyancy of these embodiments of the vessel, may be activated through the filling of the main internal ballast compartments with air. This buoyancy is more than sufficient to bring the vessel to the surface of the water.

In an embodiment of the invention, the vessel comprises an emergency drop weight. In the event of the loss of the ability to fill any of the main ballast compartments with air while the vessel is submerged, the emergency drop weight can be dropped to bring the vessel to the surface based on the fixed displacement. Thus, for embodiments including a drop weight, the emergency drop weight should weigh enough such that when it is dropped, the vessel weighs less than the weight of the total amount of water displaced by the volume of the fixed displacement. The emergency drop weight should also weigh enough such that when it is attached, the total weight of the vessel is greater than the weight of the total amount of water displaced by the volume of the fixed displacement.

The vessel of the subject invention provides significantly more variable displacement than typical surface vessels or typical vessels capable of underwater operation. This extraordinary amount of variable displacement is crucial in allowing the vessel to have the diving and underwater operating capabilities of a typical submarine and the robust seafaring capabilities of a typical surface craft. Additionally, this large proportion of variable displacement allows a high degree of configurability since adding or removing components will not have a significant effect on the vessel's ability to operate on the surface, dive under water, operate under water, or return to the surface.

When the vessel of the present invention is on the surface of the water, a large amount of its volume resides above the waterline in order to allow it to achieve robust seafaring abilities like a typical surface craft. This leads to potential problems in attempting to submerge which are solved by the unique ballast system. When at its maximum height above the water, the vessel's center of gravity, which is its geometric center of mass, is above its center of buoyancy, which is the geometric center of the buoyant force acting on the vessel. As the vessel submerges under water, its center of buoyancy rises and crosses its center of gravity. When the center of buoyancy and center of gravity are equal, any vessel would be at a point of instability and in danger of rolling over since the forces of gravity and buoyancy cancel each other out. In order to avoid rollover and have the ability to right itself if rollover occurs, the embodiments of the present invention have a carefully balanced distribution of weight, make use of stability tanks 4 mounted on the sides of the upper body works 37, and incorporate freeboard displacement that remains above the water line as the center of gravity crosses the center of buoyancy during the submersion process.

The stability tanks 4 help stabilize the vessel while submerged under water as part of the trim ballast system. As the vessel submerges and the center of gravity crosses the center of buoyancy, the stability tanks 4 remain just above the water line. If the vessel begins to roll, the stability tank 4 on the low side of the vessel enters the water to provide additional displacement and stabilize the vessel to inhibit it from rolling over. The portion of the freeboard semi-controllable ballast zone that remains above the water line as the center of gravity crosses the center of buoyancy provides freeboard displacement that serves the same purpose. In embodiments with higher loading capacities on the upper body works 37, the stability tanks 4 may be larger to offset the additional rollover threat that comes with a higher center of gravity.

Upper Body Works

The subject invention comprises an upper body works assembly 37, which is the primary assembly that typically surrounds at least the majority of the lower half of the passenger compartment 1, extending laterally from either side of the passenger compartment 1 and, in many embodiments, above the passenger compartment 1 in the rear. The upper body works 37 can be connected to a central framework 8 via bolts or glue or other means, and in many embodiments may be mated with the surface hull 42, forming the top half of the shell of the vessel.

In an embodiment of the present invention, the upper body works assembly 37 serves as the upper exterior of the vessel. In certain embodiments, the upper body works assembly 37 comprises the decking, the spoiler 10, the stability tank mounts, and the freeboard semi-controllable ballast zones. She upper body works assembly 37 may also house additional vessel components or pods, including battery bank pods, fuel cells, or air tanks.

In an embodiment, the upper body works assembly 37 comprises compartments for the storage of payload or consumable supplies such as oxygen bottles, scrubber materials, supplies, munitions, or diver support equipment such as diver propulsion vehicles.

Any appropriate decking may be used in the upper body works assembly 37. In an embodiment, the decking includes an open recreational deck and seating space for passengers. In an alternative embodiment, the decking comprises manipulator arms 55 and racks or wells 54 to allow payload to be loaded or offloaded while the vessel is submerged under water. In a further alternative embodiment, the decking includes mounted weapons 53.

In certain embodiments, the upper body works assembly 37 comprises armor plating. In an embodiment, the upper body works assembly 37 also comprises attachment points or wells 54 for weapon or sensor pods and storage for munitions.

In many embodiments of the invention, the upper body works assembly 37 comprises hard points, which are used for installation of components. The hard points can also have grid attachments for delivery of air, electrical power, or hydraulic power, as desired.

In many embodiments, the spoiler 10 extends above the surface engine compartment 20 in the rear of the vessel. The spoiler 10 may be used as a mount for optional equipment, including radar, GPS, communication, or other antennae. In an embodiment, the spoiler 10 can be configured for use as a dive plane while the vessel is under water. In a further embodiment, the spoiler 10 is used as a mounting point for air intake and exhaust ports.

In many embodiments of the subject invention, the upper body works assembly 37 comprises mounts for stability tanks 4 located aft on the vessel. In an embodiment, the upper body works assembly 37 includes mounts for at least two stability tanks 4. In a certain embodiment, the mounts for the stability tanks may be located on the spoiler 10.

In many embodiments, the upper body works assembly 37 comprises a freeboard displacement zone. The freeboard displacement zone includes a semi-controllable ballast zone 9 which allows limited water ingress while the vessel is on the surface but completely floods when the vessel is submerged under water. The freeboard displacement zone is substantially enclosed on all sides except the bottom, preventing any substantial amount of water from entering the zone when the vessel is on the surface. A one-way drain at the bottom of the freeboard zone allows water to exit during the surfacing process or during a storm, but only allows small amounts of water to enter when the vessel operates on the surface. The drain resides above the waterline during typical surface operation. When the vessel is submerged under water, the freeboard zone completely floods via a one-way connection to the semi-controllable ballast zone surrounding the surface engine compartment 20, and the air purges via one-way flapper valves 41 on the top. When the vessel is on the surface of the water, the freeboard displacement zone provides freeboard displacement. When the vessel is surfacing after being submerged, as the vessel rises, the freeboard displacement zone rises above the water line and water escapes through the drains. In alternative embodiments, the freeboard displacement zone may utilize decking with small gaps on the top to allow air to escape during a dive, instead of the one-way flapper valves 41.

The upper body works assembly 37 may be any shape and may be constructed of any appropriate materials. Examples of materials that may be used include fiberglass, carbon fiber, aluminum, other metal or composite material, and any combination of those materials. In an embodiment, the upper body works assembly 37 is constructed with the same material as the surface bull 42.

The size and shape of the upper body works assembly 37 may vary depending on the main function desired for the vessel. In an embodiment, the upper body works assembly 37 is sized and shaped to give a greater degree of freeboard displacement during the center of buoyancy and center of gravity crossover that occurs during a dive. In another embodiment, the upper body works assembly 37 is given a more hydrodynamic shape to allow for greater vessel speeds. In an alternative embodiment, the upper body works assembly 37 is sized and shaped for its aesthetic appeal. The decking is shaped to allow for better viewing from the passenger compartment 1.

Fuel and Surface Engine System

The fuel and surface engine system of embodiments of the present invention allows unprecedented range, speed, and mission duration for a small vessel capable of underwater operation. The vessel typically carries enough fuel for long mission duration, allowing for deployment from land as well as from a larger vessel. The vessel also has the ability to travel on the surface of the water at high speeds while generating power, recharging batteries, and regenerating air stores. Typical small vessels capable of underwater operation rely on a mother ship to reach a dive site and on external sources for power, battery recharging, and air store recharging.

The vessel of the subject invention is also much safer than typical smaller vessels capable of underwater operation. The surface propulsion system acts as a backup to the battery-powered underwater propulsion system, and the vessel can rise to the surface and return to land from an underwater mission even if the underwater propulsion system fails.

The fuel and surface engine system of the subject invention comprises at least one fuel cell 17, at least one fuel grid, at least one surface engine 31, at least surface engine gear 32, at least one out drive, and at least one surface engine compartment 20.

Variable Displacement Fuel Cells

In order for a vessel to submerge itself under water, it must attain a buoyancy level that is almost completely neutral. Since petroleum-based fuels are buoyant under water, using them makes it difficult to attain near-neutral buoyancy. Additionally, vessels that move on the surface require power to carry large amounts of fuel. A typical vessel capable of underwater operation that carries fuel must compensate for the changing fuel level over the course of a mission. When the fuel is in a pressure hull, the displacement due to the fuel tank is fixed while the weight of the fuel will vary. The vessel must carry sufficient weight to overcome the buoyancy of the tank when empty. This extra weight requires more energy to move the vessel.

The vessel of the present invention is unique among small vessels capable of under water operation since it is able to carry a large amount of fuel. The variable displacement fuel cells help make this possible.

Embodiments of the subject invention store their fuel in at least one fuel cell 17. In many embodiments the at least one fuel cell 17 is a variable displacement fuel cell. A variable displacement fuel cell comprises a fuel bag made of a flexible material that resides within the main internal ballast 2 or within a free-flood zone inside the vessel. In many embodiments, the flexible material is a flexible polymer material. A fuel pump vacuums the fuel out of the cell as needed, reducing the displacement of the cell. More water enters the vessel as the displacement of the cell is reduced. This negates the need for additional weight to attain near-neutral buoyancy. This lower weight requirement allows embodiments of the vessel to retain a shallow draft and to plane to achieve high speed on the surface of the water, if desired.

The vessel of the present invention is capable of submerging no matter how much fuel remains on board. The variable displacement fuel cells lead to the vessel becoming heavier under water as fuel is used up. Thus, the vessel's most buoyant state is with a full fuel load.

Additional fuel cells 50 may be added by adjusting the overall weight of the vessel. In an embodiment, approximately 400 pounds of weight must be added per 200 gallons of additional fuel to be added to the vessel.

In an embodiment, the vessel comprises four variable displacement fuel cells, two starboard and two port, with one forward and one aft on each side. In this embodiment, each variable displacement fuel cell holds approximately 125 gallons of diesel fuel. In alternative embodiments, more or less variable displacement fuel cells may be used, and variable displacement fuel cells of different sizes may be used.

In embodiments that comprise a forward and an aft fuel cell 17 on a side of the vessel, the forward variable displacement fuel cell can be attached to the aft variable displacement fuel cell by a common fuel line. The fuel line may be a hose or a pipe, and it preferably incorporates a one-way check valve allowing fuel to flow from the forward cell to the aft cell only. This is done since the vessel typically sits on the surface with the front higher than the back, allowing fuel to drain from front to back. Also, the vessel typically has the front lower than the back when underwater. Due to the buoyancy of the fuel, this will also allow fuel to drain from the front to the back. Trapping the fuel in the rear fuel cells 17 reduces the amount of shift in the center of gravity while the vessel is on the surface and the center of buoyancy when the vessel is underwater.

In many embodiments, the variable displacement fuel cells are anchored down so they will stay in place despite their buoyancy underwater.

The variable displacement fuel cells may be filled with a porous, spongy baffle material that causes the cells to regain their original shape once the vacuum is relieved. In an embodiment, the baffle material comprises approximately 10% of the internal volume of the variable displacement fuel cell. The baffle material helps in the refueling process since the cells automatically expand when the system is opened for refueling.

Since the fuel is not very compressible, the pressure differential between the interior and exterior of the variable displacement fuel cells is very close to 0. This allows the variable displacement fuel cells to maintain ambient pressure when the vessel is submerged.

Fuel Grid

The fuel grid connects the variable displacement fuel cells to the surface engine(s) 31. The fuel grid comprises at least one connective fuel line, at least one fuel pump, at least one refilling port, and at least one valve to control fuel flow. Since the variable displacement fuel cells maintain ambient pressure, the fuel lines of the fuel grid rise to ambient pressure. In certain embodiments, the at least one surface engine 31 at the other end of the fuel grid is enclosed in an ambient pressure pod, and no pressure differential exists in the fuel system. In alternative embodiments, the surface engine(s) 31 are located in a pressure hull, maintaining a pressure of one atmosphere. In these embodiments, a valve should be added to the fuel lines of the fuel grid to prevent the pressure differential from pushing fuel into the surface engine compartment 20.

Surface Engine

The vessel of the present invention uses at least one surface engine 31. Many different types of engines can be used. In many embodiments, a combustion motor is used. In an embodiment, a diesel inboard engine is used. In another embodiment, a turbine is used.

In an embodiment, two 440 horsepower diesel marine inboard engines are used. In an alternative embodiment, two cylindrical-shaped turbine engines are used. In an embodiment, the turbine engines are each 1,200 horsepower engines. In an alternative embodiment, the turbine engines are each 1,400 horsepower engines.

In certain embodiments of the invention, the power-to-weight ratio of the vessel during surface operation is at least 1 horsepower per 50 lbs of total weight of the vessel. In other embodiments, the power-to-weight ratio during surface operation is at least 1 horsepower per 35 lbs. In other embodiments, the power-to-weight ratio during surface operation is at least 1 horsepower per 20 lbs. In further embodiments, the power-to-weight ratio during surface operation is at least 1 horsepower per 10 lbs.

In an embodiment, the engine cooling system is open to the water, requiring ambient pressure compensation. In an alternative embodiment, the surface engine compartment 20 is a pressure hull, and a valve is used to close the cooling system off from the water.

Out Drive

The surface engines 31 connect to out drives on the outside of the surface engine compartment 20. Any standard marine out drive commonly known in the art may be used. In certain embodiments, jet drives are used.

Surface Engine Compartment

The surface engine compartment 20 protects the surface engines 31 and other enclosed equipment from pressure and water intrusion when the vessel is at depth under water. In many embodiments, the surface engines 31 are mounted in the surface engine compartment 20 and then bolted onto the vessel later, allowing for easy switching out. In certain embodiments, compressors and alternators are mounted in the surface engine compartment 20. Components mounted in the surface engine compartment 20 can be removed for repair. In many embodiments, electronics and other components that would normally need to be kept out of water are mounted in the surface engine compartment 20, allowing for lower construction cost and improving fire safety by keeping such components out of the passenger compartment 1.

The surface engine compartment 20 can be constructed from many different materials and in many different shapes. In an embodiment, the surface engine compartment 20 is made of a material with a high National Institute of Justice (NIJ) threat level resistance.

In many embodiments, the surface engine compartment 20 is the second largest fixed displacement compartment, after only the passenger compartment 1. The surface engine compartment 20 can also be the heaviest assembly after its components are installed. Reconfiguring the surface engine compartment 20 typically requires weight budgeting changes. Adjustments to the side tanks 15 can compensate for weight changes.

The surface engine compartment 20 increases the safety of the vessel by separating the engines and fuel system from other parts of the vessel, including the passenger compartment 1. This greatly lowers the risk of injury due to fire.

In many embodiments the surface engine compartment 20 is an ambient-pressure compensated submersion pod. An ambient-pressure compensated submersion pod keeps the overall weight of the vessel down and allows for the surface engine compartment 20 to be built with flat surfaces. Utilizing flat surfaces allows the surface engine compartment 20 to be located within the exterior confines of the vessel, reducing the amount of required fixed displacement of the vessel.

In many embodiments, the ambient-pressure compensated surface engine compartment 20 includes an ambient core reader 22. The ambient core reader 22 can comprise a piece of pipe mounted vertically inside the ambient-pressure compensated surface engine compartment 20. In an embodiment, the pipe is approximately 18' long. The pipe is open at the top to the inside of the surface engine compartment 20 and open at the bottom to the free-flood semi-controllable ballast zone surrounding the compartment. Inside the pipe, at least one float trigger is mounted. In an embodiment, three float triggers are mounted and are each separated from the next by a range of about three inches to about four inches. As the ambient water pressure increases when the vessel goes under water, water rises up the pipe. When water passes the first two float triggers, two electric switches are closed. When the second switch closes, an electric valve opens to deliver air from an air grid, such as the low-pressure primary air grid or high-pressure air storage grid. The air from the air grid is released directly into the surface engine compartment 20. In certain embodiments, a single float trigger and a single electric switch are used.

In many embodiments, as the pressure within the ambient-pressure compensated surface engine compartment 20 becomes slightly higher than the exterior ambient pressure, air forces water out of the ambient core reader until the floats drop and both switches reopen, halting the air flow. In alternative embodiments, any float, valve, trigger, pressure sensor, or meter commonly known in the art can be used to regulate the air.

In many embodiments, in-line down-regulators are placed at various locations on the vessel to compensate for overpressurization resulting from pressurization differences due to distance from the ambient core reader 22. Each 12" above the trigger of the ambient core reader 22 adds an additional positive pressure difference of approximately 0.445 psi compared to the trigger of the ambient core reader 22. In certain embodiments of the present invention, each component that has an in-line down-regulator also has an independent purge valve to allow it to vent.

In many embodiments, the ambient core reader pipe has a third float at the top of the pipe. If water reaches this float, a warning alarm is triggered on the control panel in the passenger compartment 1 indicating that the ambient-pressure air compensation grid is not delivering enough air to prevent intrusion of water. Causes include the vessel descending at a rate that is too rapid for the ambient-pressure air compensation grid to compensate, or a system malfunction. In case of such an alarm, a pilot of the vessel should cease to descend in the water.

When the vessel is on the surface of the water, a vent on the ambient-pressure compensated surface engine compartment 20 remains open. In many embodiments, the vent is on the top of the surface engine compartment 20. In an embodiment, a snorkel system is added to the surface engine compartment 20 to provide air to the surface engines when the vessel is under water but very near the surface.

When the vessel is on the surface and about to dive under water, the vent on the surface engine compartment 20 is closed. Pressurized air is released into the ambient-pressure compensated surface engine compartment 20 from the air grid. In an embodiment, hydraulic rams and a latching system at the top of the surface engine compartment lid 11 prevent any positive pressure from opening the lid 11. The surface engines 31 allow air into their structure, resulting in no net pressure differential between their interior and exterior.

As the vessel is under water rising toward the surface, the expanding air in the surface engine compartment 20 will vent to the outside environment with no need to open any valves. In many embodiments, the vessel has sufficiently-sized air egress piping to accommodate a very rapid ascent in the case of an emergency. In many embodiments, the air egress piping is fashioned into a pea trap to prevent water intrusion at depth.

In many embodiments, the surface engine compartment vent lid is located above the location of the ambient core reader trigger. This ensures that air is vented out of the surface engine compartment 20 if a leak develops in the lid 11, instead of water coming in. Additionally, due to the near 0 psi pressure difference between the interior and exterior of the surface engine compartment 20, any leak would be a slow dribble. If the float trigger system were to fail, the vessel is still properly air-compensated to depth of failure. The vessel would only require a small ascent to return to safety.

In certain embodiments of the present invention the surface engine compartment 20 is a pressure hull engine compartment. A pressure hull engine compartment requires no air compensation and is useful for vessels that will go to extremely deep levels under water, such as over 1,500 feet. A valve must be included to completely isolate the exhaust system when the vessel is submerged under water. In using a pressure hull engine compartment, the weight of the vessel increases due to the need for heavy material construction and a spherical or cylindrical design. Pressure-resistant through-hull connectors are used for all electric, hydraulic, and air connections. Additionally, the output shafts from the surface engines 31 must have a special pressure-resistant watertight seal where they exit the pressure hull engine compartment and connect to the out drives.

In many embodiments, the out drives are connected to the ambient-pressure air compensation grid. This provides pressure compensation when the vessel is at depth under water. The standard seal 24 on a typical out drive common in the art is watertight.

In an embodiment, 2-to-1 out drive transmissions are used on each surface engine 31, giving a total of 3,400 ft-lbs of torque delivered to the propellers.

In many embodiments, a tunnel from the ambient pressure surface engine compartment 20 houses the out drive shafts. The tunnel joins to the out drive housing 23 forming a watertight connection. This serves to help prevent water from entering the surface engine compartment 20. In certain embodiments, the output shaft seal is protected by venting the internal housing by connecting it through an attached gas tight line to the ambient-pressure compensated surface engine compartment 20, ensuring a pressure differential of nearly 0 psi between the internal pressure and the external water pressure.

Air Grids

The subject invention includes at least one air grid which may be used to provide air to certain parts of the vessel. The subject invention uses the air grid or plurality of air grids to store renewable air and oxygen. Additionally, the subject invention can store much more air than typical small vessels capable of underwater operation. The ability to store large amounts of air allows embodiments of the present invention to purge their main ballast compartments, pressure-compensate their large surface engine compartment 20 and secondary ballast compartments, provide life support or bring the passenger compartment 1 to ambient pressure if desired, allow surface ascent in the event of power or hydraulic failure, and provide backup life support.

While typical non-military vessels capable of underwater operation are very limited in their life support systems by the fact that they only carry a limited amount of carbon dioxide scrubbers and pure oxygen, certain embodiments of the present invention store renewable air supplies that may be used as an alternate life support source, in addition to carrying carbon dioxide scrubbers and pure oxygen. This decreases the amount of pure oxygen that must be used while the vessel is underwater.

In many embodiments, the subject invention has four or five air grid systems. These grid systems are the high-pressure air storage grid, the emergency air grid, the ambient-pressure air compensation grid, the oxygen grid and, in certain embodiments, a low-pressure primary air grid. The grid systems may be interconnected and may share common resources.

High-Pressure Air Storage Grid

The high-pressure air storage grid comprises at least one high-pressure Self-Contained Breathing Air (SCBA) compressor 34 and at least one high-pressure SCBA storage tank 14. They are often connected using hosing, valves, and regulators that are known in the art. In an embodiment, the high-pressure air storage grid compresses air from the surface and stores it. In an embodiment, the high-pressure air storage grid stores air at about 5,000 psi. In certain embodiments, the at least one high-pressure SCBA compressor 34 is located in the surface engine compartment 20 and driven by the surface engines 31. In an embodiment, the total combined rate all the compressors operate at is at least about 20 cubic feet per minute. In another embodiment, the total combined rate all the compressors operate at is at least at least 40 cubic feet per minute. In many embodiments, the compressors remove excess moisture and contaminants from the air through a series of water separators and filters to ensure the air will have low levels of moisture and other contaminants.

In many embodiments, the storage tanks 14 of the high-pressure air storage grid store approximately 450 to approximately 500 cubic feet of air each at a high pressure, such as 5,000 psi. In an embodiment, the total storage capacity of all storage tanks is about 4,000 cubic feet. In another embodiment, the total storage capacity of all storage tanks is about 5,000 cubic feet. The total storage capacity is limited only by the space available for additional storage tanks.

In certain embodiments, the high-pressure air storage grid can be used through a take-off valve to recharge external SCUBA tanks, if such tanks are being used for divers.

Emergency Air Grid

The emergency air grid is a backup system for the primary air grids. It can provide air to the vessel in the event of a system failure, and it requires no electrical or hydraulic power to operate.

In many embodiments, the emergency air grid comprises at least one emergency reserve air tank 33 which is isolated from the storage tanks of the other air grid systems. The reserve tank receives air during the recharge process via a one-way valve. The emergency air grid can deliver air directly from the reserve tank to the main internal ballast compartments using a series of hoses and connectors known in the art.

In many embodiments, at least one needle valve is located in the passenger compartment 1 of the vessel which can be opened manually to activate the emergency ballast purge lines. If desired, the pilot of the vessel can open the at least one needle valve to inject air directly into the main internal ballast system. When the vessel is on the surface of the water, the emergency reserve air tank 33 may be used to manually purge the main external ballast after a dive.

In many embodiments, the air of the emergency air grid is stored at high pressure. In an embodiment the air of the emergency air grid is stored in the emergency reserve air tank 33 at 5,000 psi.

In certain embodiments, the emergency air grid may be injected into hydraulic rains through a special valve. If the hydraulic system of the vessel fails, the emergency air grid can allow the hydraulic rams to function as pneumatic rams.

In an embodiment, the emergency reserve air tank 33 can be connected to the primary grid via a valve to provide additional air if the primary grid needs more air.

Low-Pressure Primary Air Grid

The low-pressure primary air grid receives air from the high-pressure air storage grid storage tanks. The high-pressure storage tanks connect through down-regulators.

In an embodiment of the subject invention, the air of the low-pressure primary air grid is 240 psi. The down-regulators can be set and valves, hoses, and connectors can be chosen to give a higher pressure, if desired, up to the pressure of the high-pressure air system.

In embodiments of the subject invention, the low-pressure primary air grid purges the ballast compartments, vents battery tubes of hydrogen during charging, supplies the passenger compartment vitalization system, supplies the passenger compartment conversion and breathing system, supplies the diver umbilical support, and/or provides air to the ambient pressure air compensation grid. In certain embodiments, the low-pressure primary air grid performs all of these tasks.

In certain embodiments, air from the low-pressure primary air grid is used to purge water from the ballast compartments of the vessel at the end of a dive. This may be done when the vessel is rising and is at a point just below the surface of the water. Electric or hydraulic valves are used to release air from the primary grid into the secondary ballast.

In many embodiments, the low-pressure primary air grid comprises electric valves in the battery tubes. While the batteries charge, the valve opens automatically, and air flows into the battery tube at a low rate. When the air pressure in the battery tube reaches a certain pressure, a check valve at the other end of the battery tube opens, thereby venting any hydrogen that may have been produced from the battery charge process to the outside environment. In an embodiment, the certain pressure needed to open the check valve is 0.5 psi.

In many embodiments, the low-pressure primary air grid comprises a gas-tight line that runs to the passenger compartment 1. The gas-tight line goes through a valve that can be manually opened or closed. When the valve is open, air is allowed to enter the passenger compartment 1 and can be vented through the passenger compartment's dormant relief valve. This feature allows the hatch of the passenger compartment 1 to be completely closed while still refreshing the air of the passenger compartment 1. This is especially useful when the vessel is on the surface of the water, but the waves or weather make having the hatch open a problem.

In certain embodiments, the low-pressure primary air grid can be used to pressurize the passenger compartment 1, if desired. An injection valve can be opened to allow air from the primary grid to enter the passenger compartment 1. In an embodiment, the valve is opened and closed manually. In an alternative embodiment, the pressure in the passenger compartment 1 is regulated by a meter system. Once the pressure within the passenger compartment 1 is slightly higher than the ambient pressure outside the passenger compartment 1, an open or semi-closed breathing circuit can be used. In an open breathing circuit, the don-ant relief valve of the passenger compartment 1 is open while the SCBA air from the low-pressure primary air grid is continuously delivered. This allows for less of the pure oxygen store to be used, resulting in the ability to stay under water for longer periods of time. In a semi-closed breathing circuit, a carbon dioxide scrubber is used, allowing the same air to be recycled and resulting in a decreased time to restore the SCBA air when the vessel is on the surface of the water.

In an embodiment, a compressor is used to eject air from the passenger compartment 1. The passenger compartment 1 is maintained at an internal pressure of one atmosphere, and renewable SCBA air stores are used for life support. In an embodiment, the SCBA air stores are used in an open breathing circuit. In an alternative embodiment, the SCBA air stores are used in a semi-closed breathing circuit.

In certain embodiments, the low-pressure primary air grid is used to provide air to one or more divers using a take-off connection. A SCBA regulator may be used, and each diver connects into the low-pressure primary air grid using an umbilical support. This allows divers to stay out on a dive for longer periods of time by overcoming the restriction of typical small diver air stores.

Ambient-Pressure Air Compensation Grid

The ambient-pressure air compensation grid provides air to ambient-pressure submersion pods, chambers and compartments to allow them to maintain ambient pressure and avoid deformation and water intrusion when the vessel is deep under water. This system provides the vessel with the option of being constructed with materials that are of lighter weight than would typically be needed to resist pressure. This system provides the additional advantage of allowing submersion pods, chambers, and other components to be constructed in various geometric shapes, not just limited to the spheres and cylinders that are typical of pressure-resistant vessels.

Another advantage provided by the ambient-pressure air compensation grid is that off-the-shelf components not intended for use at high-pressure depths under water can be used on the vessel at such depths. Air compensating these components negates the need for special development or testing and allows any sealed, water-resistant component to be modified and attached to the ambient-pressure air compensation grid to prevent deformation and/or water intrusion. In many embodiments, components are attached to the ambient-pressure air compensation grid via a vent hose.

In many embodiments, the ambient-pressure air compensation grid draws air from the high-pressure air storage grid. The air is down-regulated by an ambient core reader 22 that gauges the exterior ambient pressure and equalizes the pressure across the ambient-pressure air compensation grid to match the exterior ambient pressure. In a further embodiment, the ambient-pressure air compensation grid draws air from the low-pressure primary air grid.

In an embodiment, the ambient core reader 22 comprises a piece of pipe mounted vertically inside the ambient-pressure compensated surface engine compartment 20. In an embodiment, the pipe is approximately 18" long. The pipe is open at the top to the inside of the surface engine compartment 20 and open at the bottom to the free-flood semi-controllable ballast zone surrounding the compartment. Inside the pipe, at least one float trigger is mounted. In an embodiment, three float triggers are mounted and are each separated from the next by a range of about three inches to about four inches. As the ambient water pressure increases when the vessel goes under water, water rises up the pipe. When water passes the first two float triggers, two electric switches are closed. When the second switch closes, an electric valve opens to deliver air from an air grid, such as the low-pressure primary air grid or the high-pressure air storage grid. The air from the air grid is released directly into the surface engine compartment 20. In certain embodiments, a single float trigger and a single electric switch are used.

In certain embodiments, the air from the ambient-pressure air compensation grid is distributed via an ambient core manifold which connects via vent hoses or piping to the pods, chambers, and other components attached to the ambient-pressure air compensation grid. Vent hoses lead from the ambient core manifold to all of the components and chambers that are air-compensated. Any reasonably gas-tight box may be used for the ambient core manifold. In many embodiments, the surface engine compartment 20 serves as the ambient core manifold.

In many embodiments, as the pressure within the ambient core manifold becomes slightly higher than the exterior ambient pressure, air forces water out of the ambient core reader 22 until the floats drop and the switches reopen. In alternative embodiments, any float, valve, trigger, pressure sensor, or meter commonly known in the art can be used to regulate the air.

As the vessel rises toward the surface when it is under water, the exterior ambient pressure of the water decreases and the air in the ambient-pressure air compensation grid expands. In many embodiments, the valves used for delivery of air from the ambient-pressure air compensation grid are closed, and the expanding air exits to the environment through vents in the ambient core manifold by way of a pea trap or any form of one-way valve commonly known in the art. In an embodiment, components vent back to the ambient core manifold as the air expands. In an alternative embodiment, components vent directly to the external environment via pop-off or check valves placed on the components.

In many embodiments, in-line down-regulators are placed at various locations on the vessel to compensate for over-pressurization resulting from pressurization differences due to distance from the ambient core reader 22. Each 12" above the trigger of the ambient core reader 22 adds an additional positive pressure difference of approximately 0.445 psi compared to the trigger of the ambient core reader 22. In certain embodiments of the present invention, each component that has an in-line down-regulator also has an independent purge valve to allow it to vent.

In many embodiments, the ambient core reader pipe has a third float at the top of the pipe. If water reaches this float, a warning alarm is triggered on the control panel in the passenger compartment indicating that the ambient-pressure air compensation grid is not delivering enough air to prevent intrusion of water. Causes include the vessel descending a rate that is too rapid for the ambient-pressure air compensation grid to compensate, or a system malfunction. In case of such an alarm, a pilot of the vessel should cease to descend in the water.

In several embodiments, various components of the vessel include check valves to prevent over-pressurization. In an embodiment, the side tank ballast compartments comprise check valves that allow air to vent off if the internal pressure exceeds the external ambient pressure by more than about 2 psi.

Any component can be directly air compensated by connecting to the ambient-pressure air compensation grid via a vent hose or by being enclosed in a compartment or submersion pod that is connected to the ambient-pressure air compensation grid. In certain embodiments of the invention, the surface engine compartment 20, the side tank ballast compartments, the out drives, certain radar domes and antenna domes, the hydraulic reservoirs, and the trim ballast tanks 3 may all be directly air compensated by connection to the ambient-pressure air compensation grid via a vent hose.

In an embodiment, the ambient-pressure air compensation grid shares air lines with the high-pressure air storage grid. In a further embodiment, the ambient-pressure air compensation grid shares air lines with the low-pressure primary air grid.

In many embodiments, the vessel uses out drives with direct air compensation from the ambient-pressure air compensation grid. Typical out drives are water sealed but can only withstand a pressure differential of about 10 psi between the interior and exterior of the out drive. By connecting the out drives to the ambient-pressure air compensation grid, the net pressure differential of the out drive remains near 0 psi, preventing water from entering the out drive.

Oxygen Grid

The oxygen grid comprises at least one oxygen tank 13 and a connection to the passenger compartment 1. In certain embodiments, the oxygen grid also comprises regulator valves and connectors known in the art.

In certain embodiments, a carbon dioxide scrubber works in conjunction with the oxygen tank or tanks 13. Any carbon dioxide scrubber known in the art may be used. In an embodiment, cartridges filled with soda lime are used as a carbon dioxide scrubber.

In embodiments of the invention, the oxygen is manually introduced to the passenger compartment 1 using a valve. In alternative embodiments, the oxygen is introduced to the passenger compartment 1 using a meter system commonly known in the art.

The oxygen and carbon dioxide scrubber materials typically must be replenished when the vessel is not at sea.

Electrical System

Typical vessels capable of underwater operation make use of electrical energy since combustion engines cannot be used at any significant depth under water. Most vessels rely on battery storage and power generated while surfaced. Some very large submarines carry significant fuel reserves and batteries. The vessel of the present invention is the first relatively small vessel capable of underwater operation that can generate and store its own power for a dive, while carrying significant fuel reserves and having sufficient range to make use of the fuel reserves. The total dive time and propulsion time per deployment is much higher than typical small vessels capable of underwater operation since the subject invention can recharge its own batteries.

The subject invention has an electrical system which comprises at least one alternator, at least one battery, and at least one electrical grid. In many embodiments, the electrical system comprises a series of alternators connected to the surface engines 31 that generate electricity, a bank of batteries for power storage, and an electrical grid of wiring, relays, and switches that provide power to the electrical components of the vessel.

In embodiments of the invention, when the vessel is operating on the surface of the water, it uses its surface engines 31 for propulsion and generates its own power from fuel stores via its alternators. While on the surface, the alternators provide power to the electrical components of the engines and power the electrical grids to run auxiliary systems that the vessel may include, such as lights, sensors, communications equipment, and an air conditioning system. Additionally, the alternators charge the batteries in the battery bank 12 to store power. When the vessel is submerged under water, the surface engines 31 should be inactive, and the battery storage provides power to the electrical systems. Electric motors or thrusters are primarily used for propulsion and steering of the vessel. In alternate embodiments, electric motors drive hydraulic pumps to power hydraulic thrusters. The battery storage powers the motors or thrusters, as well as the auxiliary dive systems the vessel may include, such as lights, sensors, communications equipment, and an air conditioning system. The motors and thrusters allow the vessel to navigate under water at speeds commonly attained by typical small submersibles.

In many embodiments, the vessel of the present invention has three electrical systems, including a primary electrical system, a secondary electrical system, and a supplemental electrical system. Each system may comprise a series of self-contained battery banks 12. The voltage level and current type for each system will vary depending on what specific task the vessel may be expected to perform, and any appropriate voltage may be used for each system. In an embodiment, the primary electrical system is 96 volts direct current (VDC), the secondary electrical system is 12 VDC, and the supplemental electrical system is 110 volts alternating current (VAC).

In embodiments of the invention, the primary electrical system comprises banks of batteries connected in series. In an embodiment, each battery bank comprises eight 12 V batteries, giving a total system voltage of 96 V. In an alternative embodiment, each battery bank comprises eight 30 V batteries for a total system voltage of 240 V. In further alternative embodiments, a different number of batteries and/or a different total system voltage may be used. The primary electrical system battery banks are connected to the electrical grid, and the primary electrical system stores the majority of the power needed for operation of the vessel while it is submerged in water, including directly supplying motive power for the thrusters or for the hydraulic pumps that drive hydraulic thrusters. The primary electrical system also recharges the secondary electrical system by means of DC-DC converters.

In many embodiments, the primary battery banks are contained within individual submersion pods comprising ambient pressure-compensated pods or pressure hull tubes. The pods or tubes containing the primary battery banks may be positioned anywhere on or in the vessel, including within the main ballast tanks or just under the deck within the upper body works 37 module. The pods or tubes holding each primary battery bank are typically designed with a buoyancy-to-weight ratio of approximately 1 so that they will be near-neutrally buoyant. Additionally, the tubes may be located so as to balance and stabilize the vessel as it transitions from a surfaced to submerged state.

The number of primary battery banks will vary, and any appropriate number may be used. In an embodiment, four battery banks contained in pressure hull tubes are used. In an alternative embodiment, six battery banks contained in ambient pressure-compensated pods are used.

In many embodiments, each primary battery bank is designed such that it may be quickly and easily disconnected from the electrical grid. This allows for entire banks or for individual batteries to be changed out modularly for repairs or maintenance, as well as for battery upgrades or changes in battery type. Each battery in the primary electrical system may be connected to a sensor so that it can be individually monitored, and each bank may be turned off manually to isolate it in an emergency or so maintenance can be conducted.

In embodiments of the invention, the secondary electrical system comprises banks of batteries connected in parallel. In an embodiment, one battery bank comprising two 12 V batteries is used. Two additional 12 V batteries are present and typically kept disconnected, but can be connected when needed as a backup supply. In further embodiments, a different number of batteries, batteries with higher or lower voltages, and/or additional battery banks may be used. The secondary electrical system battery bank is connected to an electrical grid, and the secondary electrical system provides power for lighting and cockpit (passenger compartment) controls and for engine starting when the vessel is on the surface of the water. The secondary electrical system also provides power for the supplemental electrical system by means of a DC-AC inverter.

The secondary electrical system batteries may be located anywhere on or in the vessel, including the surface engine compartment 20 or passenger compartment 1. In many embodiments, the secondary battery banks are contained within submersion pods comprising individual ambient pressure-compensated pods or in pressure hull tubes. The pods or tubes containing the secondary battery banks may be positioned anywhere on or in the vessel, including within the main ballast tanks or just under the deck within the upper body works 37 module. The pods or tubes holding each secondary battery bank are typically designed with a buoyancy-to-weight ratio of approximately 1 so that they will be near-neutrally buoyant. Additionally, the tubes may be located so as to balance and stabilize the vessel as it transitions from a surfaced to submerged state.

In many embodiments, each secondary battery bank is designed such that it may be quickly and easily disconnected from the electrical grid. This allows for entire banks or for individual batteries to be changed out modularly for repairs or maintenance, as well as for battery upgrades or changes in battery type.

Any type of appropriate battery or battery system with sufficient storage may be used for both the primary and secondary electrical system batteries. In certain embodiments of the invention, the individual batteries used both in the primary electrical system battery banks and in the secondary electrical system are lead-acid, absorbed glass mat (AGM) type. AGM batteries typically achieve a rapid rate of recharge (approximately 30 minutes to recharge to 80% capacity) without causing any significant decrease in battery life. In alternative embodiments, silver-zinc batteries may be used. Each battery in a given battery bank does not need to be the same type, and many different batteries and battery systems are known in the art.

In many embodiments, the primary electrical system battery banks are recharged by at least one alternator. In an embodiment, the primary battery banks are 96 V and are charged by two 48V alternators connected in series. The alternators are connected to the surface engines via a pulley drive, allowing the primary batteries to be recharged when the vessel is surfaced and the surface engines are running. In an alternative embodiment, two 96 V alternators in parallel are used to charge the 96 V primary battery banks. In a further embodiment, one 96 V alternator is used to charge the 96 V primary battery banks. In yet a further embodiment, one 240 V alternator is used to charge the 240 V primary battery banks. The secondary batteries may also be charged by at least one additional alternator. In an embodiment, two 12 V alternators charge two 12 V secondary batteries.

In embodiments of the invention, the battery banks 12 are equipped with pressure and water sensor alarms. The battery banks 12 also vent out any gas produced during the recharging process.

In many embodiments of the invention, the supplemental electrical system is an alternating current system. In an embodiment, the voltage of the supplemental electrical system is 110 V. All supplemental electrical system alternating current electrical power comes from either the DC-AC inverter from the secondary electrical system or from an external source, such as the shore power available at marinas. When connected to external power, a battery charger slowly charges the primary battery banks to full capacity. The supplemental electrical system powers any alternating current devices connected to the vessel. This may include an alternating current air conditioning system in the passenger compartment as well as any device connected in the passenger compartment that operates at the same voltage as the supplemental electrical system. In an embodiment, the supplemental electrical system is 110 VAC, and a 110 V computer, power tool, or other device may be connected in the passenger compartment and draw power from the supplemental electrical system.

In many embodiments of the invention, all high-voltage wires in the electrical systems and electrical grid are kept outside the passenger compartment 1. This reduces the risk of fire in the passenger compartment 1.

Hydraulic System

Many embodiments of the subject invention comprise at least one hydraulic system to help transfer power throughout the vessel. The hydraulic systems transfer power to rams that may be used to operate dive planes, the hatch, the surface engine compartment lid 11, and the out drive trim and steering. In certain embodiments, hydraulic systems actuate valves throughout the vessel, such as in the ballast system. In certain embodiments, hydraulic systems transfer power to the thrusters.

In many embodiments, the vessel of the subject invention comprises three separate hydraulic systems: the propulsion hydraulic system, the auxiliary hydraulic system, and the control hydraulic system. The three systems may share a common reservoir, but each system typically has a separate source of power.

The propulsion hydraulic system uses at least one electric motor powered by the primary electrical system. In an embodiment, the propulsion hydraulic system uses two electric motors powered by the primary electrical system. In an embodiment, the primary electrical system providing power to the electric motors comprises battery banks connected in series giving a total output of 96 volts direct current. The electric motors drive hydraulic pumps that supply fluid power to the thrusters. Solenoid valves can be used for directional control. In many embodiments, the propulsion hydraulic system provides power to a hull evacuation pump. The hull evacuation pump ejects water from the interior of the hull to help the sub rise to the surface from a submerged state.

Using a hydraulic system to power the thrusters lowers the cost of building and increases the flexibility in mounting the thrusters. In many embodiments, the vessel comprises control valves that allow a single electric motor to power several thrusters.

In many embodiments, the hydraulic system controls the delivery of horsepower throughout the vessel, functioning as an effective transmission.

The auxiliary hydraulic system uses hydraulic pumps to generate fluid power. The hydraulic pumps are driven by the surface engines 31. In an embodiment, the vessel has two hydraulic pumps, each driven by one surface engine 31. In an embodiment, one hydraulic pump powers the hydraulic steering system for the surface out drives, and another pump drives the air compressor used to recharge the air supply of the vessel. In an alternative embodiment, the output flows from all hydraulic pumps are combined to power the steering system for the surface out drives, the air compressor used to recharge the air supply of the vessel, and the high voltage alternators. In a further embodiment, the output flows from all hydraulic pumps are combined to power any other device which must draw power from the surface engines 31.

The control hydraulic system uses a hydraulic power unit driven by the secondary electrical system to fill a hydraulic accumulator. The hydraulic accumulator stores fluid under pressure to be used by hydraulic cylinders throughout the vessel. The hydraulic cylinders that use the fluid stored by the hydraulic accumulator actuate the surface engine intake vent, ballast control valves, main hatch, and dive planes. In many embodiments, the hydraulic power unit is a hydraulic pump with a close-coupled electric motor. In many embodiments, the secondary electrical system that drives the hydraulic power unit comprises battery banks connected in parallel that give an output of 12 volts direct current.

In many embodiments, the hydraulic accumulator comprises a switch. When the stored fluid is used and drained from the hydraulic accumulator to a certain pressure, the switch activates the hydraulic power unit to refill the hydraulic accumulator. The use of a hydraulic accumulator provides the advantage of not having to activate the hydraulic power unit any time an actuator is used. Instead, the hydraulic power unit is activated only when the pressure drops below a certain point. In the event of failure of the hydraulic power unit, the hydraulic accumulator also allows operation of the actuators for a limited period of time until the stored fluid is completely drained.

The subject invention will now be described with reference to examples of specific configurations of the vessel.

It should be understood that the examples and embodiments described herein are for illustrative purposes only.

Many different configurations and variations are possible, as has been described, and are to be included within the spirit and purview of this invention.

EXAMPLE 1

The following embodiment of the present invention is a configuration that may be useful for recreational or sporting purposes.

A central framework is used, comprising an I-beam or box tubing of corrosion-resistant metal or composite material. Appropriate cross-bracing is included to withstand sea conditions. The primary assemblies attached to the central framework include a passenger compartment, a surface hull, an upper body works, a surface engine compartment, side tanks, and main internal ballast.

The passenger compartment mounts to the central framework via an external series of corrosion-resistant metal or composite material bands. It comprises a cylindrical exterior pressure hull with hemispherical ends. The pressure hull is rated to a depth of 250 feet with a safety factor of 16 and is 15 feet long and 4 feet in outside diameter. The material thickness, quality, and construction technique meet the American Bureau of Shipping (ABS) standards for the depth rating and safety factor.

The interior of the passenger compartment is outfitted with a metal or composite box-tube framework upon which the interior components are mounted. The interior trim is luxury style with seating for five passengers, including a pilot, in a single row of seats. A rear-mounted air conditioner is included. The front has a control panel and multi-screen display allowing operation of all vessel systems, sensors, and instruments, connected via a computer mounted behind the panel.

The surface hull connects to the central framework either with glue or using bolts connected to pre-drilled mounting holes. It is a V-shaped powerboat-style planing hull, and with the side tanks attached, the vessel's surface profile is in the general shape of a trimaran. The draft in saltwater is about 20-24 inches, and the vessel displaces about 30,000 pounds of water with about 520 gallons of fuel and a moderate payload.

The interior of the surface hull contains the main internal ballast compartments completely and their underlying free-flood semi-controllable ballast zone, which in turn house the fuel cells and air tanks. The surface hull also contains the surface engine compartment and a free-flood semi-controllable ballast zone surrounding the surface engine compartment aft. The exterior of the surface hull shell mates at the top to the upper body works via glue or a gasket seal.

The surface engine compartment is a box constructed of corrosion-resistant metal or composite material, and a hydraulically-actuated vent door at the top provides air intake. A larger gasket, hinged at the rear and hydraulically-actuated, seals the entire top portion of the compartment. The surface engine compartment is pressure-compensated at depth and has a volume of about 109 cubic feet.

Two 5,000 psi SCBA air compressors are used to charge the air system and are located in the surface engine compartment and hydraulically driven. Eight tanks, located in the main internal ballast compartments, store 500 cubic feet each at 4,500 psi, with one in reserve connected to the emergency air grid. The primary air system operates at 240 psi via down-regulators. The ambient core reader comprises a standard pipe and a three-trigger float mechanism, and the surface engine compartment functions as the ambient core manifold.

The oxygen tanks are located in the upper body works and are connected to the passenger compartment. Enough oxygen is present to supply 48 hours of life support to five persons, according to ABS standards. A cartridge-type carbon dioxide scrubber is mounted in the passenger compartment with sufficient stores for 48-hour operation.

The side tanks are air-compensated and are each divided internally into two main external ballast compartments and one forward trim ballast compartment. Each side tank is about 28 feet long, and the combined volume of the side tanks is about 195 cubic feet.

The upper body works mounts to the central framework via bolts on pre-drilled mounting points. The upper body works comprises a fiberglass shell molded into two longitudinally-running side decks flanking the passenger compartment, each about 3 feet wide and about 13 feet long. Molded fiberglass staircases on either side descend to the rear deck, which is about 10 feet wide and about 4 feet deep and provides attached seating for six passengers. A spoiler extends over the surface engine compartment cover and is used for mounting antennae and the radar dome.

The interior of the upper body works is hollow and houses the four battery banks and the free-flood zones. The upper and lower portions of the upper body works have a series of one-way flapper valves, allowing water and air to enter and exit the assembly during submersion and surfacing. The lower portion is open at the rear to free-flooding semi-controlled ballast section surrounding the surface engine compartment.

The hull gates open to free-flood areas in the lower surface hull to fill or purge the ballast system. Pumps are used to assist in water induction and expulsion. The four main internal ballast compartments are open-bottomed rectangular boxes lined with ballast liners and combine to give about 170 cubic feet in volume. Pea traps connect each main internal ballast compartment to each main external ballast compartment, and the exhaust pipe valve is located in the passenger compartment.

The trim ballast system comprises stability tanks mounted rearward above the deck and forward trim tanks located in the side tanks. The trim ballast compartments are air-compensated and combine to give about 19 cubic feet of volume.

Surface power is provided by two 440-horsepower marine inboard diesel engines through a two-to-one gear ratio transmission, generating about 3,400 foot-pounds of torque at maximum thrust. Out drives, which are pressure-compensated at depth, provide surface propulsion. Four collapsible baffle-lined variable displacement fuel cells of about 130 gallons each are located inside the main internal ballast compartments.

Two alternators, driven by the surface engines, provide power to the electrical system. Four battery banks, each encased in a submersion pod, provide electrical storage to the primary electrical system, which operates at 96 VDC. Each submersion pod is a tubular pressure hull of material and construction rated to the maximum depth with safety factor. Each battery bank has eight lead-acid 12-volt AGM-type dry cell batteries connected in series.

The secondary electrical system operates at 12 VDC, and is provided electrical storage by two lead-acid AGM-type dry cell batteries mounted in the surface engine compartment, with an additional emergency reserve battery. The supplemental electrical system, which operates at 110 VAC, is provided by an inverter mounted in the surface engine compartment and attached to the secondary electrical system.

A series of pumps located in the surface engine compartment generates hydraulic power which is distributed to the hydraulic grid. The pumps are powered by electric motors connected to the primary electrical system grid. Main hydraulic thrusters mounted to the rear of the upper body works, on either side of the rear deck, provide subsurface propulsion. Forward and aft hydraulic thruster tubes provide yaw control. Retractable dive planes mounted in the forward portion of the upper body works assembly assist pitch and roll control.

The surface engines drive pumps via power takeoffs to provide power to the auxiliary hydraulic system, which provides trim and steering to the out drives. The control hydraulic system actuates valves, dive planes, and vent, and is driven by a pump attached to an electric motor powered by the secondary electrical system grid with power stored in an accumulator.

The vessel is outfitted with GPS, radar, forward- and downward-sensing sonar, autopilot, and chart plotting. External antennae are pressure-compensated.

The entire vessel is about 32 feet in length and about 28 feet long at the waterline. The total beam with side tanks installed is about 13.5 feet, and the draft is about 20 inches. The height is about 6 feet, 10 inches from the keel to the top of the passenger compartment and about 8.5 feet from the keel to the top of the spoiler. The vessel weighs about 26,000 pounds when dry.

EXAMPLE 2

The following embodiment of the present invention is a configuration that may be useful for military purposes.

A central framework is used, comprising an I-beam or box tubing of corrosion-resistant metal or composite material. Appropriate cross-bracing is included to withstand sea conditions. The primary assemblies attached to the central framework include a passenger compartment, a surface hull, an upper body works, a surface engine compartment, side tanks, and main internal ballast.

The passenger compartment mounts to the central framework via an external series of corrosion-resistant metal or composite material bands. It comprises a cylindrical exterior pressure hull with hemispherical ends. The pressure hull is rated to a depth of 600 feet with a safety factor of seven and is 15 feet long and 4 feet in outside diameter. The material thickness, quality, and construction technique meet the American Bureau of Shipping (ABS) standards for the depth rating and safety factor. Additionally, the materials used for construction have a high NIJ threat level resistance.

The interior of the passenger compartment is outfitted with a metal or composite box-tube framework upon which the interior components are mounted. The interior allows seating for five passengers, including a pilot, oriented longitudinally. A rear-mounted air conditioner is included. The front has a control panel and multi-screen display allowing operation of all vessel systems, sensors, and instruments, connected via a computer mounted behind the panel. Co-pilot controls are included in the general seating area.

The surface hull connects to the central framework either with glue or using bolts connected to pre-drilled mounting holes. It is a V-shaped powerboat-style planing hull, and with the side tanks attached, the vessel's surface profile is in the general shape of a trimaran. The draft in saltwater is about 20-24 inches, and the vessel displaces about 30,000 pounds of water with about 520 gallons of fuel and a moderate payload.

The interior of the surface hull contains the main internal ballast compartments completely and their underlying free-flood semi-controllable ballast zone, which in turn house the fuel cells and air tanks. The surface hull also contains the surface engine compartment and a free-flood section surrounding the surface engine compartment aft. The exterior of the surface hull shell mates at the top to the upper body works via glue or a gasket seal.

Torpedo placements are included on the surface hull with connections to the electrical grid to provide for computer fire control.

The surface engine compartment is a box constructed of corrosion-resistant metal or composite material, and a hydraulically-actuated vent door at the top provides air intake. A larger gasket, hinged at the rear and hydraulically-actuated, seals the entire top portion of the compartment. The surface engine compartment is pressure-compensated at depth and has a volume of at least 110 cubic feet. The materials used for construction of the compartment are of a high NIJ threat level resistance.

Two 5,000 psi SCBA air compressors are used to charge the air system and are located in the surface engine compartment and hydraulically driven. Eight tanks, located in the main internal ballast compartments, store 500 cubic feet each at 4,500 psi, with one in reserve connected to the emergency air grid. The primary air system operates at 240 psi via down-regulators. The ambient core reader comprises a standard pipe and a three-trigger float mechanism, and the surface engine compartment functions as the ambient core manifold.

The oxygen tanks are located in the upper body works and are connected to the passenger compartment. Enough oxygen is present to supply 48 hours of life support to five persons, according to ABS standards. A cartridge-type carbon dioxide scrubber is mounted in the passenger compartment with sufficient stores for 48-hour operation.

The side tanks are air-compensated and are each divided internally into two main external ballast compartments and one forward trim ballast compartment. Each side tank is about 28 feet long, and the combined volume of the side tanks is about 195 cubic feet. The side tanks are constructed of a material with a high NIJ threat level resistance.

The upper body works mounts to the central framework via bolts on pre-drilled mounting points. The upper body works comprises an aluminum shell molded into two longitudinally-running side decks flanking the passenger compartment, each about 3 feet wide and about 13 feet long. Aluminum staircases on either side descend to the rear deck, which is about 10 feet wide and about 4 feet deep. The profile is radar-minimized, and a radar-absorptive coating is used.

The rear and side decks have hard point and grid attachments where gun mounts or missile launchers can be attached. Additionally, wells are constructed into the decking so guns or missiles can be retracted into submersion pods. Submersion pods are present for housing munitions as well.

The interior of the upper body works is hollow and houses the four battery banks and the free-flood zones. The upper and lower portions of the upper body works have a series of one-way flapper valves, allowing water to enter and exit the assembly during submersion and surfacing. The lower portion is open at the rear to the free-flooding semi-controllable ballast section surrounding the surface engine compartment.

The hull gates open to free-flood semi-controllable ballast zones in the lower surface hull to fill or purge the ballast system. Pumps are used to assist in water induction and expulsion. The four main internal ballast compartments are open-bottomed rectangular boxes lined with ballast liners and combine to give about 170 cubic feet in volume. Pea traps connect each main internal ballast compartment to each main external ballast compartment, and the exhaust pipe valve is located in the passenger compartment.

The trim ballast system comprises stability tanks mounted rearward above the deck and forward trim tanks located in the side tanks. The trim ballast compartments are air-compensated and combine to give about 19 cubic feet of volume.

Surface power is provided by two 1400-horsepower turbine engines. Jet drives, which are pressure-compensated at depth, provide surface propulsion. Four collapsible baffle-lined variable displacement fuel cells of about 130 gallons each are located inside the main internal ballast compartments.

Two alternators, driven by the surface engines, provide power to the electrical system. Four battery banks, each encased in a submersion pod, provide electrical storage to the primary electrical system, which operates at 96 VDC. Each submersion pod is a tubular pressure hull of material and construction rated to the maximum depth with safety factor. Each battery bank has eight silver-zinc 12-volt batteries connected in series.

The secondary electrical system operates at 12 VDC, and is provided electrical storage by two silver-zinc batteries mounted in the surface engine compartment, with an additional emergency reserve battery. The supplemental electrical system, which operates at 110 VAC, is provided by an inverter mounted in the surface engine compartment and attached to the secondary electrical system.

A series of pumps located in the surface engine compartment generates hydraulic power which is distributed to the hydraulic grid. The pumps are powered by electric motors connected to the primary electrical system grid. Main hydraulic thrusters mounted to the rear of the upper body works, on either side of the rear deck, provide subsurface propulsion. Forward and aft hydraulic thruster tubes provide yaw control.

The surface engines drive pumps via power takeoffs to provide power to the auxiliary hydraulic system, which provides trim and steering to the out drives. The control hydraulic system actuates valves, dive planes, and vent, and is driven by a pump attached to an electric motor powered by the secondary electrical system grid with power stored in an accumulator.

The vessel is outfitted with military GPS, radar, forward- and downward-sensing sonar, autopilot, and chart plotting. External antennae are pressure-compensated. Additional military communication devices are present in submersion pods.

The entire vessel is about 32 feet in length and about 28 feet long at the waterline. The total beam with side tanks installed is about 13.5 feet, and the draft is about 20 inches. The height is about 6 feet, 10 inches from the keel to the top of the passenger compartment. The vessel weighs about 26,000 pounds when dry.

EXAMPLE 3

The following embodiment of the present invention is a configuration that may be useful for industrial purposes.

A central framework is used comprising an I-beam or box tubing of corrosion-resistant metal or composite material. Appropriate cross-bracing is included to withstand sea conditions. The primary assemblies attached to the central framework include a passenger compartment, a surface hull, an upper body works, a surface engine compartment, side tanks, and main internal ballast.

The passenger compartment mounts to the central framework via an external series of corrosion-resistant metal or composite material bands. It comprises a cylindrical exterior pressure hull with hemispherical ends. The pressure hull is rated to a depth of 600 feet with a safety factor of seven and is 15 feet long and 4 feet in outside diameter. The material thickness, quality, and construction technique meet the American Bureau of Shipping (ABS) standards for the depth rating and safety factor. The front end is composed of acrylic, and there is also acrylic in the lower and upper portions of the passenger compartment.

The interior of the passenger compartment is outfitted with a metal or composite box-tube framework upon which the interior components are mounted. The interior includes a folding berth for sleeping accommodations, a marine sanitation device, and seating for two passengers, including a pilot. The front has a control panel and multi-screen display allowing operation of all vessel systems, sensors, and instruments, connected via a computer mounted behind the panel.

The surface hull connects to the central framework either with glue or using bolts connected to pre-drilled mounting holes. It is a displacement hull. The draft in saltwater is deeper than that of the previous examples, and the vessel displaces around 40,000 pounds of water with a full fuel load and heavy payload.

The interior of the surface hull contains the main internal ballast compartments completely and their underlying free-flood zone, which in turn house the fuel cells and air tanks. The surface hull also contains the surface engine compartment and a free-flood section surrounding the surface engine compartment aft. The exterior of the surface hull shell mates at the top to the upper body works via glue or a gasket seal. Part of the surface hull is constructed of acrylic to provide a viewing window through the bottom of the passenger compartment.

The surface engine compartment is a box constructed of corrosion-resistant metal or composite material, and a hydraulically-actuated vent door at the top provides air intake. A larger gasket, hinged at the rear and hydraulically-actuated, seals the entire top portion of the compartment. The surface engine compartment is pressure-compensated at depth and has a volume of about 60 cubic feet.

Two 5,000 psi SCBA air compressors are used to charge the air system and are located in the surface engine compartment and hydraulically driven. Eight tanks, located in the main internal ballast compartments, store 500 cubic feet each at 4,500 psi, with one in reserve connected to the emergency air grid. The primary air system operates at 240 psi via down-regulators. The ambient core reader comprises a standard pipe and a three-trigger float mechanism, and the surface engine compartment functions as the ambient core manifold.

The oxygen tanks are located in the upper body works and are connected to the passenger compartment. Enough oxygen is present to supply at least 48 hours of life support to two persons, according to ABS standards. A cartridge-type carbon dioxide scrubber is mounted in the passenger compartment with sufficient stores for 48-hour operation.

The side tanks are air-compensated and are each divided internally into two main external ballast compartments and one forward trim ballast compartment. Each side tank is about 28 feet long, and the combined volume of the side tanks is over 350 cubic feet.

The upper body works mounts to the central framework via bolts on pre-drilled mounting points. The upper body works comprises a fiberglass shell molded into two longitudinally-running side decks flanking the passenger compartment, each about 3 feet wide and about 13 feet long. Four extra fuel cells, doubling the fuel load, are present on the upper body works. Mounting for two manipulator arms is also present.

The interior of the upper body works is hollow and houses the four battery banks and the free-flood zones. The upper and lower portions of the upper body works have a series of one-way flapper valves, allowing water to enter and exit the assembly during submersion and surfacing. The lower portion is open at the rear to free-flooding semi-controlled ballast section surrounding the surface engine compartment.

The hull gates open to free-flood areas in the lower surface hull to fill or purge the ballast system. Pumps are used to assist in water induction and expulsion. The four main internal ballast compartments are open-bottomed rectangular boxes lined with ballast liners and combine to give about 170 cubic feet in volume. Pea traps connect each main internal ballast compartment to each main external ballast compartment, and the exhaust pipe valve is located in the passenger compartment.

The trim ballast system comprises stability tanks mounted rearward above the deck and forward trim tanks located in the side tanks. The trim ballast compartments are air-compensated and combine to give about 19 cubic feet of volume.

Surface power is provided by a single 440-horsepower marine inboard diesel engine through a two-to-one gear ratio transmission, generating about 3,400 foot-pounds of torque at maximum thrust. Out drives, which are pressure-compensated at depth, provide surface propulsion. Four collapsible baffle-lined variable displacement fuel cells of about 130 gallons each are located inside the main internal ballast compartments.

Two alternators, driven by the surface engines, provide power to the electrical system. Four battery banks, each encased in a submersion pod, provide electrical storage to the primary electrical system, which operates at 96 VDC. Each submersion pod is a tubular pressure hull of material and constriction rated to the maximum depth with safety factor. Each battery bank has eight lead-acid 12-volt AGM-type dry cell batteries connected in series.

The secondary electrical system operates at 12 VDC, and is provided electrical storage by two lead-acid AGM-type dry cell batteries mounted in the surface engine compartment, with an additional emergency reserve battery. The supplemental electrical system, which operates at 110 VAC, is provided by an inverter mounted in the surface engine compartment and attached to the secondary electrical system.

A series of pumps located in the surface engine compartment generates hydraulic power which is distributed to the hydraulic grid. The pumps are powered by electric motors connected to the primary electrical system grid. Main hydraulic thrusters mounted to the rear of the upper body works, on either side of the rear deck, provide subsurface propulsion. Forward and aft hydraulic thruster tubes provide yaw control.

The surface engines belt-drive pumps to provide power to the auxiliary hydraulic system, which provides trim and steering to the out drives. The control hydraulic system actuates valves, dive planes, and vent, and is driven by a pump attached to an electric motor powered by the secondary electrical system grid with power stored in an accumulator.

The vessel is outfitted with GPS, radar, forward- and downward-sensing sonar, autopilot, and chart plotting. External antennae are pressure-compensated.

The entire vessel is about 32 feet in length and about 28 feet long at the waterline. The total beam with side tanks installed is about 13.5 feet, and the draft is about 40 inches. The height is about 6 feet, 10 inches from the keel to the top of the passenger compartment. The vessel weighs about 30,000 pounds when dry.

We claim:

1. A purpose-configurable submarine comprising:

a surface hull;

a surface engine compartment housing at least one engine;

a fuel system configured to hold and deliver fuel to said engine;

a ballast system comprising at least one ballast compartment; and a passenger compartment;

wherein the passenger compartment is mounted such that when the submarine navigates on the surface of a body of water, at least the majority of the volume of the passenger compartment is above the waterline; and wherein said submarine comprises at least one variable displacement fuel cell as a part of said fuel system.

2. The submarine according to claim 1, wherein said passenger compartment comprises a pressure hull.

3. The submarine according to claim 1, wherein said passenger compartment comprises an ambient pressure passenger compartment.

4. The submarine according to claim 1, wherein said ballast system is a staged ballast system.

5. The submarine according to claim 1, further comprising a central framework; wherein the surface hull, the surface engine compartment, and the passenger compartment are each attached to the central framework.

6. The submarine according to claim 1, wherein the ballast system comprises at least one fully-controllable ballast compartment.

7. The submarine according to claim 6, wherein the combined volume of the at least one fully-controllable ballast compartment is from approximately 125% to approximately 315% of the total volume of said passenger compartment.

8. The submarine according to claim 7, wherein the combined volume of the at least one fully-controllable ballast compartment is approximately 200% of the total volume of said passenger compartment.

9. The submarine according to claim 6, wherein the combined volume of the at least one fully-controllable ballast compartment is from approximately 75% to approximately 125% of the total volume of surface displacement of the submarine.

10. The submarine according to claim 9, wherein the combined volume of the at least one fully-controllable ballast compartment is approximately 100% of the total volume of surface displacement of the submarine.

11. The submarine according to claim 2, wherein any through-hull penetrations in the pressure hull are located in the lowest third of the volume of said pressure hull.

12. The submarine according to claim 1, wherein said surface hull is a planing hull.

13. The submarine according to claim 1, wherein said surface hull is a displacement hull.

14. The submarine according to claim 1, wherein said surface engine compartment is ambient-pressure compensated.

15. The submarine according to claim 14, wherein said surface engine compartment contains an ambient core reader.

16. The submarine according to claim 15, wherein said ambient core reader comprises a pipe and at least one float trigger.

17. The submarine according to claim 16, wherein said pipe is about 18 inches long.

18. The submarine according to claim 16, wherein said at least one float trigger is separated from any other float triggers and from both openings of said pipe by at least 3 inches.

19. The submarine according to claim 1, wherein said at least one engine is connected to an out drive.

20. The submarine according to claim 1, wherein said at least one variable displacement fuel cell is disposed within at least one ballast compartment.

21. The submarine according to claim 1, wherein said variable displacement fuel cell comprises a flexible material.

22. The submarine according to claim 21, wherein said flexible material is a flexible polymer material.

23. The submarine according to claim 1, further comprising an upper body works.

24. The submarine according to claim 23, wherein said upper body works comprises at least one semi-controllable ballast zone.

25. The submarine according to claim 23, wherein said upper body works comprises at least one stability tank.

26. The submarine according to claim 23, wherein said upper body works comprises 2 side decks and 1 rear deck.

27. The submarine according to claim 23, wherein said upper body works comprises at least one manipulator arm.

28. The submarine according to claim 23, wherein said upper body works comprises at least one weapon mount.

29. The submarine according to claim 23, wherein said upper body works comprises at least one well.

30. The submarine according to claim 1, further comprising at least one submersion pod.

31. The submarine according to claim 1, further comprising at least one submersion pod housing at least one battery.

32. The submarine according to claim 1, further comprising at least one air grid.

33. The submarine according to claim 23, comprising a high-pressure air storage grid, an emergency air grid, an ambient-pressure air compensation grid, and an oxygen grid.

34. The submarine according to claim 33, wherein said high-pressure air storage grid comprises at least one SCBA compressor, at least one storage tank, at least one hose, and at least one valve.

35. The submarine according to claim 34, wherein said at least one SCBA compressor is rated to about 5,000 psi.

36. The submarine according to claim 34, wherein said high-pressure air storage grid further comprises at least one takeoff valve.

37. The submarine according to claim 34, wherein said emergency air grid comprises at least one air storage tank capable of storing air at about 5,000 psi.

38. The submarine according to claim 33, further comprising a low-pressure primary air grid which operates at a pressure of about 240 psi.

39. The submarine according to claim 33, wherein said ambient-pressure air compensation grid connects to an ambient core manifold.

40. The submarine according to claim 39, wherein said surface engine compartment is said ambient core manifold.

41. The submarine according to claim 33, wherein said oxygen grid comprises at least one oxygen tank and at least one connection to said passenger compartment.

42. The submarine according to claim 1, further comprising carbon dioxide scrubber material.

43. The submarine according to claim 42, further comprising at least one oxygen tank, wherein said at least one oxygen tank and said carbon dioxide scrubber material are sufficient to provide life support for 5 adult humans for at least 40 hours.

44. The submarine according to claim 1, further comprising at least 2 side tanks.

45. The submarine according to claim 44, wherein the total combined volume of said side tanks is about 195 cubic feet.

46. The submarine according to claim 44, wherein the total combined volume of said side tanks is at least 200 cubic feet.

47. The submarine according to claim 44, wherein each of said side tanks is divided internally into at least 3 compartments.

48. The submarine according to claim 6, comprising at least one internal ballast compartment contained within said surface hull and at least one external ballast compartment contained within at least one side tank.

49. The submarine according to claim 48, wherein said at least one internal ballast compartment is connected to an external ballast compartment via a pea trap connection.

50. The submarine according to claim 48, wherein said at least one internal ballast compartment is lined with a ballast liner.

51. The submarine according to claim 48, wherein said at least one internal ballast compartment is open to the environment on the bottom.

52. The submarine according to claim 48, wherein said at least one external ballast compartment is ambient-pressure compensated.

53. The submarine according to claim 1, wherein said submarine has a length of less than 50 feet.

54. The submarine according to claim 53, wherein said submarine has a length of less than 35 feet.

55. The submarine according to claim 54, wherein said submarine has a length of less than 20 feet.

56. The submarine according to claim 55, wherein said submarine has a length of less than 10 feet.

57. The submarine according to claim 1, wherein said submarine has a width of less than 20 feet.

58. The submarine according to claim 57, wherein said submarine has a width of less than 10 feet.

59. The submarine according to claim 1, wherein said submarine has a height of less than 10 feet.

60. The submarine according to claim 59, wherein said submarine has a height of less than 6 feet.

61. The submarine according to claim 1, wherein said submarine has a total dry weight of between about 2,500 pounds and about 60,000 pounds.

62. The submarine according to claim 61, wherein said submarine has a total dry weight of between about 2,500 pounds and about 30,000 pounds.

63. The submarine according to claim 62, wherein said submarine has a total dry weight of between about 2,500 pounds and about 15,000 pounds.

64. The submarine according to claim 2, wherein said pressure hull is rated to a depth of at least 50 feet.

65. The submarine according to claim 64, wherein said pressure hull is rated to a depth of at least 200 feet.

66. The submarine according to claim 65, wherein said pressure hull is rated to a depth of at least 600 feet.

67. The submarine according to claim 66, wherein said pressure hull is rated to a depth of at least 1200 feet.

68. The submarine according to claim 67, wherein said pressure hull is rated to a depth of at least 1500 feet.

69. The submarine according to claim 1, wherein said passenger compartment comprises an air conditioner.

70. The submarine according to claim 2, wherein said passenger compartment comprises a cylinder with hemispherical ends, wherein the outside diameter of said passenger compartment is about 4 feet, and wherein the length of said passenger compartment is about 15 feet.

71. The submarine according to claim 1, wherein said variable displacement fuel cell comprises a baffle.

72. The submarine according to claim 1, wherein the combined volume of said at least one variable displacement fuel cell is at least 50 gallons.

73. The submarine according to claim 72, wherein the combined volume of said at least one variable displacement fuel cell is at least 100 gallons.

74. The submarine according to claim 73, wherein the combined volume of said at least one variable displacement fuel cell is at least 200 gallons.

75. The submarine according to claim 74, wherein the combined volume of said at least one variable displacement fuel cell is at least 500 gallons.

76. The submarine according to claim 1, wherein said passenger compartment comprises at least one acrylic viewing window.

77. The submarine according to claim 76, wherein said surface hull comprises at least one acrylic viewing window.

78. The submarine according to claim 1, said fuel system further comprising a fuel grid.

79. The submarine according to claim 78, wherein said fuel grid comprises at least one pump used to pump fuel out of said at least one variable displacement fuel cell.

80. The submarine according to claim 1, wherein said ballast system comprises at least one pump.

81. The submarine according to claim 1, wherein said submarine is capable of surface operation at a speed of at least 10 miles per hour.

82. The submarine according to claim 81, wherein said submarine is capable of surface operation at a speed of at least 20 miles per hour.

83. The submarine according to claim 82, wherein said submarine is capable of surface operation at a speed of at least 30 miles per hour.

84. The submarine according to claim 83, wherein said submarine is capable of surface operation at a speed of at least 40 miles per hour.

85. The submarine according to claim 84, wherein said submarine is capable of surface operation at a speed of at least 60 miles per hour.

86. The submarine according to claim 1, wherein said submarine has a power-to-weight ratio during surface operation of at least 1 horsepower per 50 pounds.

87. The submarine according to claim 86, wherein said power-to-weight ratio during surface operation is at least 1 horsepower per 35 pounds.

88. The submarine according to claim 87, wherein said power-to-weight ratio during surface operation is at least 1 horsepower per 25 pounds.

89. The submarine according to claim 88, wherein said power-to-weight ratio during surface operation is at least 1 horsepower per 10 pounds.

90. The submarine according to claim 1, wherein said submarine is capable of safely operating on its own with human passengers for at least 40 consecutive hours.

91. The submarine according to claim 1, wherein the surface hull, the surface engine compartment, and the passenger compartment are integrated into a single chassis.

92. The submarine according to claim 1, wherein the surface hull, the surface engine compartment, and the passenger compartment each comprise reinforcing members.

93. The submarine according to claim 92, wherein the reinforcing members comprise steel.

94. The submarine according to claim 92, wherein the reinforcing members comprise composite material.

95. The submarine according to claim 92, wherein the reinforcing members comprise aluminum.

96. The submarine according to claim 92, wherein the surface hull, the surface engine compartment, and the passenger compartment each comprise mounting brackets.

97. The submarine according to claim 92, wherein the surface hull, the surface engine compartment, and the passenger compartment each comprise pre-drilled mounting holes.

98. The submarine according to claim 5, wherein the central framework comprises steel.

99. The submarine according to claim 5, wherein the central framework comprises composite material.

100. The submarine according to claim 5, wherein the central framework comprises aluminum.

101. A submarine comprising:

a planing hull;

means for propulsion;

a fuel system configured to hold and deliver fuel to said means for propulsion; and a pressure hull passenger compartment;

wherein when said submarine is navigating on the surface of a body of water, at least the majority of the pressure hull passenger compartment is above the waterline; and wherein the fuel system comprises at least one variable displacement fuel cell.

102. The submarine according to claim 101, wherein the planing hull has a bow end forward and a stern end rearward, and wherein the means for propulsion causes the submarine to move in a bow-end forward manner when navigating at its highest speed both on the surface of the water and when submerged.

103. The submarine according to claim 101, further comprising a central framework, wherein the planing hull, means for propulsion, and pressure hull passenger compartment are each attached to the central framework.

104. The submarine according to claim 101, further comprising a ballast system with at least one fully-controllable ballast compartment, wherein the combined volume of the at least one fully-controllable ballast compartment is from approximately 125% to approximately 315% of the total volume of said passenger compartment.

105. The submarine according to claim 104, wherein the combined volume of the at least one fully-controllable ballast compartment is approximately 200% of the total volume of said passenger compartment.

106. The submarine according to claim 101, further comprising a ballast system with at least one fully-controllable ballast compartment, wherein the combined volume of the at least one fully-controllable ballast compartment is from approximately 75% to approximately 125% of the total volume of surface displacement of the submarine.

107. The submarine according to claim 106, wherein the combined volume of the at least one fully-controllable ballast compartment is approximately 100% of the total volume of surface displacement of the submarine.

108. The submarine according to claim 101, wherein the means for propulsion comprises a surface engine compartment housing at least one engine.

109. The submarine according to claim 108, wherein said surface engine compartment is ambient-pressure compensated.

110. The submarine according to claim 109, wherein said surface engine compartment contains an ambient core reader.

111. The submarine according to claim 110, wherein said ambient core reader comprises a pipe at least one float trigger.

112. The submarine according to claim 111, wherein said pipe is about 18 inches long.

113. The submarine according to claim 111, wherein said at least one float trigger is separated from any other float triggers and from both openings of said pipe by at least 3 inches.

114. The submarine according to claim 101, wherein any through-hull penetrations in the pressure hull are located in the lowest third of the volume of said pressure hull.

115. The submarine according to claim 101, further comprising a ballast system comprising at least one ballast compartment, wherein said at least one variable displacement fuel cell is disposed within at least one ballast compartment.

116. The submarine according to claim 108, wherein said at least one engine is connected to an out drive.

117. The submarine according to claim 101, wherein said variable displacement fuel cell comprises a flexible material.

118. The submarine according to claim 117, wherein said flexible material is a flexible polymer material.

119. The submarine according to claim 101, further comprising an upper body works.

120. The submarine according to claim 119, wherein said upper body works comprises at least one semi-controllable ballast zone.

121. The submarine according to claim 119, wherein said upper body works comprises at least one stability tank.

122. The submarine according to claim 119, wherein said upper body works comprises 2 side decks and 1 rear deck.

123. The submarine according to claim 119, wherein said upper body works comprises at least one manipulator arm.

124. The submarine according to claim 119, wherein said upper body works comprises at least one well.

125. The submarine according to claim 101, further comprising at least one submersion pod.

126. The submarine according to claim 101, further comprising at least one submersion pod housing at least one battery.

127. The submarine according to claim 101, further comprising at least one air grid.

128. The submarine according to claim 127, comprising a high-pressure air storage grid, an emergency air grid, an ambient-pressure air compensation grid, and an oxygen grid.

129. The submarine according to claim 128, wherein said high-pressure air storage grid comprises at least one SCBA compressor, at least one storage tank, at least one hose, and at least one valve.

130. The submarine according to claim 129, wherein said at least one SCBA compressor is rated to about 5,000 psi.

131. The submarine according to claim 129, wherein said high-pressure air storage grid further comprises at least one takeoff valve.

132. The submarine according to claim 128, wherein said emergency air grid comprises at least one air storage tank capable of storing air at about 5,000 psi.

133. The submarine according to claim 128, further comprising a low-pressure primary air grid which operates at a pressure of about 240 psi.

134. The submarine according to claim 128, wherein said ambient-pressure air compensation grid connects to an ambient core manifold.

135. The submarine according to claim 134, wherein ambient core manifold also serves as a surface engine compartment.

136. The submarine according to claim 128, wherein said oxygen grid comprises at least one oxygen tank and at least one connection to said passenger compartment.

137. The submarine according to claim 101, further comprising carbon dioxide scrubber material.

138. The submarine according to claim 137, further comprising at least one oxygen tank, wherein said at least one oxygen tank and said carbon dioxide scrubber material are sufficient to provide life support for 5 adult humans for at least 40 hours.

139. The submarine according to claim 101, further comprising at least 2 side tanks.

140. The submarine according to claim 139, wherein the total combined volume of said side tanks is about 195 cubic feet.

141. The submarine according to claim 139, wherein the total combined volume of said side tanks is at least 200 cubic feet.

142. The submarine according to claim 139, wherein each of said side tanks is divided internally into at least 3 compartments.

143. The submarine according to claim 101, comprising a ballast system, wherein said ballast system comprises at least one internal ballast compartment contained within said planing hull and at least one external ballast compartment contained within at least one side tank.

144. The submarine according to claim 143, wherein said at least one internal ballast compartment is connected to an external ballast compartment via a pea trap connection.

145. The submarine according to claim 143, wherein said at least one internal ballast compartment is lined with a ballast liner.

146. The submarine according to claim 143, wherein said at least one internal ballast compartment is open to the environment on the bottom.

147. The submarine according to claim 143, wherein said at least one external ballast compartment is ambient-pressure compensated.

148. The submarine according to claim 101, wherein said submarine has a length of less than 50 feet.

149. The submarine according to claim 148, wherein said submarine has a length of less than 35 feet.

150. The submarine according to claim 149, wherein said submarine has a length of less than 20 feet.

151. The submarine according to claim 150, wherein said submarine has a length of less than 10 feet.

152. The submarine according to claim 101, wherein said submarine has a width of less than 20 feet.

153. The submarine according to claim 152, wherein said submarine has a width of less than 10 feet.

154. The submarine according to claim 101, wherein said submarine has a height of less than 10 feet.

155. The submarine according to claim 154, wherein said submarine has a height of less than 6 feet.

156. The submarine according to claim 101, wherein said submarine has a total dry weight of between about 2,500 pounds and about 60,000 pounds.

157. The submarine according to claim 156, wherein said submarine has a total dry weight of between about 2,500 pounds and about 30,000 pounds.

158. The submarine according to claim 157, wherein said submarine has a total dry weight of between about 2,500 pounds and about 15,000 pounds.

159. The submarine according to claim 101, wherein said pressure hull is rated to a depth of at least 50 feet.

160. The submarine according to claim 159, wherein said pressure hull is rated to a depth of at least 200 feet.

161. The submarine according to claim 160, wherein said pressure hull is rated to a depth of at least 600 feet.

162. The submarine according to claim 161, wherein said pressure hull is rated to a depth of at least 1200 feet.

163. The submarine according to claim 162, wherein said pressure hull is rated to a depth of at least 1500 feet.

164. The submarine according to claim 101, wherein said passenger compartment comprises an air conditioner.

165. The submarine according to claim 101, wherein said passenger compartment comprises a cylinder with hemispherical ends, wherein the outside diameter of said passenger compartment is about 4 feet, and wherein the length of said passenger compartment is about 15 feet.

166. The submarine according to claim 101, wherein said variable displacement fuel cell comprises a baffle.

167. The submarine according to claim 101, wherein the combined volume of said at least one variable displacement fuel cell is at least 50 gallons.

168. The submarine according to claim 167, wherein the combined volume of said at least one variable displacement fuel cell is at least 100 gallons.

169. The submarine according to claim 168, wherein the combined volume of said at least one variable displacement fuel cell is at least 200 gallons.

170. The submarine according to claim 169, wherein the combined volume of said at least one variable displacement fuel cell is at least 500 gallons.

171. The submarine according to claim 101, wherein said passenger compartment comprises at least one acrylic viewing window.

172. The submarine according to claim 171, wherein said planing hull comprises at least one acrylic viewing window.

173. The submarine according to claim 101, said fuel system further comprising a fuel grid.

174. The submarine according to claim 173, wherein said fuel grid comprises at least one pump used to pump fuel out of said at least one variable displacement fuel cell.

175. The submarine according to claim 101, comprising a ballast system, wherein said ballast system comprises at least one pump.

176. The submarine according to claim 101, wherein said submarine is capable of surface operation at a speed of at least 10 miles per hour.

177. The submarine according to claim 176, wherein said submarine is capable of surface operation at a speed of at least 20 miles per hour.

178. The submarine according to claim 177, wherein said submarine is capable of surface operation at a speed of at least 30 miles per hour.

179. The submarine according to claim 178, wherein said submarine is capable of surface operation at a speed of at least 40 miles per hour.

180. The submarine according to claim 179, wherein said submarine is capable of surface operation at a speed of at least 60 miles per hour.

181. The submarine according to claim 101, wherein said submarine has a power-to-weight ratio during surface operation of at least 1 horsepower per 50 pounds.

182. The submarine according to claim 181, wherein said power-to-weight ratio during surface operation is at least 1 horsepower per 35 pounds.

183. The submarine according to claim 182, wherein said power-to-weight ratio during surface operation is at least 1 horsepower per 25 pounds.

184. The submarine according to claim 183, wherein said power-to-weight ratio during surface operation is at least 1 horsepower per 10 pounds.

185. The submarine according to claim 101, wherein said submarine is capable of safely operating on its own with human passengers for at least 40 consecutive hours.

186. The submarine according to claim 101, wherein said submarine is purpose-configurable.

187. The submarine according to claim 101, wherein the planing hull and the passenger compartment are integrated into a single chassis.

188. The submarine according to claim 101, wherein the planing hull and the passenger compartment each comprise reinforcing members.

189. The submarine according to claim 188, wherein the reinforcing members comprise steel.

190. The submarine according to claim 188, wherein the reinforcing members comprise composite material.

191. The submarine according to claim 188, wherein the reinforcing members comprise aluminum.

192. The submarine according to claim 188, wherein the planing hull and the passenger compartment each comprise mounting brackets.

193. The submarine according to claim 188, wherein the planing hull and the passenger compartment each comprise pre-drilled mounting holes.

194. The submarine according to claim 103, wherein said central framework comprises steel.

195. The submarine according to claim 103, wherein said central framework comprises composite material.

196. The submarine according to claim 103, wherein said central framework comprises aluminum.

197. A submarine comprising:

a passenger compartment; and a ballast system comprising at least one semi-controllable ballast zone;

said ballast system further comprising at least one ballast compartment and at least one variable displacement fuel cell disposed within said at least one ballast compartment;

wherein said at least one semi-controllable ballast zone is open to the environment and is substantially free of water when the submarine navigates on the surface of a body of water; and wherein said at least one semi-controllable ballast zone is filled with water when the submarine is submerged; and wherein when the submarine, while surfacing, rises to a point such that the at least one semi-controllable ballast zone breaches the surface, then by action of gravity water drains from at least the majority of the semi-controllable ballast zone volume.

198. The submarine according to claim 197, wherein said passenger compartment comprises a pressure hull.

199. The submarine according to claim 197, further comprising a central framework, wherein the passenger compartment is attached to the central framework.

200. The submarine according to claim 197, wherein the ballast system comprises at least one fully-controllable ballast compartment.

201. The submarine according to claim 200, wherein the combined volume of the at least one fully-controllable ballast compartment is from approximately 125% to approximately 315% of the total volume of said passenger compartment.

202. The submarine according to claim 201, wherein the combined volume of the at least one fully-controllable ballast compartment is approximately 200% of the total volume of said passenger compartment.

203. The submarine according to claim 200, wherein the combined volume of the at least one fully-controllable ballast compartment is from approximately 75% to approximately 125% of the total volume of surface displacement of the submarine.

204. The submarine according to claim 203, wherein the combined volume of the at least one fully-controllable ballast compartment is approximately 100% of the total volume of surface displacement of the submarine.

205. The submarine according to claim 197, wherein the submarine, while surfacing, rises to a point such that the at least one semi-controllable ballast zone breaches the surface, then by action of gravity water drains from at least 65% of the semi-controllable ballast zone volume.

206. The submarine according to claim 205, wherein the submarine, while surfacing, rises to a point such that the at least one semi-controllable ballast zone breaches the surface, then by action of gravity water drains from at least 70% of the semi-controllable ballast zone volume.

207. The submarine according to claim 206, wherein the submarine, while surfacing, rises to a point such that the at least one semi-controllable ballast zone breaches the surface, then by action of gravity water drains from at least 75% of the semi-controllable ballast zone volume.

208. The submarine according to claim 197, further comprising a planing hull.

209. The submarine according to claim 197, further comprising a surface engine compartment housing at least one engine.

210. The submarine according to claim 209, wherein part of said at least one semi-controllable ballast zone surrounds said surface engine compartment.

211. The submarine according to claim 209, wherein said surface engine compartment is ambient-pressure compensated.

212. The submarine according to claim 211, wherein said surface engine compartment contains an ambient core reader.

213. The submarine according to claim 212, wherein said ambient core reader comprises a pipe and at least one float trigger.

214. The submarine according to claim 213, wherein said pipe is about 18 inches long.

215. The submarine according to claim 213, wherein said at least one float trigger is separated from any other float triggers and from both openings of said pipe by at least 3 inches.

216. The submarine according to claim 209, wherein said at least one engine is connected to an out drive.

217. The submarine according to claim 197, wherein said variable displacement fuel cell comprises a flexible material.

218. The submarine according to claim 217, wherein said flexible material is a flexible polymer material.

219. The submarine according to claim 197, further comprising an upper body works.

220. The submarine according to claim 219, wherein said upper body works comprises at least one semi-controllable ballast zone.

221. The submarine according to claim 219, wherein said upper body works comprises at least one stability tank.

222. The submarine according to claim 219, wherein said upper body works comprises 2 side decks and 1 rear deck.

223. The submarine according to claim 219, wherein said upper body works comprises at least one manipulator arm.

224. The submarine according to claim 219, wherein said upper body works comprises at least one weapon mount.

225. The submarine according to claim 219, wherein said upper body works comprises at least one well.

226. The submarine according to claim 197, further comprising at least one submersion pod.

227. The submarine according to claim 197, further comprising at least one submersion pod housing at least one battery.

228. The submarine according to claim 197, further comprising at least one air grid.

229. The submarine according to claim 228, comprising a high-pressure air storage grid, an emergency air grid, an ambient-pressure air compensation grid, and an oxygen grid.

230. The submarine according to claim 229, wherein said high-pressure air storage grid comprises at least one SCBA compressor, at least one storage tank, at least one hose, and at least one valve.

231. The submarine according to claim 230, wherein said at least one SCBA compressor is rated to about 5,000 psi.

232. The submarine according to claim 230, wherein said high-pressure air storage grid further comprises at least one takeoff valve.

233. The submarine according to claim 229, wherein said emergency air grid comprises at least one air storage tank capable of storing air at about 5,000 psi.

234. The submarine according to claim 229, further comprising a low-pressure primary air grid which operates at a pressure of about 240 psi.

235. The submarine according to claim 229, wherein said ambient-pressure air compensation grid connects to an ambient core manifold.

236. The submarine according to claim 235, wherein said ambient core manifold also serves as a surface engine compartment.

237. The submarine according to claim 229, wherein said oxygen grid comprises at least one oxygen tank and at least one connection to said passenger compartment.

238. The submarine according to claim 197, further comprising carbon dioxide scrubber material.

239. The submarine according to claim 238, further comprising at least one oxygen tank, wherein said at least one oxygen tank and said carbon dioxide scrubber material are sufficient to provide life support for 5 adult humans for at least 40 hours.

240. The submarine according to claim 197, further comprising at least 2 side tanks.

241. The submarine according to claim 240, wherein the total combined volume of said side tanks is about 195 cubic feet.

242. The submarine according to claim 240, wherein the total combined volume of said side tanks is at least 200 cubic feet.

243. The submarine according to claim 240, wherein each of said side tanks is divided internally into at least 3 compartments.

244. The submarine according to claim 197, comprising at least one internal ballast compartment contained within a surface hull and at least one external ballast compartment contained within at least one side tank.

245. The submarine according to claim 244, wherein said at least one internal ballast compartment is connected to an external ballast compartment via a pea trap connection.

246. The submarine according to claim 244, wherein said at least one internal ballast compartment is lined with a ballast liner.

247. The submarine according to claim 244, wherein said at least one internal ballast compartment is open to the environment on the bottom.

248. The submarine according to claim 244, wherein said at least one external ballast compartment is ambient-pressure compensated.

249. The submarine according to claim 197, wherein said submarine has a length of less than 50 feet.

250. The submarine according to claim 249, wherein said submarine has a length of less than 35 feet.

251. The submarine according to claim 250, wherein said submarine has a length of less than 20 feet.

252. The submarine according to claim 251, wherein said submarine has a length of less than 10 feet.

253. The submarine according to claim 197, wherein said submarine has a width of less than 20 feet.

254. The submarine according to claim 253, wherein said submarine has a width of less than 10 feet.

255. The submarine according to claim 197, wherein said submarine has a height of less than 10 feet.

256. The submarine according to claim 255, wherein said submarine has a height of less than 6 feet.

257. The submarine according to claim 197, wherein said submarine has a total dry weight of between about 2,500 pounds and about 60,000 pounds.

258. The submarine according to claim 257, wherein said submarine has a total dry weight of between about 2,500 pounds and about 30,000 pounds.

259. The submarine according to claim 258, wherein said submarine has a total dry weight of between about 2,500 pounds and about 15,000 pounds.

260. The submarine according to claim 198, wherein said pressure hull is rated to a depth of at least 50 feet.

261. The submarine according to claim 260, wherein said pressure hull is rated to a depth of at least 200 feet.

262. The submarine according to claim 261, wherein said pressure hull is rated to a depth of at least 600 feet.

263. The submarine according to claim 262, wherein said pressure hull is rated to a depth of at least 1200 feet.

264. The submarine according to claim 263, wherein said pressure hull is rated to a depth of at least 1500 feet.

265. The submarine according to claim 197, wherein said passenger compartment comprises an air conditioner.

266. The submarine according to claim 198, wherein said passenger compartment comprises a cylinder with hemispherical ends, wherein the outside diameter of said passenger compartment is about 4 feet, and wherein the length of said passenger compartment is about 15 feet.

267. The submarine according to claim 197, wherein said variable displacement fuel cell comprises a baffle.

268. The submarine according to claim 197, wherein the combined volume of said at least one variable displacement fuel cell is at least 50 gallons.

269. The submarine according to claim 268, wherein the combined volume of said at least one variable displacement fuel cell is at least 100 gallons.

270. The submarine according to claim 269, wherein the combined volume of said at least one variable displacement fuel cell is at least 200 gallons.

271. The submarine according to claim 270, wherein the combined volume of said at least one variable displacement fuel cell is at least 500 gallons.

272. The submarine according to claim 197, wherein said passenger compartment comprises at least one acrylic viewing window.

273. The submarine according to claim 272, further comprising a surface hull, wherein said surface hull comprises at least one acrylic viewing window.

274. The submarine according to claim 197, further comprising a fuel grid to which said variable displacement fuel cell is in fluid connection.

275. The submarine according to claim 274, wherein said fuel grid comprises at least one pump used to pump fuel out of said at least one variable displacement fuel cell.

276. The submarine according to claim 197, wherein said ballast system comprises at least one pump.

277. The submarine according to claim 197, wherein said submarine is capable of surface operation at a speed of at least 10 miles per hour.

278. The submarine according to claim 276, wherein said submarine is capable of surface operation at a speed of at least 20 miles per hour.

279. The submarine according to claim 278, wherein said submarine is capable of surface operation at a speed of at least 30 miles per hour.

280. The submarine according to claim 279, wherein said submarine is capable of surface operation at a speed of at least 40 miles per hour.

281. The submarine according to claim 280, wherein said submarine is capable of surface operation at a speed of at least 60 miles per hour.

282. The submarine according to claim 197, wherein said submarine has a power-to-weight ratio during surface operation of at least 1 horsepower per 50 pounds.

283. The submarine according to claim 282, wherein said power-to-weight ratio during surface operation is at least 1 horsepower per 35 pounds.

284. The submarine according to claim 283, wherein said power-to-weight ratio during surface operation is at least 1 horsepower per 25 pounds.

285. The submarine according to claim 284, wherein said power-to-weight ratio during surface operation is at least 1 horsepower per 10 pounds.

286. The submarine according to claim 197, wherein said submarine is capable of safely operating on its own with human passengers for at least 40 consecutive hours.

287. The submarine according to claim 197, further comprising a surface hull, wherein the surface hull and the passenger compartment are integrated into a single chassis.

288. The submarine according to claim 197, further comprising a surface hull, wherein the surface hull and the passenger compartment each comprise reinforcing members.

289. The submarine according to claim 288, wherein the reinforcing members comprise steel.

290. The submarine according to claim 288, wherein the reinforcing members comprise composite material.

291. The submarine according to claim 288, wherein the reinforcing members comprise aluminum.

292. The submarine according to claim 288, further comprising a surface hull, wherein the surface hull and the passenger compartment each comprise mounting brackets.

293. The submarine according to claim 288, further comprising a surface hull, wherein the surface hull and the passenger compartment each comprise pre-drilled mounting holes.

294. The submarine according to claim 199, wherein the central framework comprises steel.

295. The submarine according to claim 199, wherein the central framework comprises composite material.

296. The submarine according to claim 199, wherein the central framework comprises aluminum.

297. A submarine comprising:

a passenger compartment;

a ballast system comprising at least one ballast compartment;

at least one variable displacement fuel cell disposed in said at least one ballast compartment;

an ambient core manifold; and an ambient core reader.

298. The submarine according to claim 297, wherein said ambient core manifold is a surface engine compartment housing at least one engine.

299. The submarine according to claim 297, wherein said ambient core reader comprises a pipe at least one float trigger.

300. The submarine according to claim 299 wherein said pipe is about 18 inches long.

301. The submarine according to claim 299, wherein the at least one float trigger is separated from any other float triggers and from both openings of said pipe by at least 3 inches.

302. The submarine according to claim 297, wherein said passenger compartment comprises a pressure hull.

303. The submarine according to claim 297, further comprising a central framework, wherein the passenger compartment is attached to the central framework.

304. The submarine according to claim 297, wherein the ballast system comprises at least one fully-controllable ballast compartment.

305. The submarine according to claim 304, wherein the combined volume of the at least one fully-controllable ballast compartment is from approximately 125% to approximately 315% of the total volume of said passenger compartment.

306. The submarine according to claim 305, wherein the combined volume of the at least one fully-controllable ballast compartment is approximately 200% of the total volume of said passenger compartment.

307. The submarine according to claim 304, wherein the combined volume of the at least one fully-controllable ballast compartment is from approximately 75% to approximately 125% of the total volume of surface displacement of the submarine.

308. The submarine according to claim 307, wherein the combined volume of the at least one fully-controllable ballast compartment is approximately 100% of the total volume of surface displacement of the submarine.

309. The submarine according to claim 297, further comprising a planing hull.

310. The submarine according to claim 298, wherein said at least one engine is connected to an out drive.

311. The submarine according to claim 297, wherein said variable displacement fuel cell comprises a flexible material.

312. The submarine according to claim 311, wherein said flexible material is a flexible polymer material.

313. The submarine according to claim 297, further comprising an upper body works.

314. The submarine according to claim 313, wherein said upper body works comprises at least one semi-controllable ballast zone.

315. The submarine according to claim 313, wherein said upper body works comprises at least one stability tank.

316. The submarine according to claim 313, wherein said upper body works comprises 2 side decks and 1 rear deck.

317. The submarine according to claim 313, wherein said upper body works comprises at least one manipulator arm.

318. The submarine according to claim 313, wherein said upper body works comprises at least one weapon mount.

319. The submarine according to claim 313, wherein said upper body works comprises at least one well.

320. The submarine according to claim 297, further comprising at least one submersion pod.

321. The submarine according to claim 297, further comprising at least one submersion pod housing at least one battery.

322. The submarine according to claim 297, further comprising at least one air grid.

323. The submarine according to claim 322, comprising a high-pressure air storage grid, an emergency air grid, an ambient-pressure air compensation grid, and an oxygen grid.

324. The submarine according to claim 323, wherein said high-pressure air storage grid comprises at least one SCBA compressor, at least one storage tank, at least one hose, and at least one valve.

325. The submarine according to claim 324, wherein said at least one SCBA compressor is rated to about 5,000 psi.

326. The submarine according to claim 324, wherein said high-pressure air storage grid further comprises at least one takeoff valve.

327. The submarine according to claim 324, wherein said emergency air grid comprises at least one air storage tank capable of storing air at about 5,000 psi.

328. The submarine according to claim 323, further comprising a low-pressure primary air grid which operates at a pressure of about 240 psi.

329. The submarine according to claim 323, wherein said ambient-pressure air compensation grid connects to the ambient core manifold.

330. The submarine according to claim 323, wherein said oxygen grid comprises at least one oxygen tank and at least one connection to said passenger compartment.

331. The submarine according to claim 297, further comprising carbon dioxide scrubber material.

332. The submarine according to claim 331, further comprising at least one oxygen tank, wherein said at least one oxygen tank and said carbon dioxide scrubber material are sufficient to provide life support for 5 adult humans for at least 40 hours.

333. The submarine according to claim 297, further comprising at least 2 side tanks.

334. The submarine according to claim 333, wherein the total combined volume of said side tanks is about 195 cubic feet.

335. The submarine according to claim 333, wherein the total combined volume of said side tanks is at least 200 cubic feet.

336. The submarine according to claim 333, wherein each of said side tanks is divided internally into at least 3 compartments.

337. The submarine according to claim 297, comprising at least one internal ballast compartment contained within a surface hull and at least one external ballast compartment contained within at least one side tank.

338. The submarine according to claim 335, wherein said at least one internal ballast compartment is connected to an external ballast compartment via a pea trap connection.

339. The submarine according to claim 335, wherein said at least one internal ballast compartment is lined with a ballast liner.

340. The submarine according to claim 335, wherein said at least one internal ballast compartment is open to the environment on the bottom.

341. The submarine according to claim 337, wherein said at least one external ballast compartment is ambient-pressure compensated.

342. The submarine according to claim 297, wherein said submarine has a length of less than 50 feet.

343. The submarine according to claim 342, wherein said submarine has a length of less than 35 feet.

344. The submarine according to claim 343, wherein said submarine has a length of less than 20 feet.

345. The submarine according to claim 344, wherein said submarine has a length of less than 10 feet.

346. The submarine according to claim 297, wherein said submarine has a width of less than 20 feet.

347. The submarine according to claim 248, wherein said submarine has a width of less than 10 feet.

348. The submarine according to claim 297, wherein said submarine has a height of less than 10 feet.

349. The submarine according to claim 348, wherein said submarine has a height of less than 6 feet.

350. The submarine according to claim 297, wherein said submarine has a total dry weight of between about 2,500 pounds and about 60,000 pounds.

351. The submarine according to claim 350, wherein said submarine has a total dry weight of between about 2,500 pounds and about 30,000 pounds.

352. The submarine according to claim 351, wherein said submarine has a total dry weight of between about 2,500 pounds and about 15,000 pounds.

353. The submarine according to claim 302, wherein said pressure hull is rated to a depth of at least 50 feet.

354. The submarine according to claim 353, wherein said pressure hull is rated to a depth of at least 200 feet.

355. The submarine according to claim 354, wherein said pressure hull is rated to a depth of at least 600 feet.

356. The submarine according to claim 355, wherein said pressure hull is rated to a depth of at least 1200 feet.

357. The submarine according to claim 356, wherein said pressure hull is rated to a depth of at least 1500 feet.

358. The submarine according to claim 297, wherein said passenger compartment comprises an air conditioner.

359. The submarine according to claim 302, wherein said passenger compartment comprises a cylinder with hemispherical ends, wherein the outside diameter of said passenger compartment is about 4 feet, and wherein the length of said passenger compartment is about 15 feet.

360. The submarine according to claim 297, wherein said variable displacement fuel cell comprises a baffle.

361. The submarine according to claim 297, wherein the combined volume of said at least one variable displacement fuel cell is at least 50 gallons.

362. The submarine according to claim 361, wherein the combined volume of said at least one variable displacement fuel cell is at least 100 gallons.

363. The submarine according to claim 362, wherein the combined volume of said at least one variable displacement fuel cell is at least 200 gallons.

364. The submarine according to claim 363, wherein the combined volume of said at least one variable displacement fuel cell is at least 500 gallons.

365. The submarine according to claim 297, wherein said passenger compartment comprises at least one acrylic viewing window.

366. The submarine according to claim 365, further comprising a surface hull, wherein said surface hull comprises at least one acrylic viewing window.

367. The submarine according to claim 297, further comprising a fuel grid to which said variable displacement fuel cell is in fluid connection.

368. The submarine according to claim 367, wherein said fuel grid comprises at least one pump used to pump fuel out of said at least one variable displacement fuel cell.

369. The submarine according to claim 297, wherein said ballast system comprises at least one pump.

370. The submarine according to claim 297, wherein said submarine is capable of surface operation at a speed of at least 10 miles per hour.

371. The submarine according to claim 370, wherein said submarine is capable of surface operation at a speed of at least 20 miles per hour.

372. The submarine according to claim 371, wherein said submarine is capable of surface operation at a speed of at least 30 miles per hour.

373. The submarine according to claim 372, wherein said submarine is capable of surface operation at a speed of at least 40 miles per hour.

374. The submarine according to claim 373, wherein said submarine is capable of surface operation at a speed of at least 60 miles per hour.

375. The submarine according to claim 297, wherein said submarine has a power-to-weight ratio during surface operation of at least 1 horsepower per 50 pounds.

376. The submarine according to claim 375, wherein said power-to-weight ratio during surface operation is at least 1 horsepower per 35 pounds.

377. The submarine according to claim 376, wherein said power-to-weight ratio during surface operation is at least 1 horsepower per 25 pounds.

378. The submarine according to claim 377, wherein said power-to-weight ratio during surface operation is at least 1 horsepower per 10 pounds.

379. The submarine according to claim 297, wherein said submarine is capable of safely operating on its own with human passengers for at least 40 consecutive hours.

380. The submarine according to claim 297, further comprising a surface hull, wherein the surface hull and the passenger compartment are integrated into a single chassis.

381. The submarine according to claim 297, further comprising a surface hull, wherein the surface hull and the passenger compartment each comprise reinforcing members.

382. The submarine according to claim 381, wherein the reinforcing members comprise steel.

383. The submarine according to claim 381, wherein the reinforcing members comprise composite material.

384. The submarine according to claim 381, wherein the reinforcing members comprise aluminum.

385. The submarine according to claim 381, further comprising a surface hull, wherein the surface hull and the passenger compartment each comprise mounting brackets.

386. The submarine according to claim 381, further comprising a surface hull, wherein the surface hull and the passenger compartment each comprise pre-drilled mounting holes.

387. The submarine according to claim 303, wherein said central framework comprises steel.

388. The submarine according to claim 303, wherein said central framework comprises composite material.

389. The submarine according to claim 303, wherein said central framework comprises aluminum.

* * * * *

UNITED STATES PATENT AND TRADEMARK OFFICE

CERTIFICATE OF CORRECTION

PATENT NO. : 7,856,938 B2
APPLICATION NO. : 11/774356
DATED : December 28, 2010
INVENTOR(S) : Reynolds Martin, Ezra Eugene Mock and Scott Anthony Shamblin It is certified that error appears in the above-identified patent and that said Letters Patent is hereby corrected as shown below:

Column 7,
Line 27, “can be constricted” should read --can be constructed--.

Column 8,
Line 23, “to be able dispense” should read --to be able to dispense--.

Column 20,
Line 16, “rise tip in” should read --rise up in--.

Column 25,
Line 53, “manipulator anus 55” should read --manipulator arms 55--.

Column 28,
Line 5, “1 rims” should read --1 runs--.

Column 31,
Line 42, “pressure bull” should read --pressure hull--.
Line 55, “while oil the surface” should read --while on the surface--.

Column 35,
Line 50, “if part of” should read --in part of--.

Column 40,
Line 23, “She upper” should read --The upper--.

Column 41,
Line 28, “surface bull 42” should read --surface hull 42--.

Signed and Sealed this
Seventh Day of February, 2012

David J. Kappos

David J. Kappos
*Director of the United States Patent and Trademark Office*

Column 46,
Line 57, “is at least at least 40” should read --is at least 40--.

Column 47,
Line 31, “hydraulic rains” should read --hydraulic rams--.

Column 48,
Line 25, “the don-ant” should read --the dormant--.

Column 63,
Line 24, Claim 33, “according to claim 23” should read --according to claim 32--.

Column 73,
Line 59, Claim 278, “according to claim 276” should read --according to claim 280--.

Column 76,
Line 55, Claim 347, “according to claim 248” should read --according to claim 346--.